US006830108B2

(12) United States Patent
Rogers, Jr.

(10) Patent No.: US 6,830,108 B2
(45) Date of Patent: Dec. 14, 2004

(54) PLUNGER ENHANCED CHAMBER LIFT FOR WELL INSTALLATIONS

(75) Inventor: Jack R. Rogers, Jr., Tyler, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/440,903

(22) Filed: May 19, 2003

(65) Prior Publication Data

US 2004/0216886 A1 Nov. 4, 2004

Related U.S. Application Data

(60) Provisional application No. 60/467,167, filed on May 1, 2003.

(51) Int. Cl.[7] ..... E21B 43/00; E21B 33/068; F04B 47/12

(52) U.S. Cl. ..... 166/372; 166/53; 166/105; 166/386; 417/57; 417/58

(58) Field of Search ..... 166/369, 370, 166/372, 373, 371, 381, 386, 53, 105; 417/56, 57, 58, 60

(56) References Cited

U.S. PATENT DOCUMENTS 3,991,825 A * 11/1976 Morgan ..... 166/68
4,150,721 A 4/1979 Norwood
4,352,376 A 10/1982 Norwood
4,685,522 A * 8/1987 Dixon et al. ..... 166/372
4,921,048 A 5/1990 Crow et al.
5,146,991 A 9/1992 Rogers, Jr.
5,374,163 A * 12/1994 Jaikaran ..... 417/172
5,911,278 A * 6/1999 Reitz ..... 166/372
6,672,392 B2 * 1/2004 Reitz ..... 166/372
2002/0074118 A1 * 6/2002 Fisher ..... 166/250.15
2003/0183394 A1 * 10/2003 Reitz ..... 166/370

OTHER PUBLICATIONS

Brown et al., "The Technology of Artificial Lift Methods," vol. 2a, pp 125–128, 324, Pennwell Publishing Co., (Tulsa, OK) (1980).

* cited by examiner

*Primary Examiner*—David Bagnell
*Assistant Examiner*—Jennifer H Gay
(74) *Attorney, Agent, or Firm*—Mueller and Smith, LPA

(57) ABSTRACT

Method for operating a well installation utilizing a chamber in operative association with plunger lift to carry out deliquidfication. Injection gas may be employed for plunger lift in a manner wherein the injection channel is isolated from the primary annulus of the well adjacent the casing. Gas is produced through that primary annulus.

129 Claims, 22 Drawing Sheets

3
560
562
IF VV OPEN-CLOSE VENT VALVE
IF IV OPEN-CLOSE INJECTION VALVE
564
566
FAST
TIME ADJUSTMENTS FOR PLUNGER ARRIVAL PERFORMANCE GOOD-FAST-SLOW
SLOW
568
570
4
6
GOOD
572
574
664
704
4A
LOAD TV AF TIME
LOAD CV DEL TIME
START TV AF TIMER
START CV DEL TIMER
6A
576
578
590
5
DECR TV TIMER
DECR CV TIMER
580
582
NO
TV TIMER> MIN OT?
7
592
584
YES
588
586
CV TIMER >0?
NO
8
594
YES

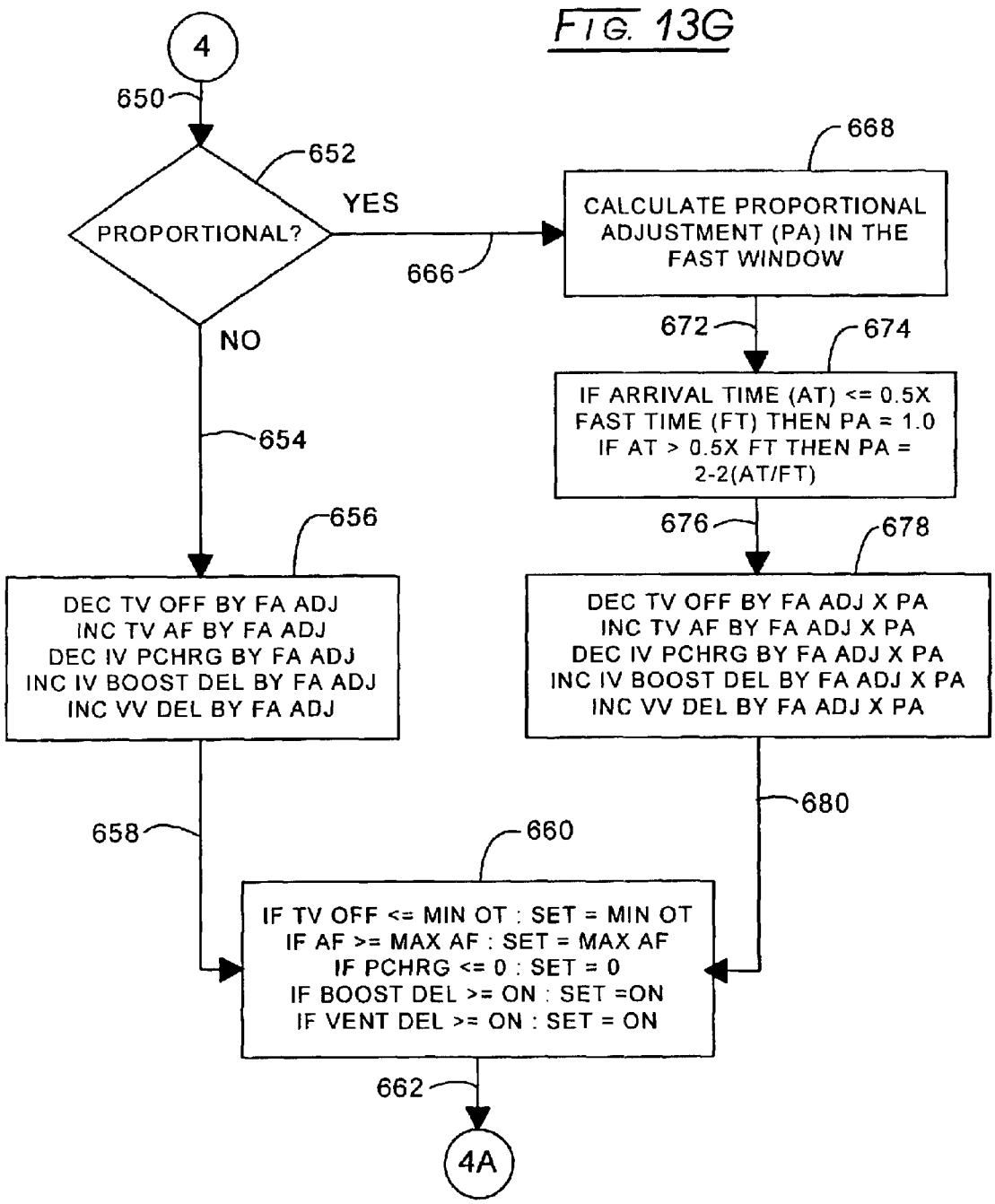
FIG. 13G
4
650
652
PROPORTIONAL?
YES
NO
666
668
CALCULATE PROPORTIONAL ADJUSTMENT (PA) IN THE FAST WINDOW
672
674
IF ARRIVAL TIME (AT) <= 0.5X FAST TIME (FT) THEN PA = 1.0 IF AT > 0.5X FT THEN PA = 2-2(AT/FT)
654
656
676
678
DEC TV OFF BY FA ADJ
INC TV AF BY FA ADJ
DEC IV PCHRG BY FA ADJ
INC IV BOOST DEL BY FA ADJ
INC VV DEL BY FA ADJ
DEC TV OFF BY FA ADJ X PA
INC TV AF BY FA ADJ X PA
DEC IV PCHRG BY FA ADJ X PA
INC IV BOOST DEL BY FA ADJ X PA
INC VV DEL BY FA ADJ X PA
680
658
660
IF TV OFF <= MIN OT : SET = MIN OT
IF AF >= MAX AF : SET = MAX AF
IF PCHRG <= 0 : SET = 0
IF BOOST DEL >= ON : SET =ON
IF VENT DEL >= ON : SET = ON
662
4A 2
730
DECR AF F/NA
INCR OFF F/NA
INCR PRECHG F/NA
732
DECR VV DELAY
DECR IV BST DELAY
INCR IV PUR ON
734
736
738
AF>
MIN OFF
?
NO
10
760
740
YES
TBG OFF =
PRECHG
742
744
START IV
PRECHG
746
748
DECR IV TIMER
750
756
752
754
NO
IV
TIMER
=0?
758
YES
1

PLUNGER ENHANCED CHAMBER LIFT FOR WELL INSTALLATIONS

CROSS REFERENCE TO RELATED APPLICATIONS

This application claims the benefit of U.S. Provisional Application No. 60/467,167 filed May 1, 2003.

STATEMENT REGARDING FEDERALLY SPONSORED RESEARCH

Not applicable.

BACKGROUND OF THE INVENTION

The modern history of the production of fluid hydrocarbons begins in the latter half of the $19^{th}$ century with the vision of a few promoters seeking to exploit "rock oil". Rock oil, as opposed to animal fats or vegetable oil, was observed seeping into salt wells in the isolated wooded hills of western Pennsylvania. From that modest birth, by the $20^{th}$ century, petroleum production had become a predominate world industry. As that industry has developed, the underlying technology has advanced concomitantly.

While wells within some geologic regions are capable of producing under naturally induced reservoir pressures, more commonly encountered are well facilities which employ some form of artificial lift-based production procedure. The purpose of artificial lift is to maintain a reduced producing bottom hole pressure (BHP) such that the involved geologic formation can give up desired reservoir fluids. If a predetermined drawdown pressure can be maintained, a well will produce desired fluids notwithstanding the form of lift involved. In general, lift systems may involve sucker rod pumping (beam pumping), gas lift, electrical submersible pumping, hydraulic pumping, jet pumping, plunger lift, as well as other modalities. See generally:

Brown et al., "The Technology of Artificial Lift Methods, Vol. 2a, Pennwell Publishing Co., Tulsa, Okla. (1980).

One widely employed approach to hydrocarbon fluid production is a non-pumping gas lifting one wherein a cyclical opening and closing of a well is carried out. Generally referred to as "intermitting", this cyclical process provides alternating on-cycles and off-cycles which are established by the operation of a gas driven motor valve which, when utilized in conjunction with gas production, functions to produce gas to a sales line and is referred to as a "sales valve".

The timing involved in intermitting a well has long been considered critical, the timing of on-cycles and off-cycles having been a taxing endeavor to well production. In this regard, early endeavors called upon the technician to monitor many well parameters including tubing pressure, casing pressure, sales line pressure and many other heuristic details. A failure of the intermitting process would typically result in an excessive quantity of liquids being accumulated within the tubing string of the well, a condition generally referred to as "loading up" of the well. This condition represents a failure which may be quite expensive to correct.

For a substantial period of time, control over the cyclical production of wells was based simply upon a crude, clock-operated device. This device required hand winding and thus well location visitation by technicians on a quite frequent basis. Inasmuch as those locations are, for the most part, difficult to access the earlier spring-wound controllers were a source of much frustration to industry. That frustration commenced to end with the introduction to the industry of a long life battery operated controller by W. L. Norwood about 1978. Described in U.S. Pat. No. 4,150,721, entitled Gas Well Controller System, issued Apr. 24, 1979, this seminal and pioneer electric controller provided for long term, battery operated control over wells and served to simplify the control adjustment procedure required of well technicians. Of particular importance, the controller was designed to respond to system parameters to override the cycle timing to accommodate conditions wherein such timing should be overridden and subsequently reinitiated on an automatic basis. Sold under the trademark "Digitrol", the controller, incorporated in a classic green metal box, is still seen to be performing on wells and has had a profound impact upon well production.

At about the time of the introduction of the Norwood controller, some leading petroleum engineers were promoting a plunger method of artificial lift wherein an untethered piston which is referred to as a "plunger" is slidably installed within the tubing string of the well and is permitted to travel the entire length of that tubing string in conjunction with the on-cycles and off-cycles of the well. While promising many advantageous aspects of well production, the plunger lift approach to artificial lift was hindered by a lack of appropriate control. The Norwood controller, being able to respond to plunger arrival at a wellhead essentially permitted the creation of a successful plunger lift based industry.

In 1980, W. L. Norwood introduced the first practical microprocessor driven controller to the industry. This instrument, marketed under the trademark "Liquilift", gave well technicians a substantially expanded capability and flexibility for well control, providing for response to a substantial number of well parameters, as well as for the development of delay techniques to accommodate for temporary system excursions and the like. The initial version of the Liquilift device is described in U.S. Pat. No. 4,352,376 by Norwood, entitled "Controller for Well Installations", issued Oct. 5, 1982.

In 1991, Rogers, Jr., introduced a control technique for plunger lift wells which optimized production through the evaluation of the speed at which the plunger arrives at the wellhead. Deviations from this optimum speed are detected and afterflow times as well as off cycle intervals were then varied to, in effect, "tune" the well toward optimum plunger speed performance. Where excessive low plunger speed was encountered, a second motor valve referred to as a tank or vent valve was opened to vent the well, in effect, to atmospheric pressure. The production technique had a profound impact upon the industry, improving gas production performance, for example, from about 50% to as high as 150%.

The gas lift approach to artificial lift is a method of lifting fluid wherein relatively high pressure gas is used as the lifting medium in a mechanical form of process. In general, gas lift methodology may involve a continuous flow approach or may employ an intermittent lift technique. In continuous flow, a continuous volume of high-pressure gas is introduced to the well to aerate or lighten the fluid column until reduction of the bottom hole pressure will allow sufficient differential across the sand face. To accomplish this, a flow valve is used that will permit the deepest possible one point injection of available gas lift pressure in conjunction with a valve that will act as a changing or variable orifice to regulate gas injected at the surface. This approach is used in wells with a high productivity index (PI) and a reasonably high bottom hole pressure (BHP) relative to well depth.

An intermittent flow gas lift approach involves expansion of a high pressure gas ascending to a low pressure outlet.

This high pressure gas is called upon to drive a slug of liquid from the well. Typically, the intermittent lift is accomplished through the utilization of a multi-point injection of gas through more than one gas lift valve. For such an approach, the installation is designed so that the lowest gas lift valve is opened just as the bottom of the liquid slug passes each such valve. Gas lift approaches, however are inefficient in that there is about a 7% fallback of liquids from the slug for each 1,000 feet of well depth. In this regard, for example, for a well of 10,000 feet depth, 70% of the slug of liquid may be left in the well for each intermitting cycle. Accordingly, much of the energy employed in injecting compressed gas into the well is wasted. Gas lift installations also are hindered by a somewhat ineffective removal of solids such as sand or scale which may accumulate in the well. By contrast, plunger lift procedures will drive such materials from the well by virtue of the necessarily involved efficient plunger to liquid interface. Intermitting approaches to artificial lift procedures also may adversely effect the geologic zone of production involved. In this regard, the well is closed in for an off-cycle interval during which pressure builds against that zone. The effect is more pronounced where injected lifting gas is pressurized against that zone.

Intermitting gas lift installations also will pose problems at the gathering system associated with a well. Such gathering systems are composed of all the lines, separators and low-pressure volume chamber that supply gas to the suction side of the gas lift compressor. If the gas lift cycles are far apart in time, the compressor will be starved of gas between cycles and excessive make-up gas will be required. One solution described for this problem suggests the use of low-pressure volume chamber which save gas for the compressor. Where continuous flow wells are present the problem is substantially ameliorated.

Some gas producing wells are characterized in exhibiting a very high production index (PI). As a consequence, the length of casing perforation admitting production zone gas, referred to as the perforation or pay interval, can be quite extensive, for example, up to about 1,500 feet. Producing these wells with plunger lift procedures is problematic since the tubing string cannot extend to the well bottom which will be located below the perforation zone and determining an end position for inflow with respect to the perforation interval is difficult. The reservoir characteristic associated with these wells also may evoke a low bottom hole pressure (BHP) condition such that significant accumulation of liquids are encountered. A resultant liquid pressure head militates against effective gas production and thus, its removal is called for.

A technique of injection gas lift referred to as a "chamber installation" often is elected for these low BHP, high PI characterized wells.

> Often a chamber installation increases the total oil production. A chamber is an ideal installation to run in a low BHP, high PI well. This well will produce fairly high fluid volumes if a high drawdown is created on the sand face. A chamber allows the lowest flowing BHP possible to obtain by gas lift. The chamber uses the casing volume to store fluids. Brown et al., (supra), pp 125–126.

These chambers may assume a variety of configurations, but function to use the casing volume to store fluids and lower the liquid pressure head. However, as noted above, gas injection lift procedures for these typically deep wells are inefficient due to significant fallback or slippage of the liquid being driven from the well. Where chamber lift is employed fallback falls to 5% per 1000 feet, only a slight improvement, however inefficiency remains significant. See Brown et al., (supra) p 324.

In the same well installations, the liquids are removed with down hole rod string driven pumps. However, in the gassy environment of the wells such positive displacement devices tend to ingest gas and commence to become what is referred to as being "gas locked". As a consequence, the pumps become quite inefficient and are subject to failure. Rod string pump actuation, in and of itself, is difficult in deep wells due to material strain. Further, the pumps must be shut-in periodically to permit liquid buildup such that they can be loaded with liquid to commence pumping. Of course, the pumps are not immune from damage due to solid accumulations at the down hole location.

BRIEF SUMMARY OF THE INVENTION

The present invention is addressed to methods for operating a well installation wherein improved well deliquidification is achieved with chamber configurations which are enhanced with the more positive liquid displacement of plunger lift. Gas production is provided from the larger cross-sectional annulus as defined between the well casing and tubing string to advantageously lower gas flow friction and provide for enhanced production intervals. In one embodiment such production interval is continuous, without interruption.

Where gas under pressure is supplied to the well installation, an injection passageway to the chamber is provided in isolation from the formation zone to carry out a U-tube drive to the plunger, thus avoiding an otherwise deleterious pressurization of the zone.

Key benefits of this method are as follows:

1) Achieve Continuous Flow

> Gas and liquid production is maximized from low bottom hole pressure/high productivity index wells by efficiently removing liquid and producing at the lowest possible bottom hole pressure. This creates the lowest sand/face pressure by producing the formation gas from the primary casing/tubing annulus 24 hours per day.

2) Produce Long Perforated Intervals with Low Bottom Hole Pressure

> Utilization of a chamber configuration allows long perforated pay intervals to be produced at minimum pressure ensuring fluid storage with a minimum amount of head pressure. Injection gas is isolated from the formation by creating a closed chamber system. There is a reduction of the pressure build-up time normally required by adding injection pressure source gas from a source of gas under pressure. Artificially creating this pressure improves cycle frequency and accomplishes maximum draw down on the reservoir.

3) Reduce Friction Through Annular Flow

> Dynamic gas friction is minimized by producing through the larger conduit defined by the primary annulus as opposed to the smaller production tubing to improve inflow performance. Pressure drawndown is maximized by removing the liquids from the well bore and distributing them across the largest cross-sectional area, (i.e. casing/tubing annulus). The tubing can be set low in the well bore creating maximum draw down of pressure as liquid is removed. Traditional plunger lift requires the tubing to be set higher in the well bore.

4) Reduce Formation and Compression Surge

> Compression surge is mitigated by continuous production from the casing/tubing primary annulus. Formation pressure surge is significantly improved by producing the casing/tubing primary annulus 24 hours per day. Reducing the pressure cycle on the formation mitigates sand and solids production. Solids removal is better accomplished by the high frequency of plunger cycles, thus not allowing solids to settle and accumulate in the bottom of the tubing.

5) Total Gas System Management

Requirements for "make-up" gas are minimized by utilizing a semi-closed single well intermittent rotative system. There is a maximization of the use of injection gas when using a gas injection system (i.e. high pressure, clean dry gas). The control theory allows for modification to the injection cycle time based on plunger performance and therefore adjusts the volume of gas injected for the amount of fluid that is being produced. A minimization of gas and liquid production loss is achieved utilizing a concentric tubing concept. Well equipment can be installed and implemented with this concentric tubing concept without having to "kill" the well. This technique minimizes the potential of damaging the reservoir and will improve the speed at which the application will be returned to a producing status.

Another feature and object of the invention is to provide a method for operating a well installation having a casing extending within a geologic formation from a wellhead to a bottom region, the casing having a perforation interval extending to an end location at a given depth, the installation including a collection facility and a source of gas under pressure having an injection output, comprising the steps of:

(a) providing a tubing assembly within the casing including a plunger lift tube having a tube outlet at the wellhead and extending to a tubing input located in adjacency with or below the perforation interval end location communicable in fluid passage relationship with formation fluids and having an injection input;

(b) providing an injection passage adjacent the plunger lift tube extending from the injection output at least to the plunger lift tube injection input;

(c) providing a plunger within the plunger lift tube movable between a bottom position located above the injection input and the wellhead;

(d) providing a formation fluid receiving assembly defining a chamber with the injection passage in fluid communication with the tubing assembly, the chamber having a lower disposed check valve assembly with an open orientation admitting formation fluid within the chamber and responsive to injection fluid pressure to define a U-tube function with the injection passage and the tubing assembly;

(e) providing a tubing valve between the tube outlet and the collection facility actuable between an open orientation permitting the flow of fluid to the collection facility and a closed orientation blocking the tube outlet;

(f) providing an injection control assembly actuable between an open condition effecting application of gas under pressure from the pressurized gas output to the injection gas input and a closed condition;

(g) providing a detector at the wellhead having a detector output in response to the arrival of the plunger at the wellhead;

(h) accumulating formation fluid into the chamber by passage thereof through the check valve assembly;

(i) moving fluid from the chamber into the tubing assembly above the plunger;

(j) actuating the injection control assembly to the open condition to apply gas under pressure to the defined U-tube from the injection input, to impart upward movement to the plunger;

(k) actuating the tubing valve to the open orientation;

(l) actuating the injection control assembly to the closed condition in response to the detector output: and (m) then, actuating the tubing valve into the closed orientation for an off-time interval at least sufficient for the movement of the plunger from the wellhead to the bottom position.

As another feature, the invention provides a method of operating a well installation having a wellhead in fluid transfer relationship with a collection facility and with a well casing extending within a geologic formation and having a perforation interval effectively extending a given depth to an interval depth location, and having a source of gas under pressure with a pressurized gas output, comprising the steps of:

(a) providing an injection passage within the casing, having an injection input coupled with the pressurized gas output extending to an injection outlet and defining a casing production region with the casing;

(b) providing a plunger lift tube at least partially within the injection passage extending from an outlet at the wellhead to a tubing input, the plunger lift tube being communicable in fluid passage relationship with the injection outlet at an injection location;

(c) providing a plunger within the plunger lift tube movable between a bottom position located above the injection location and the wellhead;

(d) providing a formation fluid receiving assembly defining a chamber with the injection passage in fluid communication with the plunger lift tube and the injection outlet, the chamber having a check valve with an open orientation admitting formation fluid within the chamber and responsive to fluid pressure to define a U-tube function with the injection passage and the plunger lift tube;

(e) collecting formation fluid into the plunger lift tube above the plunger bottom position;

(f) communicating the plunger lift tube outlet in fluid transfer relationship with the surface collection facility;

(g) applying injection gas under pressure from the pressurized gas output to the injection input for an injection interval effective to move the plunger to the wellhead and to move formation liquid located above it through the outlet and into the surface collection facility; and (h) communicating the casing production region in gas transfer relationship with the surface collection facility.

Another feature and object of the invention is to provide a method for operating a well installation have a casing extending within a geologic formation from a wellhead to a bottom region, the installation including a collection facility, and having a source of gas under pressure with a pressurized gas output, comprising the steps of:

(a) providing a tubing assembly within the casing having a plunger lift tube with a tube outlet at the wellhead, extending to a tubing input located to receive formation fluid;

(b) providing an injection passage extending from an injection gas input at the wellhead to an injection outlet;

(c) providing a plunger within the plunger lift tube movable between a bottom position and the wellhead;

(d) providing a formation fluid receiving assembly defining a chamber with the injection passage in fluid communication with the plunger lift tube and the injection outlet, the chamber having a check valve with an open orientation admitting formation fluid within the chamber and responsive to fluid pressure to define a U-tube function with the injection passage and the plunger lift tube;

(e) providing a detector at the wellhead having a detector output in response to the arrival of the plunger at the wellhead;

(f) providing a tubing valve between the tube outlet and the collection facility actuable between an open orientation permitting the flow of fluid to the collection facility and a closed orientation blocking the tube outlet;

(g) providing an injection valve between the pressurized gas outlet and the injection gas input actuable between an open orientation effecting application of gas under pressure to the injection outlet and a closed orientation;

(h) providing an equalizing valve in gas flow communication between the injection gas input and the collection facility, actuable between an open orientation providing the flow communication and a closed orientation blocking the flow communication;

(i) accumulating formation fluid into the chamber through the check valve when the equalizing valve is in the open orientation, the injection valve is in its closed orientation and the check valve is in its open orientation;

(j) moving formation fluid accumulated within the chamber into the plunger lift tube above the plunger;

(k) actuating the equalizing valve into the closed orientation;

(l) actuating the injection valve into the open orientation; and (m) actuating the tubing valve into the open orientation to effect movement of the plunger toward the wellhead.

As another feature and object, the invention provides a method of operating a well installation having a wellhead in fluid transfer relationship with a collection facility, having a well casing extending from the wellhead within a geologic formation to a lower region, having a tubing assembly extending within the casing from the wellhead to a fluid input at the lower region, the space between the tubing assembly and the casing defining an annulus, comprising the steps of:

(a) blocking fluid flow within the annulus with an annulus seal;

(b) providing an entrance valve assembly positioned to control fluid flow into the tubing assembly;

(c) providing fluid communication between the annulus and the tubing assembly at a communication entrance within the lower region above the entrance valve assembly and the annulus seal;

(d) providing a plunger within the tubing assembly movable between the wellhead and a bottom location above the communication entrance;

(e) providing a tubing valve in fluid flow communication between the tubing assembly at the wellhead and the collection facility, actuable between open and closed orientations;

(f) accumulating formation fluid through the entrance valve assembly into the tubing assembly and the annulus above the annulus seal;

(g) pressurizing the annulus above the seal for a pre-charge interval;

(h) actuating the tubing valve into the open orientation for a purge interval effective to transfer fluid accumulated in the annulus through the communication entrance into the tubing assembly;

(i) actuating the tubing valve into the closed orientation;

(j) pressurizing the annulus;

(k) actuating the tubing valve into the open orientation to commence an on-time driving the plunger toward the wellhead at a plunger speed;

(l) directing fluid above the plunger into the collection facility;

(m) detecting the arrival of the plunger at the wellhead;

(n) communicating the annulus in fluid flow relationship with the collection facility for an afterflow interval in response to the detected arrival of the plunger at the wellhead;

(o) actuating the tubing valve into the closed orientation for an off-time interval permitting the plunger to move toward the bottom location; and (p) reiterating steps (f) through (o) to define a sequence of well production cycles.

Other objects of the invention will, in part, be obvious and will, in part, appear hereinafter. The invention, accordingly comprises the method possessing the steps which are exemplified in the following detailed disclosure.

For a fuller understanding of the nature and objects of the invention, reference should be had to the following detailed description taken in connection with the accompanying drawings.

BRIEF DESCRIPTION OF THE DRAWINGS

FIGS. 13A–13K combine to provide a flow chart illustrating the control methodology of the invention;

DETAILED DESCRIPTION OF THE INVENTION

In the discourse to follow, the production approach of the invention initially is described in conjunction with a well installation typically exhibiting a relatively low bottom hole pressure (BHP) and high productivity index (PI). The production method may be employed with wells configured with very long pay or effective perforated intervals, intervals of, for instance, 400 feet to 1500 feet not being uncommon with these wells. Employing a plunger enhanced chamber structuring, the method performs to carry out a deliquidification of the wells utilizing plunger technology and with enhanced plunger cycling frequencies. Production is enhanced with this more rapid cycling in consequence of principal gas production being from the casing as opposed to tubing and will be seen to occur, for example, during the movement of the plunger into its bottom position from the wellhead. The larger cross-sectional area for such casing production lowers friction to enhance production further.

The discussion then turns to variations of this deliquidation and pressure reduction approach in terms of chamber definition and, in one arrangement, the employment of formation pressures in replacement of pressurized injection gas displacement of the plunger.

Figure 1:
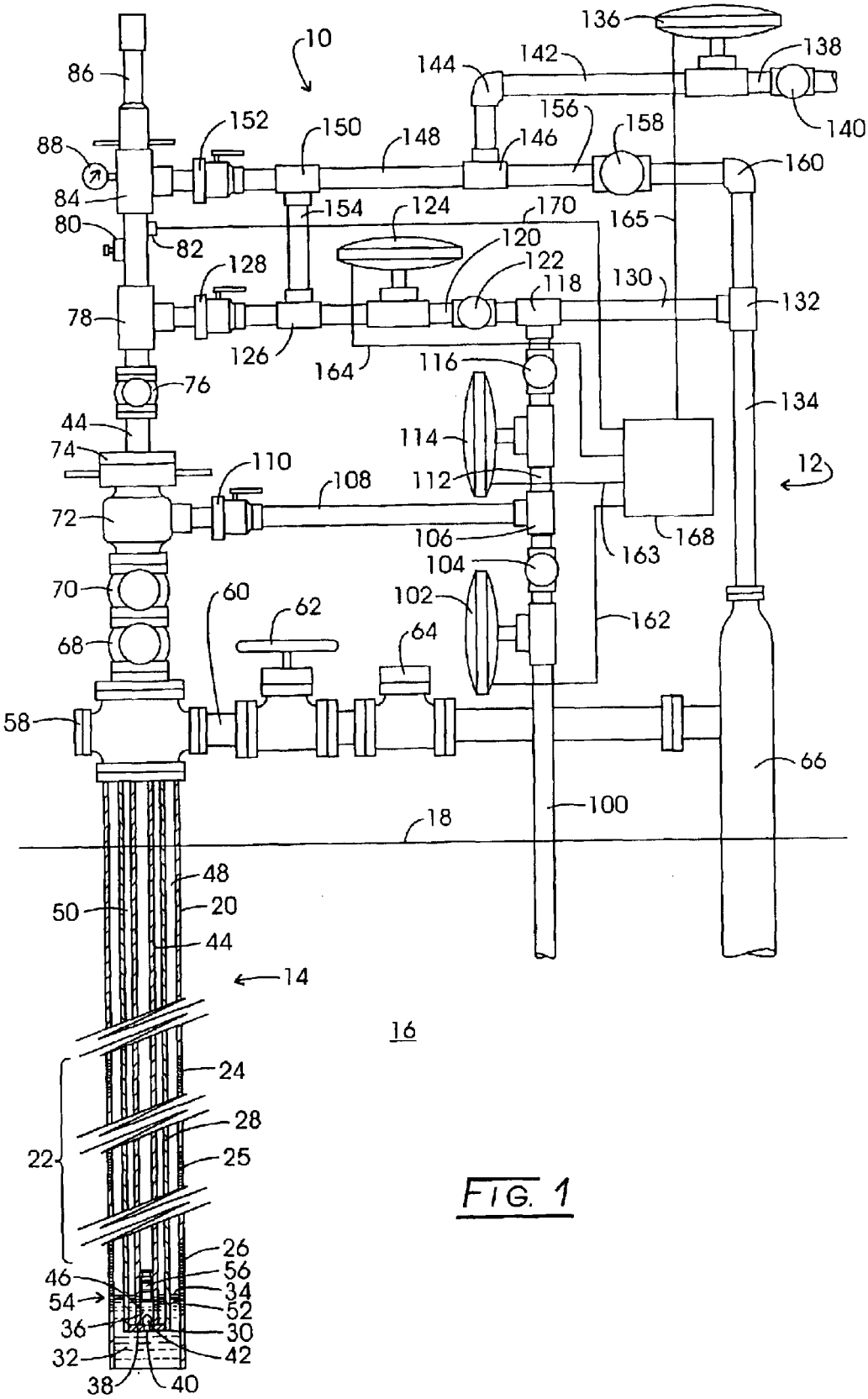
FIG. 1 is a front and partial sectional schematic view of a well installation incorporating the method of the invention.

Referring to FIG. 1, a well installation according to the invention is represented generally at 10. Installation 10 is configured with a wellhead represented generally at 12 which is in communication with a well bore represented generally at 14 extending within a geologic formation represented generally at 16 through symbolic terrain surface 18. The well is formed with an outwardly disposed cylindrical casing 20. Casing 20 is depicted in broken away fashion to illustrate a long effective perforation or pay interval 22. In this regard, the effective interval 22 is shown having perforation intervals 24 through 26. Next inboard from casing 20 is cylindrical intermediate tubing 28 which extends to a bottom location 30 located at the bottom or below the perforation interval 22, for example, it may be 30 feet below interval 22. Within this lower region of the well, formation fluids including liquid as at 32 is seen to have been accumulated, having a common level across the well bore 34. Casing 20 may, for example, have a diameter of about 5½ inches, while the intermediate tubing positioned within it may have a diameter, for example, of about 2⅞ inches. Tubing 28 may have pre-existed within the well which may be retrofitted to carry out the instant method. In this regard, note that a formation fluid receiving assembly represented generally at 36 is configured with a lower-disposed packer or seal assembly represented symbolically at 38 which is configured having a fluid passage way represented symbolically at 40 which performs in conjunction with a check valve function here symbolically represented as a standing ball valve. Next extending inboard from the intermediate tubing 28 is a plunger lift tube 44 which extends from an outlet at the wellhead 12 to a tubing input represented symbolically at 46. Tube 44 may have a diameter of about 1¾ inches and, for the instant concentric design may be provided as coil or coiled tubing. Utilization of such tubing with the concentric structuring permits its insertion within the well without "killing" it. In this regard, the restructuring of well geometry often requires the flooding of the well with water to avoid blowback. The extent of water utilized for such purposes is such that subsequent swabbing procedures are required to remove the water which may require an extended period of time with no well production. Through the utilization of a snubbing procedure described later herein, the refitting of the well with such tubing represents a substantially improved procedure. With the concentric arrangement shown, note that there is defined a primary annulus 48 between casing 24 and intermediate tubing 28. Next inboard of the primary annulus 48 is a secondary annulus 50 defined between intermediate tubing 28 and plunger lift tube 44. Secondary annulus 50 functions with the instant method as an injection passage which extends to an injection outlet 52 here represented as perforations formed within plunger lift tube 44.

With the geometry shown, the formation fluid receiving assembly 36 defines a chamber represented generally at 54 within intermediate tubing 28 which is in fluid communication with the plunger lift tube 44 and the injection outlet 52. With the chamber, check valve function 52 will have an open orientation for admitting formation fluid 36 within the chamber and is responsive to fluid pressure evolved by injection gas within the secondary annulus 50 to assume a closed orientation to define a U-tube function with that injection passage and the plunger lift tube 44. That U-tube injected gas pressure functions to drive a plunger 56 within plunger lift tube 44 from the bottom position shown located above the injection location or outlet 52 and the wellhead 12.

Now looking to wellhead 12, casing 20 and intermediate tubing 28 are seen to be coupled with a T-manifold 58. In this regard, the primary annulus 48 defined between casing 20 and intermediate tubing 28 is directed by component 58 into a casing line or conduit 60. Line 60 incorporates a manual shut-in valve 62 and check valve 64, whereupon it is directed to one input of a common point header 66. Header 66, in turn, will be seen to be in fluid transfer communication with a collection facility, in particular, being directed to the separator stage of that facility.

Next above manifold 58 are conventional tubing string shut-off or master valves 68 and 70 which are not used with the retrofitted installation 10. In this regard, the coil-type plunger lift tubing 44 extends through them as well as a manifold header 72 and next upwardly disposed coil tubing hanger 74. Manifold header 72 communicates in fluid flow relationship with the secondary annulus 50 located between plunger lift tubing 44 and intermediate tubing 28. Plunger lift tube 44 extends upwardly to a service or coil tubing shut-off valve 76, whereupon it encounters a T-connector 78;

a plunger capture mechanism 80; a plunger detector (MSO) 82; another T-connector 84; and a lubricator 86. A coil tubing or plunger lift tube pressure gage 88 is mounted at T-connector 84.

Gas under pressure or injection gas is supplied to wellhead 12 via an injection line or conduit 100. Line 100 extends to an injection motor valve or injection valve 102, thence through a check valve 104 to a T-connector 106. Connector 106 is in fluid flow communication through line or conduit 108 and service valve 110 with manifold header 72. Thus, an opening of valve 102 permits the flow of pressurized injection gas from header 72 into secondary annulus 50 such that the annulus functions as an injection passage extending to the chamber 54.

Above T-connector 106 a line or conduit 112 extends to an equalizer motor valve 114, the opposite side of which extends through a check valve 116 to a T-connector 118. One side of T-connector 118 at line or conduit 120 extends through a check valve 122 to one side of a tubing motor valve or tubing valve 124. The opposite side of valve 124 is coupled with a T-connector 126 and service valve 128 for a fluid flow association with T-connector 78. Thus, tubing valve 124 is positioned to shut-in or open coil plunger lift tube 44. In this regard, when opened, valve 124 provides fluid communication between the plunger lift tubing 44 and common point header 66 via line or conduit 130, T-connector 132 and line or conduit 134.

FIG. 1 also shows an optional installation of a vent motor valve or vent valve 136. Valve 136 is sometimes referred to as "tank valve" and it functions to divert fluid expelled from the plunger lift tube 44 to a low pressure facility, for example, such as a conventional tank at atmospheric pressure. Valve 136 is seen coupled via line 138 and check valve 140 to such a low pressure facility. The opposite side of vent valve 136 is coupled via line 142 and elbow 144 to a T-connector 146. Connector 146 is coupled with line 148 which extends through T-connector 150 and service valve 152 to T-connector 84. A line 154 interconnects T-connectors 126 and 150. The opposite side of T-connector 146 is coupled via line 156, check valve 158 and elbow 160 to line 134.

Valves 102, 114, 124 and 136 are controlled as represented at respective control lines 162–165 by a programmable controller 168. Additionally, a control line 170 provides an MSO or plunger arrival signal to the controller 168. Such controllers as at 168 are marketed by Ferguson Beauregard of Tyler Tex.

Figure 2:
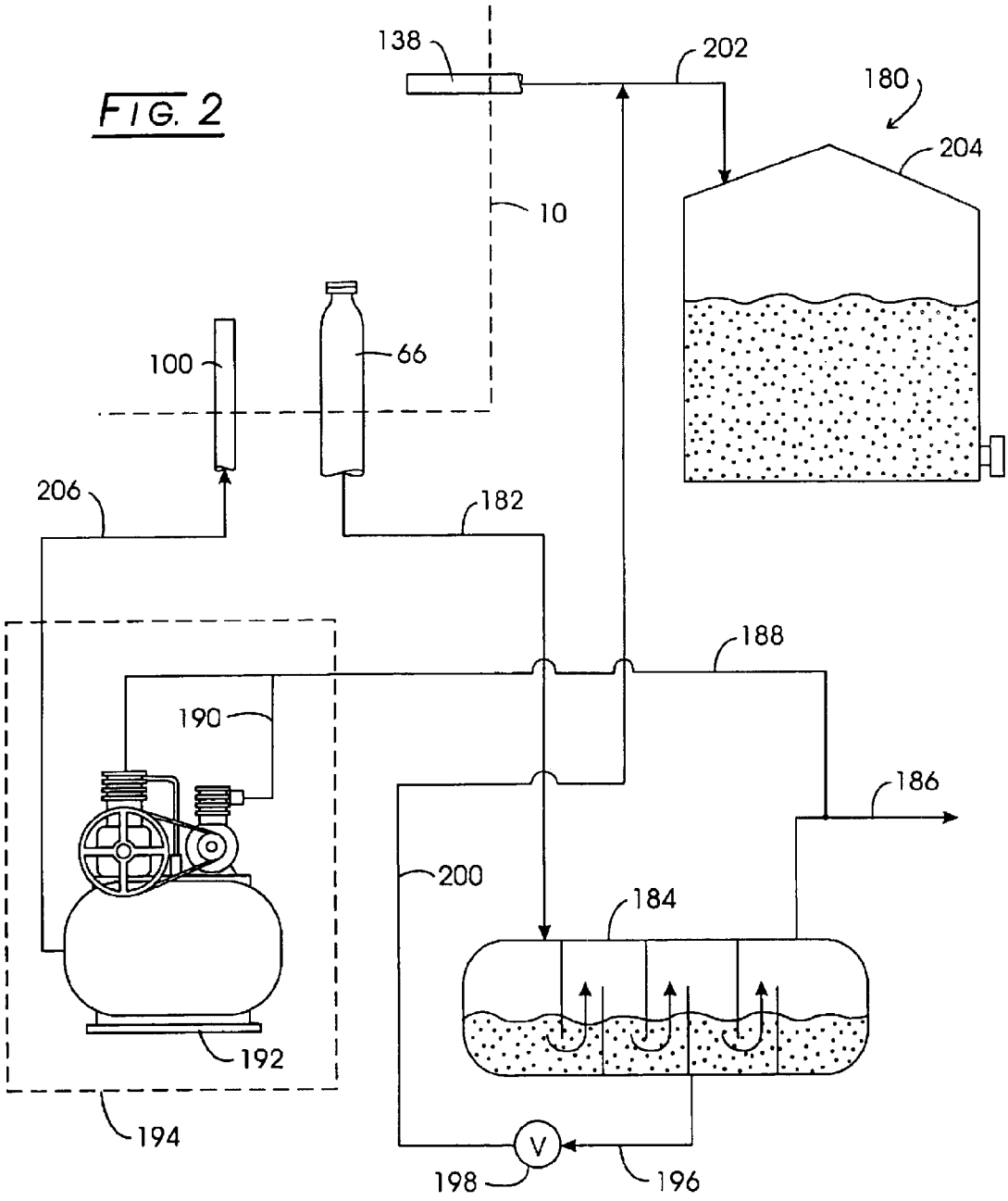
FIG. 2 is a schematic representation of a collection facility employed with the well installation of FIG. 1.

Referring to FIG. 2 a collection facility is represented in general at 180 in conjunction with earlier-described vent line 138, common point header 66 and injection input line 100, earlier-described in connection with system 10 which numerical identification returns in dashed boundary form. Fluids produced from the installation 10 are directed from the common point header 66 as represented at arrow 182 to the input of a separator facility represented at 184. Gas is separated from liquids at facility 184 and directed, as shown at arrow 186, both to a sales line or the like and, as represented at arrows 188 and 190 to the suction input of a compressor symbolically represented at 192. The discharge side of compressor 192 extends to injection line 100 as represented at arrow 206. Within dashed boundary 194 a compressor as at 192 may or may not be utilized as a source of gas under pressure for injection lift of the plunger 56 and the fluids above it the system 10 may be located to utilize the high pressure gas facilities of a production plant as opposed to using a compressor. While conventional gas injection lift facilities typically employ what is termed a closed rotating system wherein all gas recovered is redirected to the suction side of a compressor, the instant system is a semi-closed rotating system wherein a portion of the gas at line 186 is available for transportation and sale. Separator 184 is shown configured to discharge separated liquids to a tank or collection facility as represented at arrow 196, liquid valve 198, arrows 200 and 202 and tank 204. Note that arrow 202 also extends to vent valve discharge line 138 of system 10. The vent line 138 also may be directed through a separator to supply dean gas at low pressure to low pressure lines within a gas production facility as opposed to being submitted to a tank. This has the advantage of being able to sell gas as opposed to losing it to a tank arrangement as at 204.

Returning momentarily to FIG. 1, it may be observed that the casing line communicating with primary annulus 48 is not configured with a casing motor valve or casing valve. In this regard, gas is produced with system 10 continuously from the primary annulus 48, i.e., from the casing with the instant embodiment. However, a casing valve may be employed with the system. When it is so employed, it is actuated from controller 168 in concert or simultaneously with the actuation with equalizer valve 114.

FIGS. 3–8 schematically portray the sequence of steps that are carried out with the plunger enhanced chamber lift of the invention. In particular, they are involved with the utilization of pressurized injection gas. These schematic figures additionally should be considered in conjunction with the exemplary timeline diagram of FIG. 9.

Figure 3:
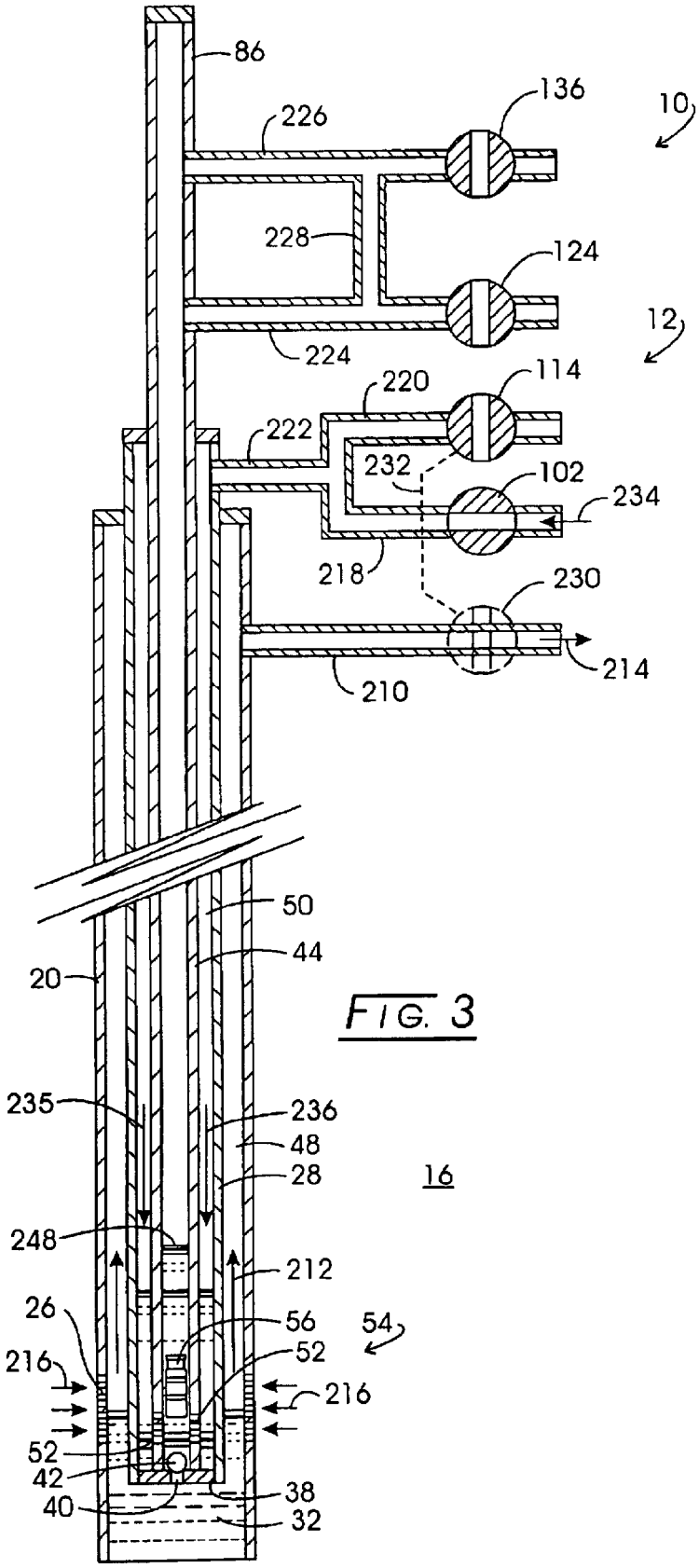
FIG. 3 is schematic sectional representation of the well installation of FIG. 1 showing a pre-charge mode.

Looking initially to FIG. 3, the well configuration of FIG. 1 is repeated in general schematic form. In this regard, the components of the chamber 54 again are identified. Primary casing annulus 48 is seen to be in fluid communication with a schematic casing line 210. The continuous production from the primary annulus 48 and schematic casing line 210 is represented by arrows 212 and 214. Zone fluids including gas and liquid are schematically represented as ingressing through, for example, perforation interval 26 as represented at arrows 216. Injection valve 102 symbolically reappears in schematic injection line 218, while equalizer valve 114 schematically reappears in conjunction with schematic equalizer line 220. Lines 218 and 220 are seen having a common input at schematic line 222 into the secondary annulus 50.

Above valve 114, tubing valve 124 schematically reappears in conjunction with a schematic tubing line 224 and vent valve 136 schematically reappears in association with schematic vent line 226. Line 154 schematically reappears as a line 228.

Returning to casing line 210, note that a schematic casing motor valve, or casing valve is represented in phantom at 230 inasmuch as it is not employed with the instant embodiment. The casing valve 230, however, is actuated from controller 168 simultaneously with the actuation of equalizer valve 114. Thus, this common control is represented in the instant figure by dashed line 232.

The chamber 54 located at the bottom of the intermediate tubing string creates a larger void or chamber for formation liquid to accumulate during a production cycle. This liquid is disbursed over a larger cross-sectional area, creating less head or back pressure against the producing formation 16. While the chamber can be created and incorporated in a variety of configurations, the instant chamber is one of a concentric tubing design incorporating coil tubing 44 as the inner plunger containing production string and standard tubing or intermediate tubing is the outer string. By sealing off the two strings as at 38 the secondary annulus 50 is created allowing the transfer of injection gas to the bottom of the tubing 44 to provide necessary lift pressure for the plunger 56 to ascend to the wellhead 12 and remove liquids from the well bore.

Figure 9:
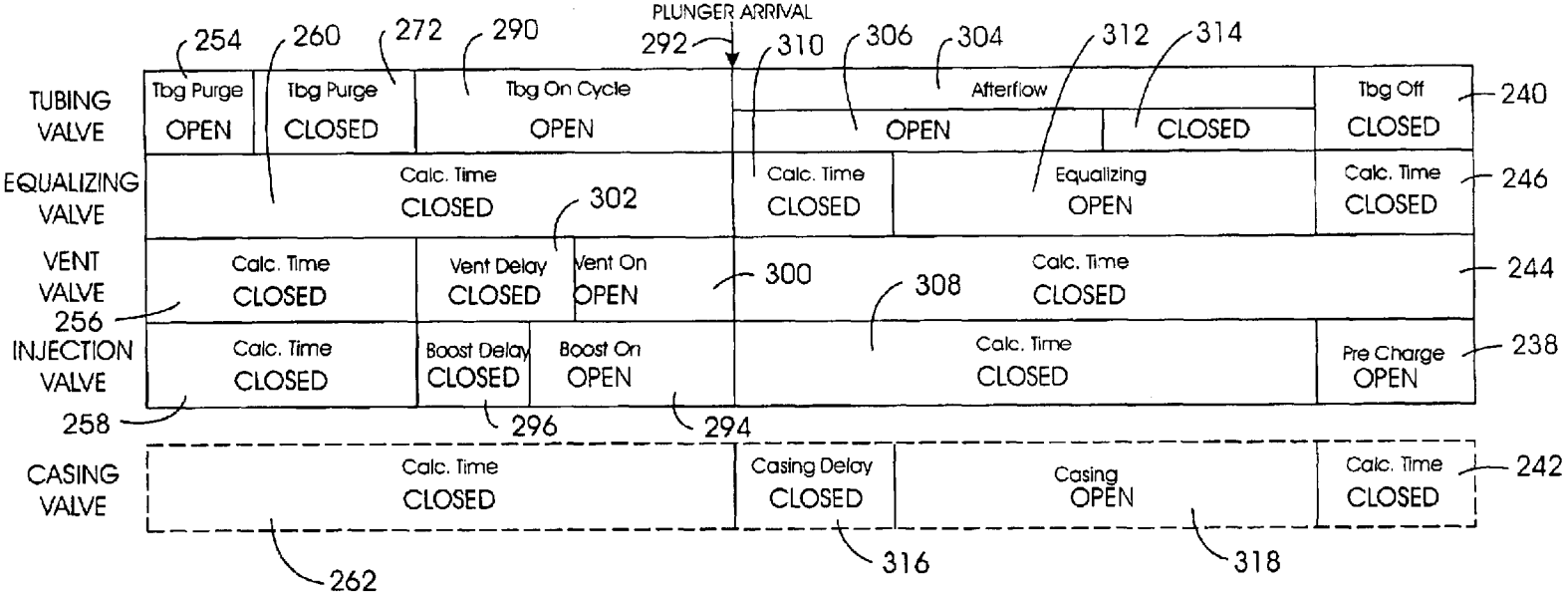
FIG. 9 is a timeline describing the well installation of FIG. 3 with an alternate utilization of a casing valve.

FIG. 3 represents a pre-charging cycle or interval during which vent valve 136, tubing valve 124 and equalizer valve 114 are closed and injection valve 102 is open to apply gas under pressure into secondary annulus 50. Just prior to the commencement of this cycle, fluids at the casing and within the chamber 54 will be at an equal level as seen in FIG. 1. This pressurization of the secondary annulus 50 or injection passageway is represented by arrows 234–236. The pre-charge interval itself is represented in the timeline of FIG. 9 at pre-charge interval 238. Note additionally, that tubing valve 124 is seen to be closed as represented at time interval block 240. Should a casing valve 230 be employed, it would be closed as represented at timeline interval block 242. The vent valve would be closed as represented at timeline block 244 and the equalizing valve 114 will be closed as represented at timeline block 246. Such pre-charge pressurization will cause the closure of check valve 42 and the pressurization of fluid within the secondary annulus 50. Some of the formation fluid will be transferred from the secondary annulus 50 to the plunger lift tube in the course of this precharge. It may be observed in FIG. 9 that timeline blocks 242 for the casing valve and 246 for the equalizing valve are coincident. While the casing valve is shown closed in FIG. 9, the casing line 210 has no valve and is open, casing gas production being underway as represented at arrows 212 and 214. Note, in this regard, that with the closure of check valve 42 chamber 54 is, in effect, a closed cylinder and the pressure extant within secondary annulus 50 is isolated from the casing primary annulus 48. Thus, this injection pressurization will have no deleterious effect upon the formation 16. Any such pressure would otherwise tend to drive fluids within the primary annulus back into the formation whereupon at an appropriate point in the cycling procedure, it would again be withdrawn from the zone, a back and forth phenomena which derogates well efficiency.

As a next step in the production procedure, a purge on cycle or interval occurs. Looking to FIG. 4, this purge on interval is defined by closing injection valve 102 and opening tubing valve 124 for a relatively short interval which may be, for example, one minute in duration. The function of this cycling component is to relieve pressure within the coil plunger lift string 44 for an interval effective to completely displace all fluid from the secondary annulus 50 through the injection outlet 52 and into coil tubing 44. Note that check valve 42 remains closed in consequence of this pressure as represented at arrows 250 and liquid is U-tubed into coil tubing 44. The liquid level within coil tubing 44 has elevated substantially as represented at level 252 and, typically, the plunger 56 will have elevated somewhat along with it.

Figure 4:
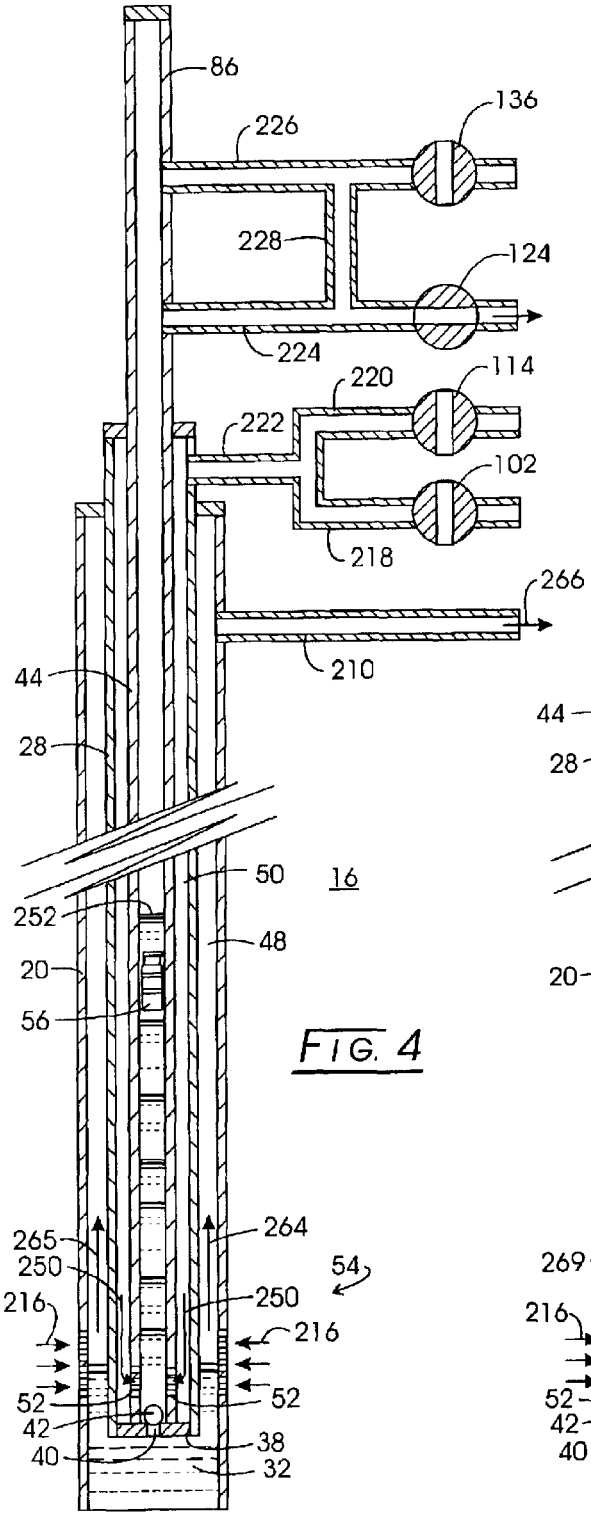
FIG. 4 is a schematic sectional representation of the well installation of FIG. 3 showing a purge interval mode.
Figure 5:
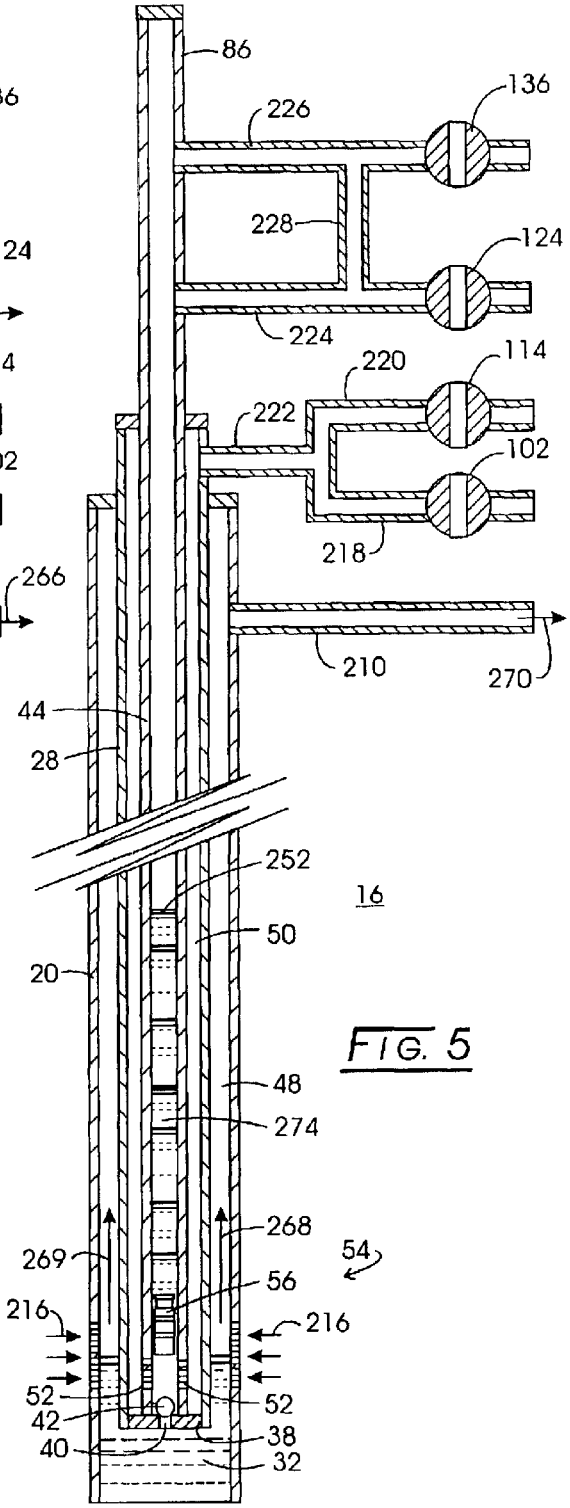
FIG. 5 is a schematic sectional representation of the well installation of FIG. 3 showing a purge off mode.

Looking again to FIG. 9, this tubing purge interval is represented at timeline block 254. Note, additionally, as represented in FIG. 4 the vent valve 136 is closed as represented at timeline block 256; the injection valve 102 is closed as represented at timeline block 258; and equalizing valve 114 is closed as represented at timeline block 260. Where a casing valve is employed, it will be closed as represented at timeline block 262. Note, again, that timeline blocks 260 and 262 are coincident. However, as shown in FIG. 4 at arrows 264–266, for the instant embodiment, the primary annulus or casing annulus continues to produce gas.

It now is necessary to maneuver plunger 56 back into its home or bottom position (FIG. 1) and this is achieved by carrying out a purge off cycle or interval. Looking to FIG. 5, it may be observed that casing valve 102, equalizer valve 114, tubing valve 124 and vent valve 136 are closed and at the termination of this purge off cycle, plunger 56 will have moved to its home position or bottom location as shown in the figure. Note, however, as represented at arrows 268–270 the casing or primary annulus continues to produce gas to the collection facility. Looking to FIG. 9, this purge off cycle which may endure, for example, for about a five minute duration is represented at timeline block 272 for the tubing valve 124, closed position. Vent valve 136 remains closed as shown at block 256; injection valve 102 remains closed as shown at block 258; equalizing valve 114 remains closed as shown at block 260; and casing valve 230 remains closed as shown at block 262.

With the repositioning of plunger 56 at its home or bottom location a liquid slug is now located above plunger 56 and the control procedure now enters an on-time or lift cycle or interval. In programming controller 168, the operator will program a fixed on-time. Also, an optimally efficient speed or velocity of travel of the piston 56 with associated slug 274 will be determined. Then, timing values for slow performance of the piston 56 as well as fast performance are programmed as performance windows. Additionally, it typically is desirable to program a window of normal performance, however, that window may be "shut" to a point value. Should plunger 56 fail to arrive within the fixed and assigned on-time, then a no arrival condition ensues. Well parameters are adjusted with each lift cycle if necessary such that the well will be "tuned" toward a plunger speed or average speed which is optimized. Adjustments may be in pre-assigned increments or those increments may be proportionalized in consonance with the proximity of plunger arrival times to an optimized velocity or speed. Such plunger speed tuning of plunger lift wells is described in detail in U.S. Pat. No. 5,146,991 (supra). This on or lift cycle initially is described in connection with FIG. 6. Looking to that figure it may be observed that the tubing valve 124 is open concurrently with injection valve 102 to cause secondary annulus 50 to become an injection gas path permitting a U-tubing drive of plunger 56 as developed by the pressurized closure of check valve 42 and the movement of pressurized injection gas through injection outlet 52. This lift pressure is represented at arrow 282 and it may be observed that plunger drive is, in effect, within a closed cylinder. The amount of power required to thus propel plunger 56 and slug 274 is not high and the duration of the lift cycle may be somewhat short, for example, a duration of ten or more minutes to achieve plunger arrival at lubricator 86 with the expulsion of slug 274 through the tubing valve 124 and tubing line 224 to separator 184 (FIG. 2). Again it may be observed that during this pressurized injection based lift cycle, there is no collateral pressure effect upon formation 16 inasmuch as intermediate tubing 28 is isolated from casing 20 as represented by the primary annulus 48. In the latter regard, as represented at arrows 284–286 the primary annulus 48 or casing continues to produce gas.

Looking to FIG. 9, the timeline for tubing valve 124 for this lift cycle is shown at timeline block 290 which extends to that point in time at arrow 292 representing plunger arrival time. During this interval, note, as represented at block 260, equalizing valve 114 remains closed. Where venting is not called for, vent valve 136 also will remain closed. Note, however, that injection valve 102 is open as represented at timeline block 294. However, the commencement of the opening of injection valve 102 may be delayed by a boost delay wherein the valve is closed as represented at timeline block 296. Where a casing valve 230 is employed, as seen at timeline block 262, the casing valve 230 will remain closed in concert with the closure of equalizing valve 114 as represented at timeline block 260. The boost delay feature represented at block 296 may constitute one of the well parameters adjusted in seeking an optimized average plunger speed.

Figure 6:
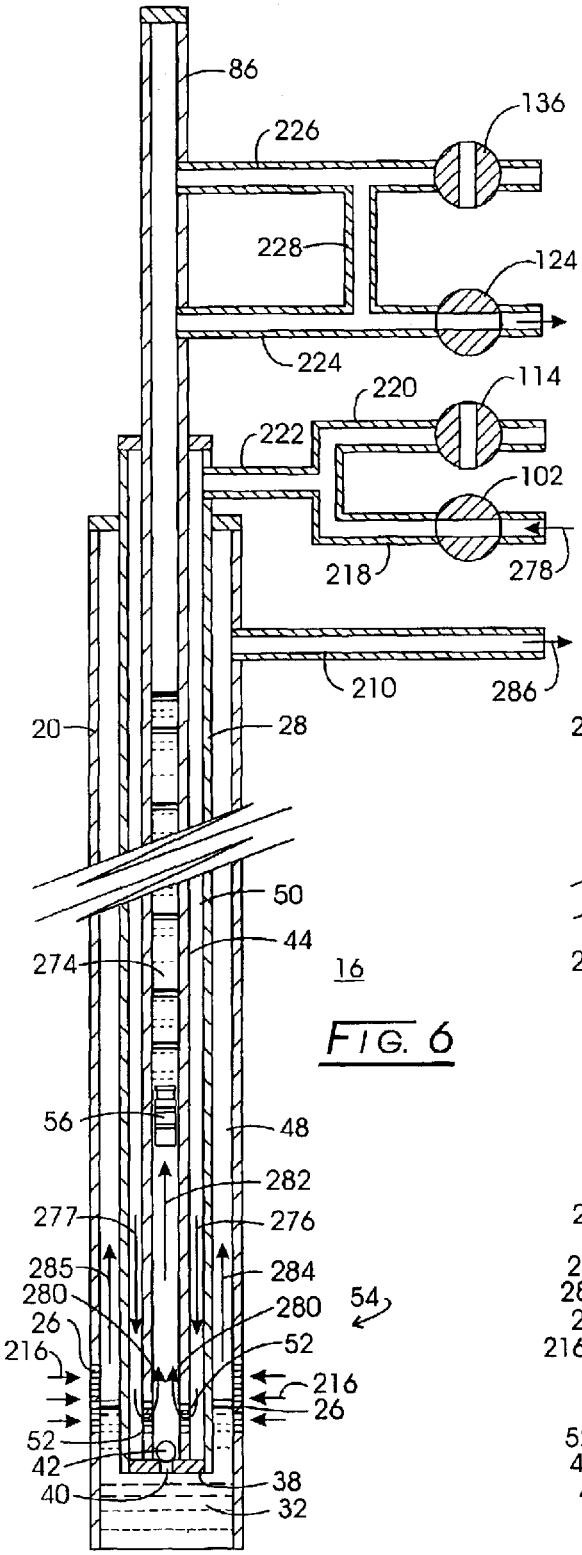
FIG. 6 is a schematic sectional representation of the well installation of FIG. 3 showing a plunger lift mode.
Figure 6A:
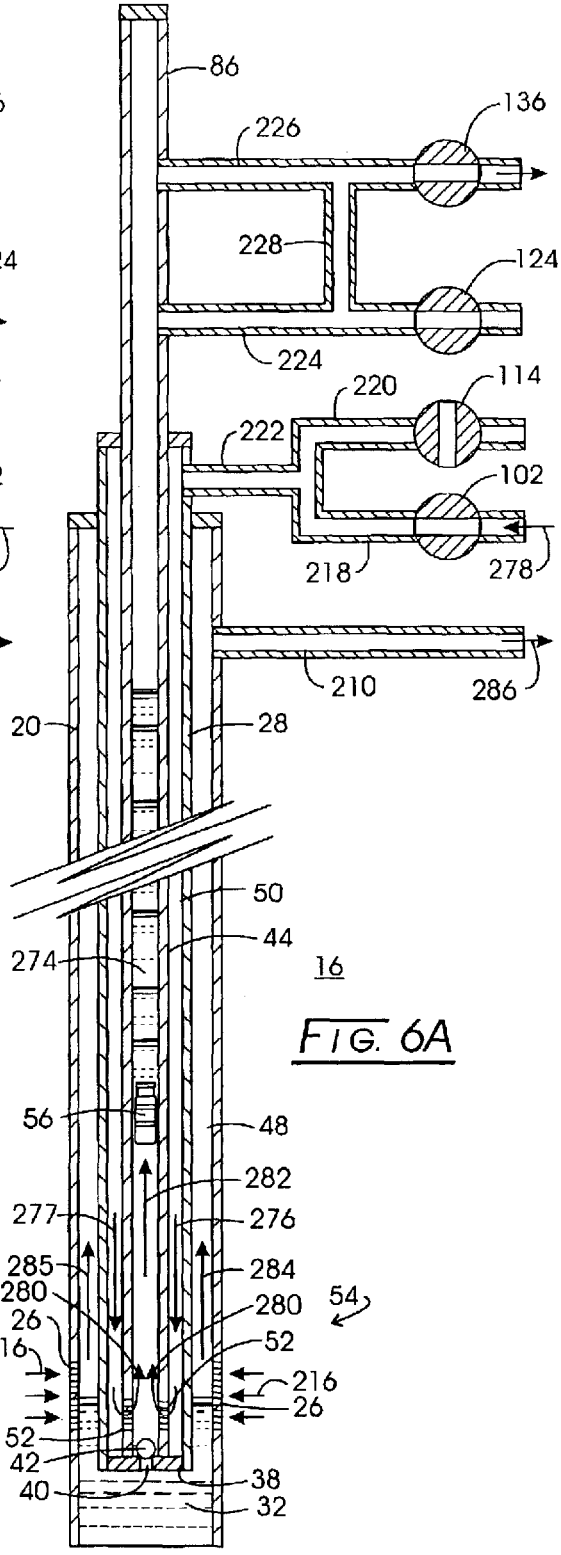
FIG. 6A is a schematic representation of the well installation of FIG. 3 showing an open vent valve in the course of a lift cycle.

This on or lift cycle may be modified by programming an opening of vent valve 136. Such an adaptation is represented in FIG. 6A. Note in the figure that vent valve 136 is open; tubing valve 124 is open; equalizer valve 114 is closed and injection valve 102 is open. As before, gas continues to be produced from the casing or primary annulus as represented at arrows 284–286. Venting to a low pressure source such as tank 204 (FIG. 2) or another low pressure source may be called for where marginal pressure only may be available from a compressor as at 192. For example, the system may have 50 PSIG suction pressure at lines 188 and 190 and a three level compression to provide an output or discharge pressure at arrow 206. With utilization of the vent valve in conjunction with atmospheric pressure at tank 204, the system is producing to a suction pressure of zero PSIG.

Returning to FIG. 9, the vent valve 136 is shown to have an open interval as represented at timeline block 300 which extends to the point of plunger arrival as represented at arrow 292. However, controller 168 may be programmed such that the vent valve 136 is opened only after a vent delay represented at timeline block 302. The vent delay again may be programmed as one of the well parameters utilized to adjust the average speed of plunger 56 toward an optimal value or value within a range of optimal values.

When plunger 56 has reached the wellhead 12 and is located at the lubricator 86, its arrival will have been detected by detector 82 (FIG. 1). Such detection will cause the controller 168 to enter an afterflow cycle or mode during a portion of which tubing valve 124 will remain open. Referring to FIG. 9, an afterflow interval, for example, two hours is represented at timeline block 304 as commencing with plunger arrival represented at arrow 292. During this afterflow interval, the tubing valve 124 will remain open for an open interval represented at timeline block 306. Among other things, at least during an initial portion of this open interval, any liquids which would have followed plunger 56 to the wellhead will have had an opportunity to be removed through line 224. Plunger arrival as represented at arrow 292 also initiates a closure of injection valve 102 which remains closed as represented at timeline block 308 until the earlier-described commencement of pre-charge by opening the valve as discussed in connection with timeline block 238. To accommodate for this plunger following liquid removal, equalizing valve 114 is held closed for an equalizing delay interval represented at timeline block 310, again commencing with plunger arrival as represented at arrow 292. Following that delay as represented at timeline block 310, as represented at timeline block 312, equalizing valve 114 is opened until the termination of the afterflow represented at timeline block 304. During this interval, note that tubing valve 124 will have been open and then closed at least for a minimum off-time as represented at timeline block 314. This minimum off-time is that minimum interval of time required for the plunger 56 to return to its home position or bottom location. However, tubing valve 124 may be closed earlier in the afterflow interval shown at timeline block 304 than that interval extending to the minimum off-time represented at timeline block 314. Note in the figure that where a casing valve 230 is employed, a similar casing delay will ensue from the plunger arrival as represented at arrow 292 as shown at timeline block 316. Following that delay, again for purposes of removing liquid following the plunger 56, the casing valve 230 is opened as represented at timeline block 318. Where the tubing valve open afterflow interval represented at timeline block 306 is coincident or is equal to or greater than a minimum off-time which would be represented at timeline block 314, then the tubing off closed interval represented at timeline block 240 is set equal to and commences coincidently with the pre-charge opening of injection valve 102 as represented at timeline block 238. The equalizing valve 114 as well as a casing valve 230 also will close in coincidence with the commencement of the pre-charge opening of the injection valve 102. Such an equalizing valve closure is represented at timeline block 246.

Figure 7:
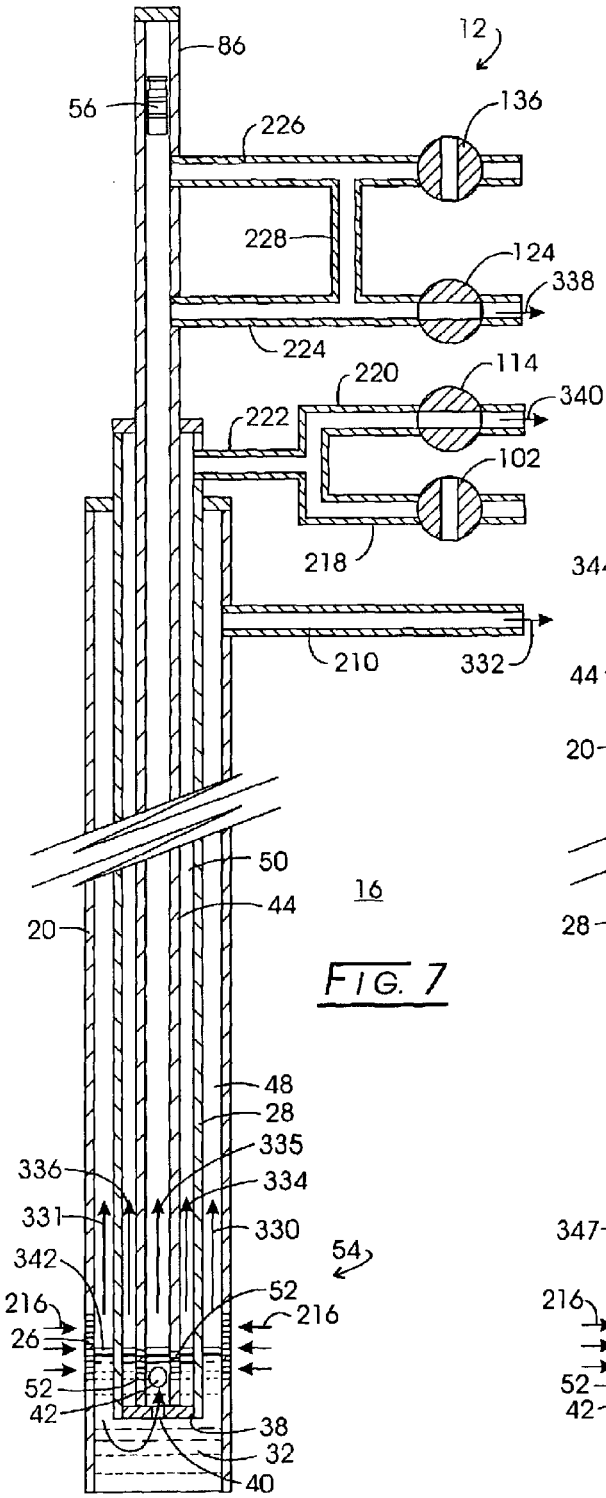
FIG. 7 is a schematic sectional representation of the well installation of FIG. 3 showing an afterflow cycle with an open equalizing valve, tubing valve and casing line.
Figure 8:
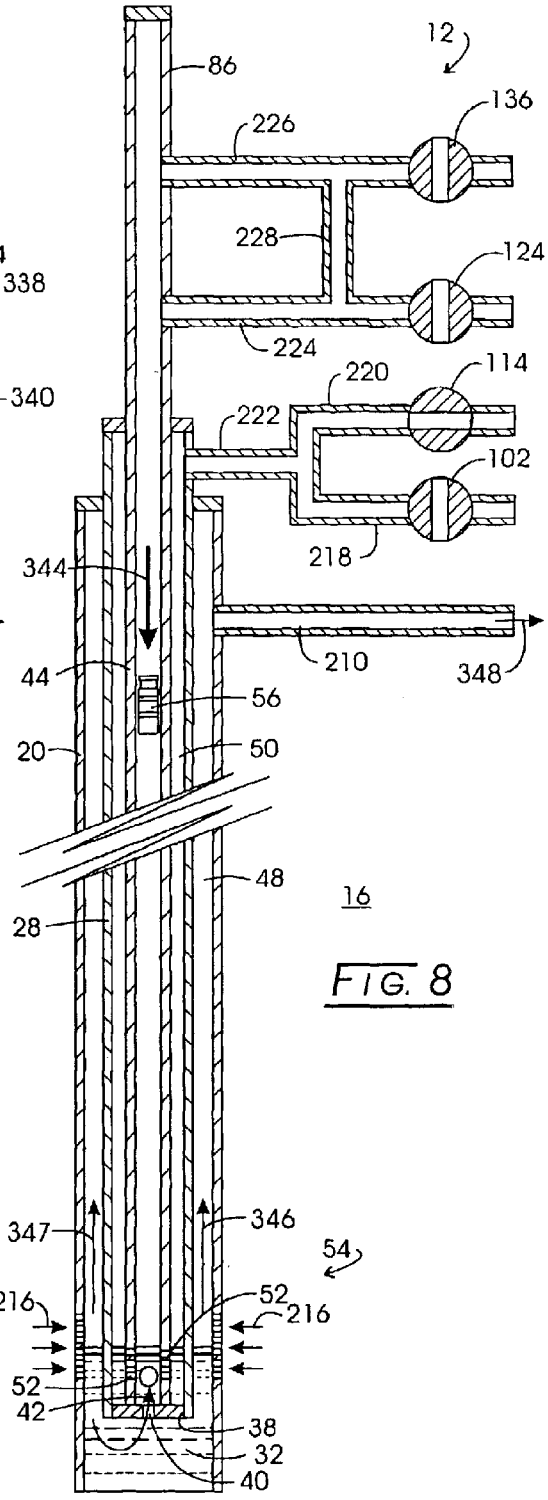
FIG. 8 is a schematic sectional view of the well installation of FIG. 3 showing a closed mode wherein the equalization valve is open.

Referring to FIG. 7, the orientation of components during a portion of this afterflow interval is represented. In the figure, note that the tubing valve 124 and equalizing valve 114 are open, while vent valve 136 and injection valve 102 have been closed. The primary annulus or casing remains open and as represented at arrows 330–332 continues to produce. It may be recalled from FIG. 1 that this configuration of the valves ties the primary annulus 48, the secondary annulus 50 and the plunger lift tubing 44 to the common point header 66. Header 66, in turn, is tied in fluid flow relationship with the collection facility 180. As a consequence, injection pressure is bled off of the secondary annulus 50 and the tubing pressure is equalized with that pressure as well as the pressure in the casing or primary annulus. This equalization of pressures is represented by arrows 334–336 as well as arrows 330 and 331. The association of tubing valve 124 with common point header 66 is represented at arrow 338, while association of equalizing valve 114 with that common point is represented at arrow 340. The result of this equalization of pressures is to, in effect, refill the chamber 54. Note in the figure that check valve ball 42 has come off its seat and zone fluids are permitted to reenter the chamber 54. The levels of these zone fluids within the chamber as well as within the primary annulus 48 are equal as shown at liquid level 342. Recall, however, from the discourse in connection with FIG. 9 that during this interval wherein the equalizing valve 114 is open, the well continues to produce through the equalizing valve 114 as well as from the primary annulus or casing as represented at line 210. Additionally, production continues through the tubing valve during its open condition in the course of afterflow. Notice further in conjunction with level 342 that zone fluid is displaced across the largest cross-sectional area of the well bottom, thus minimizing liquid head pressure.

As the tubing valve is closed, a closed or off cycle ensues to permit return of plunger 56 to its home or bottom location. Looking to FIG. 8, the closed cycle valve orientations are represented. Note that vent valve 136, tubing valve 124 and injection valve 102 are closed, while equalization valve 114 remains open. Plunger 56 is gradually moving to its bottom location or home position as represented by arrow 344. In conventional plunger lift wells, during this off cycle there is no gas production. However, as represented at arrows 346–348 the casing or primary annulus 48 continues to produce gas. Notice additionally that the secondary annulus 50 is continually open during this period as a consequence of the maintenance of equalization valve 114 in an open condition. This allows fluid entry and equalization of surface pressure with the casing. In this regard, note that the check valve ball 42 is off seat.

Figure 10:
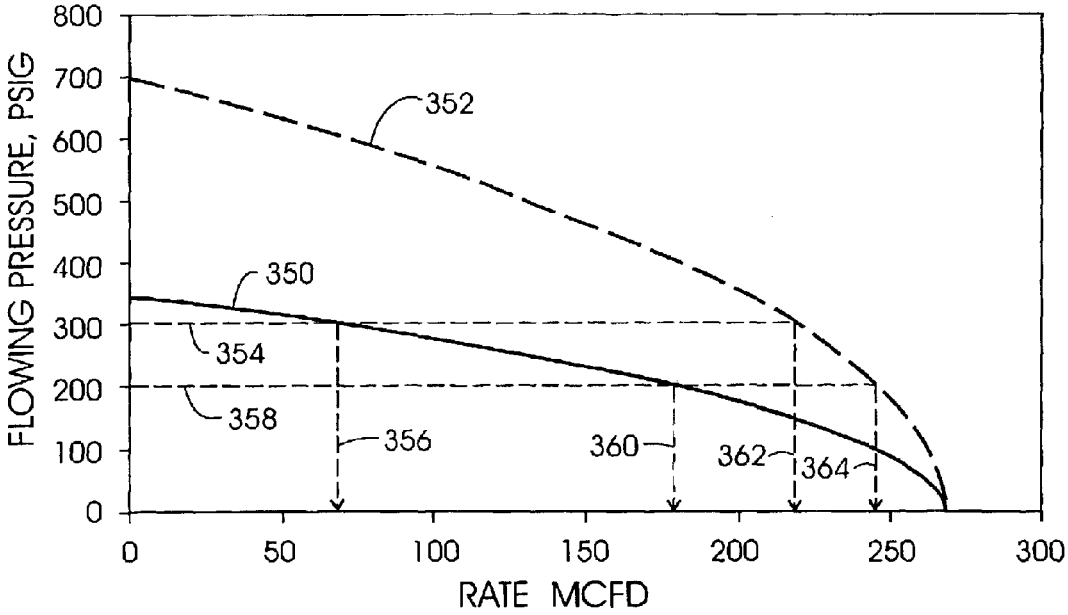
FIG. 10 is a graph showing IPR curves for two different well installations.

The consequence of the methodology at hand is that smaller liquid slugs may be lifted at a much increased cycle frequency per day to substantially maintain lower bottom hole pressures and thus improve gas production. Further, because of the relatively larger cross-sectional area of the primary annulus 48, the production of gas from the casing is one encountering lowered frictional losses. Isolation of the gas injection features and U-tube plunger lift feature from the casing avoids the driving of zone fluids from the casing back into the zone itself and then recovery of those fluids again, an inefficient activity. The rapid cycling which is achieved also tends to generate a turbulence in the zone fluids 32 such that solids will be entrained within those fluids as they are lifted by the plunger 56 and the result is a substantial reduction of solids build up in the well.

Where bottom hole pressure is reduced in the type of well at hand exhibiting low bottom hole pressures and high productivity index the reduction in bottom hole pressure can have a significant impact on production. These wells typically exhibit a rather shallow or low slope Inflow Performance Relationship (IPR) curve. Such a curve is represented in FIG. 10 in stylized fashion at 350. The steeper IPR curve, for example, representing a well performing in more impervious strata, is represented at curve 352. Looking to curve 350, for example, where the flowing bottom hole pressure is at 300 PSIG as represented at dashed line 354 a well performing in conjunction with curve 350 will produce, for example, something above 50 MCFD of gas as shown at vertical dashed line 356. By diminishing bottom hole pressure to 200 PSIG as represented at horizontal dashed line 358 production increases from something over 50 MCFD to something above 175 MCFD of gas as represented at vertical line 360. Accordingly, higher frequency cycling to remove down hole liquids can have a substantial economic impact for many wells. By contrast, the well represented at IPR curve 352 may exhibit a production rate of something over 200 MCFD of gas for a flowing pressure of 300 PSIG as shown at dashed lines 354 and 362. By dropping the down hole flowing pressure to 200 PSIG, as represented at dashed lines 358 and 364 only marginal improvement in production, i.e., to less than 250 MCFD will be realized.

Figure 11:
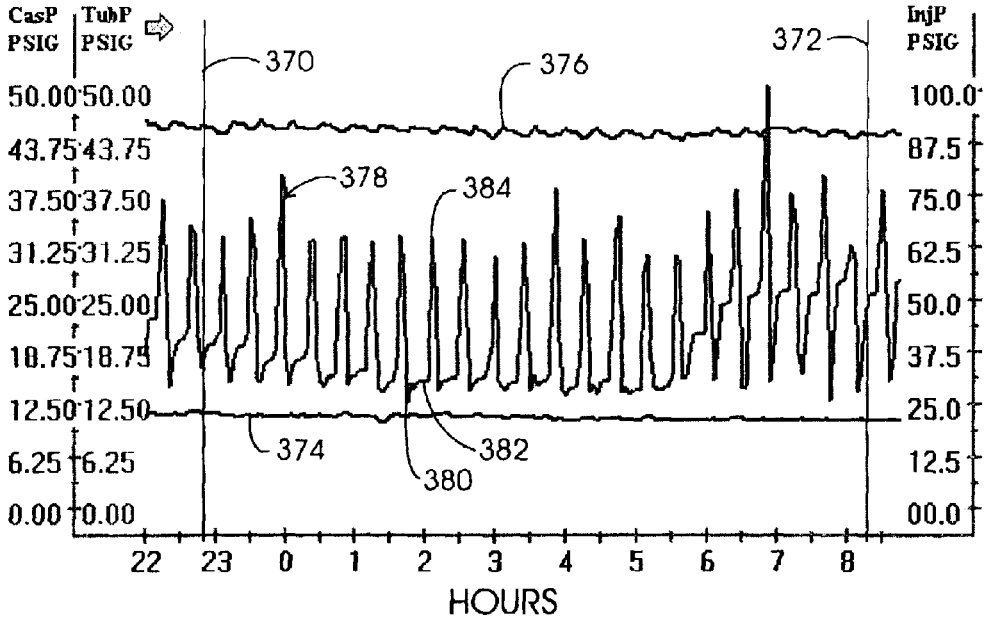
FIG. 11 is an exemplary data log trace of a well structured similar to the well installation of FIG. 1 but without a vent valve.

Referring to FIG. 11, a performance log for a well quite similar to that shown in FIG. 1 (not having a vent valve) is shown for a nine hour twenty six minute interval represented between vertical interval bars 370 and 372. This well exhibited an average casing pressure of 11.06 PSIG as represented at trace 374. That pressure was measured at the common point header 66. Correspondingly, the average injection pressure was 90.68 PSIG as represented at trace 376. Plunger lift tubing pressure is represented at the multiple cycle traces represented generally at 378. The average of those pressures was 21.3 PSIG. Resolution of this log was three minutes per pixel, thus it is somewhat low. It may be observed that the tubing pressure recorded at the wellhead during the lift cycles had no effect on casing pressure. Looking to the tubing pressure cycles 378 it may be noted that, for instance, at point 380 tubing pressure approaches casing pressure at a point in time when the plunger has reached the wellhead and pressure is bled from the plunger lift tubing with some minimal amount of flow time. The tubing then is shut in to evoke a slight build-up in tubing pressure as represented at point 382 and provide a minimum off-time to occur to assure return of the plunger to its home location. Pre-charge then occurs to charge the system at the secondary annulus and a pressure spike occurs as represented at point 384. This pre-charge for the instant well occurred quite quickly, for example, for a period of about one minute with an ensuing thirty second purge followed by about a five minute shut in. As the equalizer valve is opened, pressure again drops. Cycling during the interval evaluated between bars 370 and 372 is quite significant, being 25 cycles in about 10 hours. That activity translates into a frequency of 70 cycles a day which function to move relatively small liquid slugs quite often. During this period, the primary or casing annulus offered the path of least resistance gas flow and resulted in a lowest operating pressure at the sand face. Of importance, the frequent cycles occur without disturbing system pressure.

Figure 12:
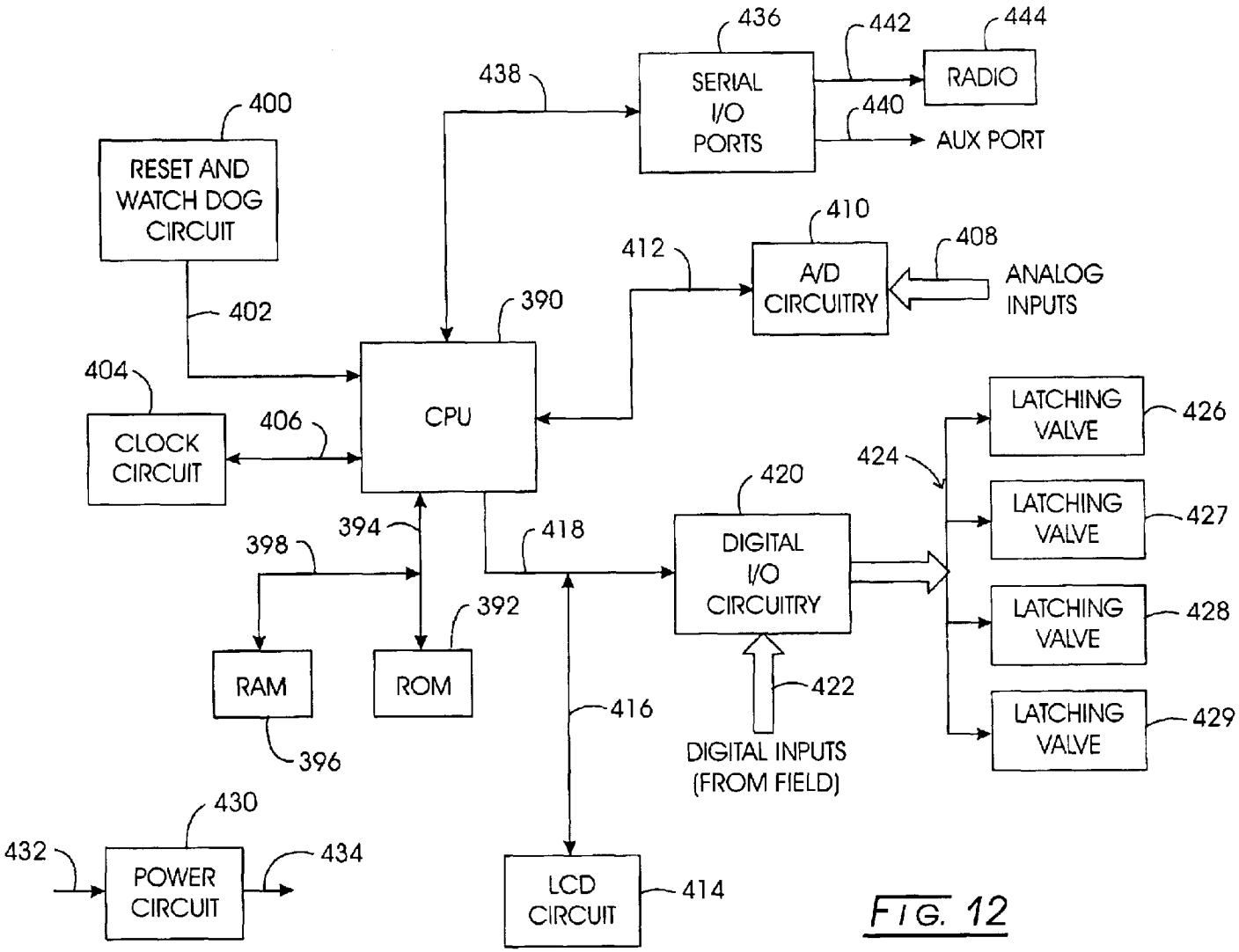
FIG. 12 is a block schematic diagram of the circuit of a controller described in connection with FIG. 1.

There are a variety of well configurations which may incorporate the enhanced chamber lift features of the invention. Thus, controller 168 necessarily is quite flexible in terms of its programming and, for instance, incorporates a capability for controlling a plurality of latching valves. Those latching valves, in turn direct control gas to the motor valves. Referring to FIG. 12, the components of the control circuit are presented in block diagrammatic form. In the figure, the principal component is a central processing unit (CPU) represented at block 390. CPU 390 may be provided, for instance, as a type V25, marketed by NEC of Kawasaki Kanagawa, Japan. Device 390 performs in conventional interactive fashion with erasable programmable read only memory (EPROM) 392 as represented by the interactive arrow 394. EPROM 392 may be of a 128K×8 variety and may be present as a model 27c1001 marketed by ST Thompson of Geneva, Switzerland. Similarly in conventional fashion the device 390 performs in conjunction with random access memory (SRAM) 396 as represented by the interactive arrow 398. RAM 396 may be provided with a 512K×8 capacity and may be provided, for instance, as a type Hy 638400A marketed by Hynix of Seoul, Korea. CPU 390 is monitored by a reset and watchdog circuit 400 as represented by arrow 402. Device 400 may be provided as a type MAX 691AC, marketed by Maxim Integrated Products, of Sunnyvale, Calif. A clock circuit is provided at 404 in association with CPU 390 as represented by dual arrow 406. The circuit 404 may incorporate a 16 mHz crystal. Preferably, the circuit incorporates a data logging function, for example, for generating data as described above in connection with FIG. 11. Analog inputs such as pressures, plunger arrivals and the like to the circuit are represented at arrow 408 extending to analog-to-digital conversion circuitry as represented at 410, the association of that conversion device with CPU 390 being represented at dual arrow 412. Device 410 may be provided as a type TLC 2543 marketed by Texas Instruments of Dallas, Tex. One visual readout to on-site operators is provided in conventional fashion with a liquid crystal display (LCD). That display with associated drivers and the like is represented at 414, its association with CPU 390 being represented by arrows 416 and 418. LCD circuit 414 may be provided, for instance, as a 4×20 LCD of a type BT 42005P-NERE, marketed by Batron (Data Module) of Munich, Germany. Arrow 418 additionally is seen to be directed to digital input/output (I/O) circuitry 420. That circuitry also receives digital inputs from the field, for example, derived from operator carried laptop computers. Such inputs are represented at arrow 422. I/O circuitry 420 provides outputs as represented at the arrow combination represented generally at 424 to four latching valves 426–429. Valves 426–429 perform in electromagnetically actuated fashion to apply control gas under pressure to the diaphragms of motor valves as described in connection with the earlier figures at 102, 114, 124, 230 and 136. Such latching type valves are employed inasmuch as they carry out motor valve control with a minimum utilization of electric power. That power may be provided, inter alia, by rechargeable batteries performing in conjunction with a power circuit represented at 430. The battery input to circuit 430 is represented at arrow 432 and its distribution to the circuit is represented at arrow 434. The circuit also incorporates a serial input/output (I/O) port as represented at block 436 which interactively communicates with CRJ 390 as represented by dual arrow 438. Serial ports 436 communicate through an auxiliary port represented at arrow 440 and, additionally, perform in conjunction with interactive telemetry as represented by arrow 442 and block 444. Ports 436 may be provided as type MAX 232 marketed by Maxim Integrated Products, of Sunnyvale, CA It may be noted that four latching valves 426–429 are illustrated. One of those latching valves may be assigned to actuate the equalizing valve 114 and/or a casing valve as described in conjunction with FIG. 3 at 214. Where both valves are actuated, as is apparent such actuation will be simultaneous in timing nature as described in connection with FIG. 9. Latching valves 426–429 are driven by type ULN 2003 AN drivers marketed by Texas Instruments of Dallas Tex.

FIGS. 13A–13K present a flow chart describing the control features of the plunger enhanced chamber lift approach of the invention. Looking to FIG. 13A, the flow chart commences with block 450 calling for the loading of control mode and the initialization of timers. Then, as represented at line 452 and block 454 the timers are initialized and certain program variables are loaded. In this regard, the tubing on-time which is utilized, inter alia, to determine plunger speed performance is loaded. Vent valve delay as illustrated at timeline block 302 in FIG. 9 is loaded as well as the total vent valve on-time. Injection valve boost delay as described at time block 296 in FIG. 9 is loaded as well as the injection valve total boost on-time. Pre-charge time is loaded as described at timeline block 238 in FIG. 9.

The program then continues as represented at line 456 to block 460 which provides for starting the tubing valve purge function. This calls for opening injection valve 102 to commence the pre-charge interval as described at block 238 in connection with FIG. 9. Recall that the pre-charge time was loaded in connection with block 454. Thus, as represented at line 462 and block 464 the injection valve timer is decremented and the program continues as represented at line 466 to the query posed at block 468 determining whether the injection valve timer has reached zero. In the event that it has not, then as represented at loop line 470 and block 464, the program loops until the precharge interval is concluded. Where the pre-charge interval has been completed, then as represented at line 472 and block 474 the purge onetime is loaded into the tubing valve timer and the program continues as represented at line 476 and block 478 providing for opening tubing valve 124 to start the purge on interval described at block 254 in connection with FIG. 9. As represented at line 480 and block 482 timing of this interval is carried out by decrementing the now loaded tubing valve timer and, as represented at line 484 and block 486 a determination is made as to whether the tubing valve timer has reached a zero value. In the event that it has not, then the program loops as represented at line 488 and block 482. Where the tubing valve timer has timed out the purge on interval, then as represented at line 490 and block 492, the purge off interval value is loaded and as represented at line 494 and block 496, tubing valve 124 is closed and the purge off interval (block 272 in FIG. 9) is commenced. As represented at line 498 and block 500 the tubing valve timer is decremented and, as shown at line 502 and block 504 a determination is made as to whether the tubing valve timer had decremented to zero. In the event that it has not, then as represented at loop line 506 and block 500 the program dwells. When the tubing valve timer has reached zero, then as represented at line 508 the program continues to node 1A. Node 1A reappears in FIG. 13A with line 508 extending to block 510, describing that the on-time or tubing on cycle is commenced as described in block 290 in connection with FIG. 9. In the event that a vent valve as at 136 is being utilized, then the vent valve delay described at timeline block 302 in connection with FIG. 9 is commenced by starting the vent valve delay timer. Additionally, the injection valve 102 delay timer is started. That injection valve delay is illustrated in connection with timeline block 296 of FIG. 9 as a boost delay. The program then continues as represented at line 512 and block 514 wherein the tubing valve timer is decremented; the vent valve timer is decremented; and the injection valve timer is decremented. Next, as represented at line 516 and block 518 a query is posed as to whether the tubing valve timer has reached a zero valuation. Recall that the on-time is a programmed value particularly concerned with evaluating plunger speed performance. Accordingly, the time out of the tubing valve timer at this juncture will be last to occur with respect to the decrementations carried out in conjunction with block 514. In the event of a negative determination with respect to the tubing valve time out, then as represented at line 520 and block 522 a determination is made as to whether the vent valve timer has timed out. Recall from block 510 that this time out is concerned with the interval of vent delay. Where time out has not occurred, then the program continues as represented at line 524. However, where the vent valve has timed out for this delay, and as represented at line 526 and block 528 a vent valve on-timer is loaded; vent valve 136 is opened; and the vent valve on-timer is started. The program then continues as represented at line 530 to line 524. Line 524 extends to block 532 wherein a determination is made as to whether the injection valve timer has timed out. Recall this is the injection valve boost delay described at block 296 in connection with FIG. 9. Where the injection valve timer has not timed out, then the program continues as represented at line 534. In the event of an affirmative determination with respect to the query posed at block 532, then as represented at line 536 and block 538 the injection valve boost on-timer is loaded; injection valve 102 is opened; and the injection valve boost on-timer is started. This boost on condition is illustrated at timing line block 294 in connection with FIG. 9. The program then continues as represented at line 540 to line 534. Line 534 extends to the query posed at block 542 wherein a determination is made as to whether plunger 56 has been propelled to the wellhead with a detection by sensor 82 and conveyance of the output thereof to controller 168 (FIG. 1). In the event the plunger has not arrived, then the program loops as represented at loop line 544 extending to block 514. Where no such arrival has taken place, then the program again looks to the query posed at block 518 determining whether the tubing valve on-timer has decremented to a zero value. Where no plunger arrival is detected and if the query at block 518 results in an affirmative determination, then a no arrival condition is at hand and the program diverts as represented at line 546 and node 2. This looping represented at loop line 544 will continue with a negative determination to the query posed at block 518 to, for instance, carry out the timing indicated in blocks 528 and 538.

Where plunger 56 arrives within the programmed on-time, then as represented at line 548 the program extends to node 3. Node 3 reappears in FIG. 13C in conjunction with line 560 extending to block 562. Recall from FIG. 9 and plunger arrival arrow 292 that if vent valve 136 was in use, it will be closed upon plunger arrival and if the injection valve 102 is open to provide a boost on condition it will be closed. These activities are represented in block 562. As described in conjunction with block 538, the injection valve boost on interval may be programmed to a specific time. For example, programmed intervals for timeline block 294 in FIG. 9 might be twenty-five minutes. However, notwithstanding the preprogrammed interval of that timing, upon plunger arrival represented at arrow 292, the injection valve 102 is closed. This arrangement provides for enhanced program capability, for instance, to conserve injection gas. Next, as represented at line 564 and block 566 the program carries out well parameter time adjustments with respect to plunger arrival performance. That performance is based upon determining an optimum speed of the plunger which corresponds to the time involved from the opening of the tubing valve to plunger arrival. In general, times within the predesignated on-time are set forth to represent slow plunger performance and fast plunger performance. Those times generally are referred to as a slow window and a fast window. Good or normal performance may be an optimum plunger velocity or range of optimum velocities sometimes referred to as a good window. Where the program determines that the plunger arrived in a fast window, then as represented at line 568, the program extends to node 4. Where plunger arrival occurs in a slow window, then as represented at line 570 the program diverts to node 6. Where good performance is determined, then the program continues represented at line 572 extending to block 574. Block 574 illustrates that the tubing valve afterflow timer is loaded and started. The afterflow value is described at timeline block 304 in FIG. 9. For example, that afterflow value may be two hours. Additionally, block 574 indicates that the casing valve delay timer is loaded and started. In FIG. 9, this casing delay is shown at timeline block 316. Recall additionally, that both the equalizing valve 114 and casing valve 230 are actuated simultaneously by a single one of the latching valves 426–429 described in connection with FIG. 12. Thus, an equalizing delay time 310 is invoked simultaneously.

From block 574, as represented at line 576 and block 578, the tubing valve afterflow timer is decremented and the casing valve delay timer is decremented. The program then continues as represented at line 580 to the query posed at block 582 determining whether the elapsed tubing valve afterflow, as represented at timing line block 306 in FIG. 9, has not, reached that point in time where it encounters the commencement of the minimum off-time within the afterflow interval required for permitting plunger 56 to descend from the wellhead to its bottom or home locationor is greater than minimum off-time. Where an affirmative determination is made with respect to that calculated time, then, as represented at line 584 and block 586 the query is posed as to whether the casing valve delay and corresponding equalization valve closure time is greater than zero, i.e., has the casing valve delay timer not timed out. In the event of an affirmative determination then as represented by loop line 588, node 5 and line 590, the program continues to decrement the afterflow timer and casing valve delay timer as represented at block 578.

Returning to block 582, in the event of a negative determination, the program extends to line 592 and node 7. Returning to FIG. 9 and assuming, as before, that the afterflow time represented at timeline block 304 is two hours and the minimum off-time for the tubing valve at timeline block 314 is forty minutes, then the condition at line 592 with respect to block 582 is represented when timeline block 306 amounts to an hour and twenty minutes. However, when that condition is not present, and the query posed at block 586 wherein the casing valve delay value is not greater than zero, i.e., the delay has timed out, then as represented at line 594, the program diverts to node 8.

Figure 13A:
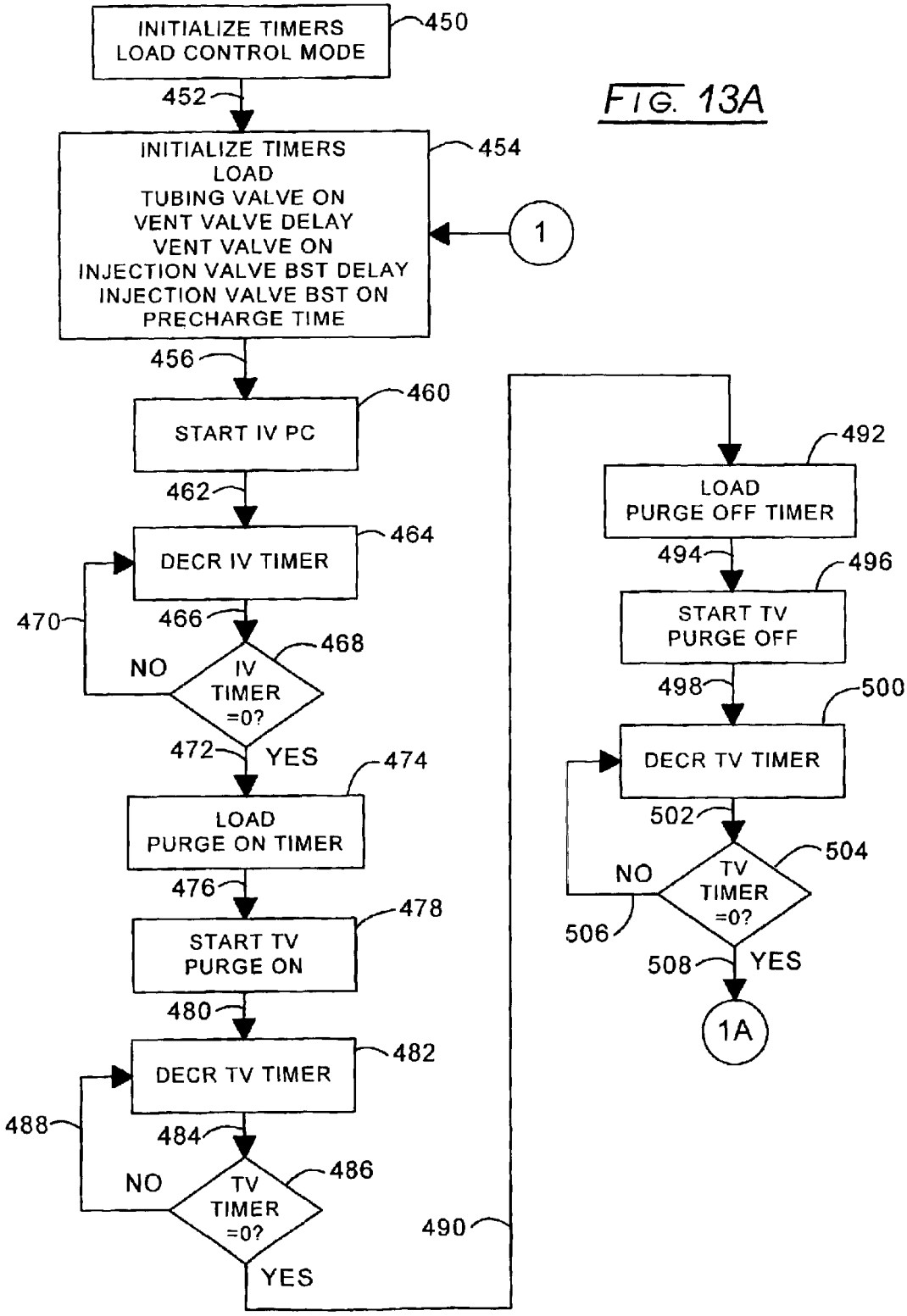
Figure 13B:
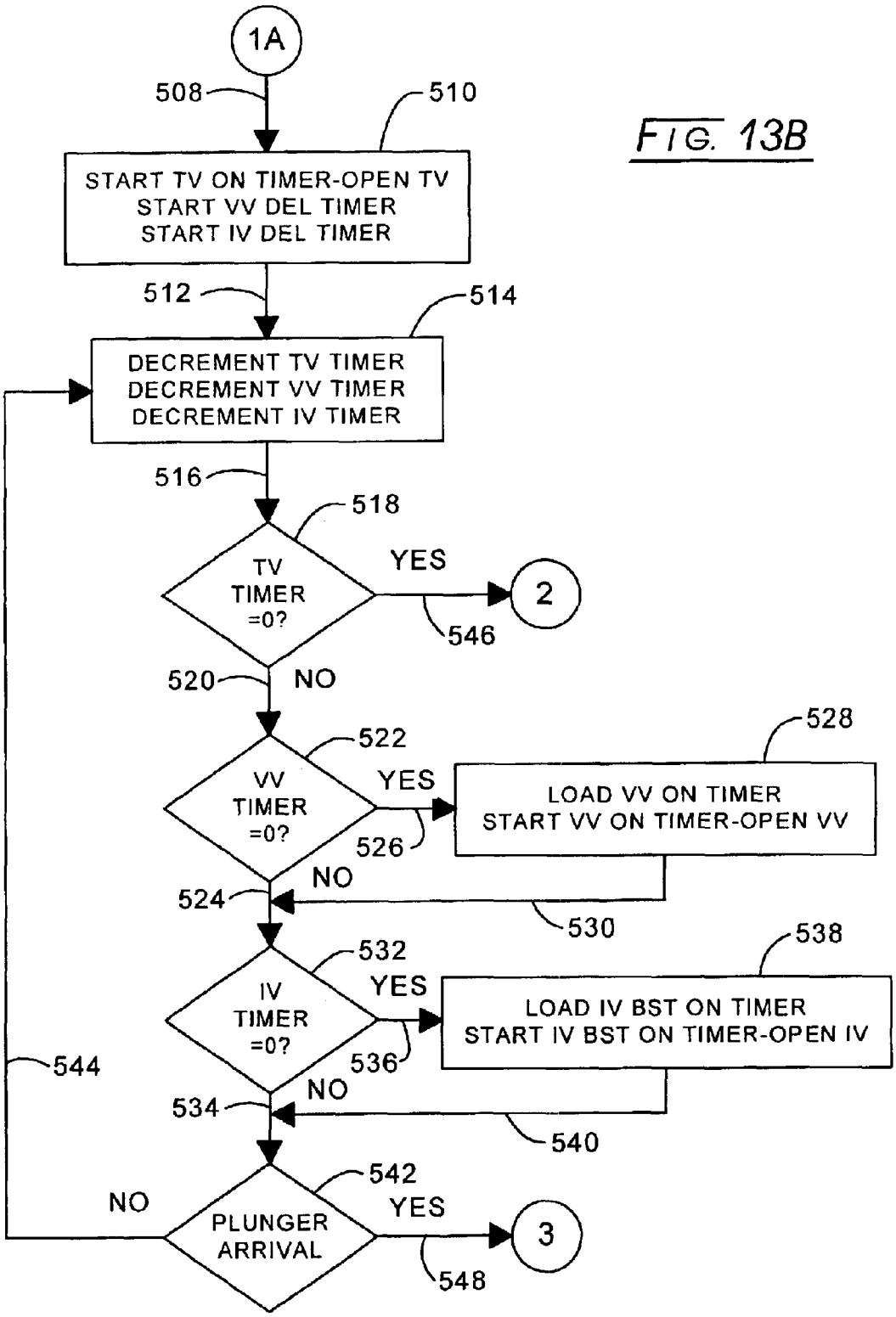
Figure 13C:
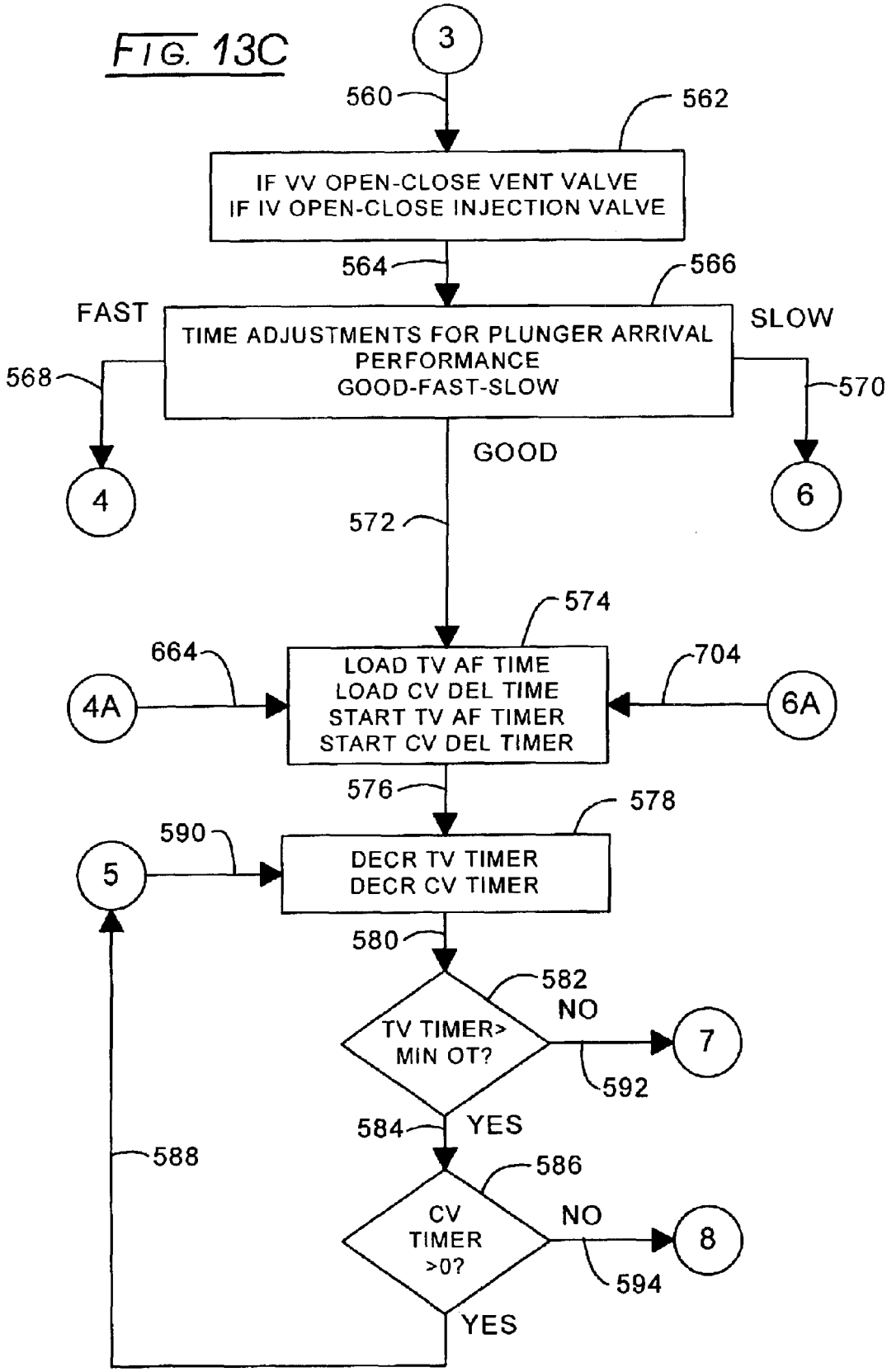
Figure 13D:
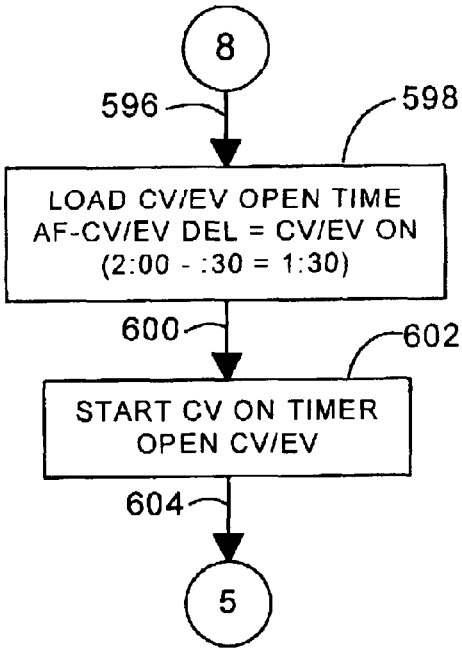

Node 8 reappears in FIG. 13D in conjunction with line 596 extending to block 598. Block 598 provides for the loading of the casing valve open time which is a calculated value. Returning to FIG. 9, the value determined is the timespan represented in timeline block 318 for the casing valve and timeline block 312 with respect to the equalizing valve. The casing valve delay time and casing valve open times coincide with the afterflow time represented at timeline block 304. Thus if the casing valve and equalization valve delay times are thirty minutes, and the afterflow time represented at timeline block 304 again is two hours, then the computed open time will be one hour and thirty minutes for both timeline blocks 312 and 318. This is shown in block 598 as the casing valve on-time. Accordingly, as represented at line 600 and block 602 the casing valve on-timer is started and casing valve 230, if present, and equalizing valve 114 are opened. As represented at line 604 the program then continues to node 5 and line 590 extending to the time decrementation activity at block 578. Returning momentarily to FIG. 1, it may be observed that the condition at block 602 is one wherein tubing valve 124 may be open, vent valve 136 is closed and injection valve 102 is closed. Accordingly, when equalization valve 114 is opened, injection gas pressure may still reside in secondary annulus 50 which will overcome the outlet side of tubing valve 124 opening check valve 116 and closing check valve 122. This, in effect, shuts in the tubing line. Equalization, as described above, will occur at common point header 66 to reach the condition of pressure equalization described in conjunction with FIG. 7 to, in effect, fill the chamber 54.

When the condition at line 592 obtains, the elapsed tubing valve open time during afterflow is calculated to reach the commencement of the interval of minimum off-time requiring closure and the program is directed to node 7. Node 7 reappears in FIG. 13E in conjunction with line 606 and block 608. Block 608 provides for a loading of the tubing valve minimum off-time in the tubing valve timer. Next, as represented at line 610 and block 612 the tubing valve is turned off and the tubing valve minimum off-time timing commences. As represented at line 614 and block 616 the tubing valve timer then is decremented as well as the casing valve timer. This timing is represented in FIG. 9 in connection with timeline block 314 with respect to the tubing valve and at timeline blocks 312 and 318 with respect to the equalizing valve and the casing valve. Note that these intervals terminate at the same point in time coincidently with the termination of the program afterflow.

The program continues as represented at line 618 and block 620 where a determination is made as to whether the casing valve timer is decremented to zero. In the event that it has not, then the program loops as represented at loop line 622 extending to block 616. Where an affirmative determination is made with respect to the query at block 620, then as represented at line 624, the program progresses to node 9.

Figure 13E:
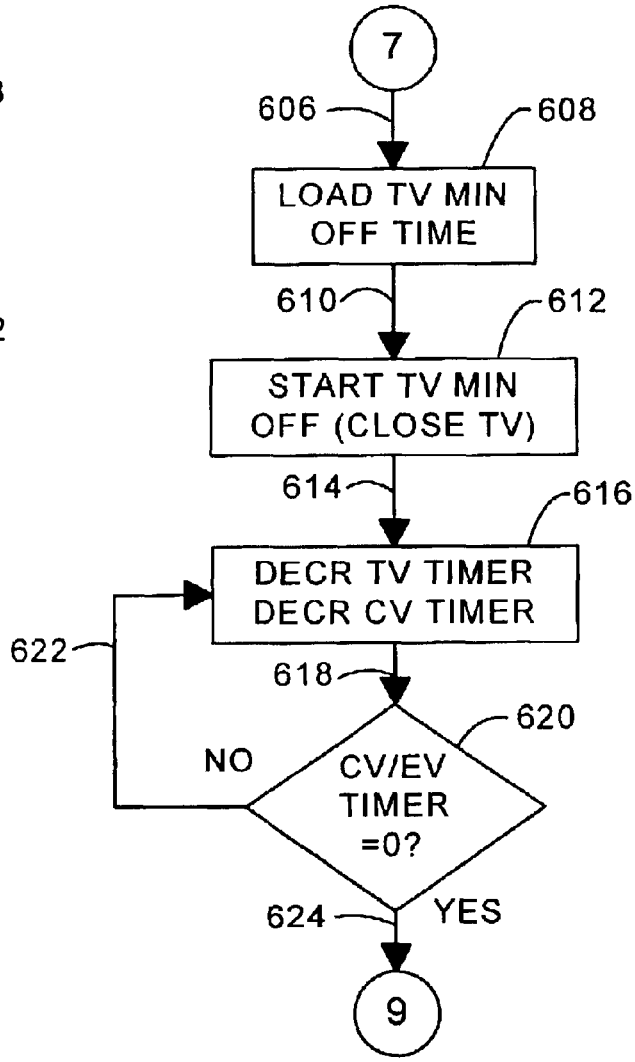
Figure 13F:
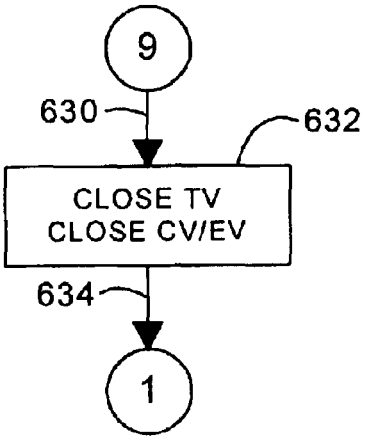
Figure 13H:
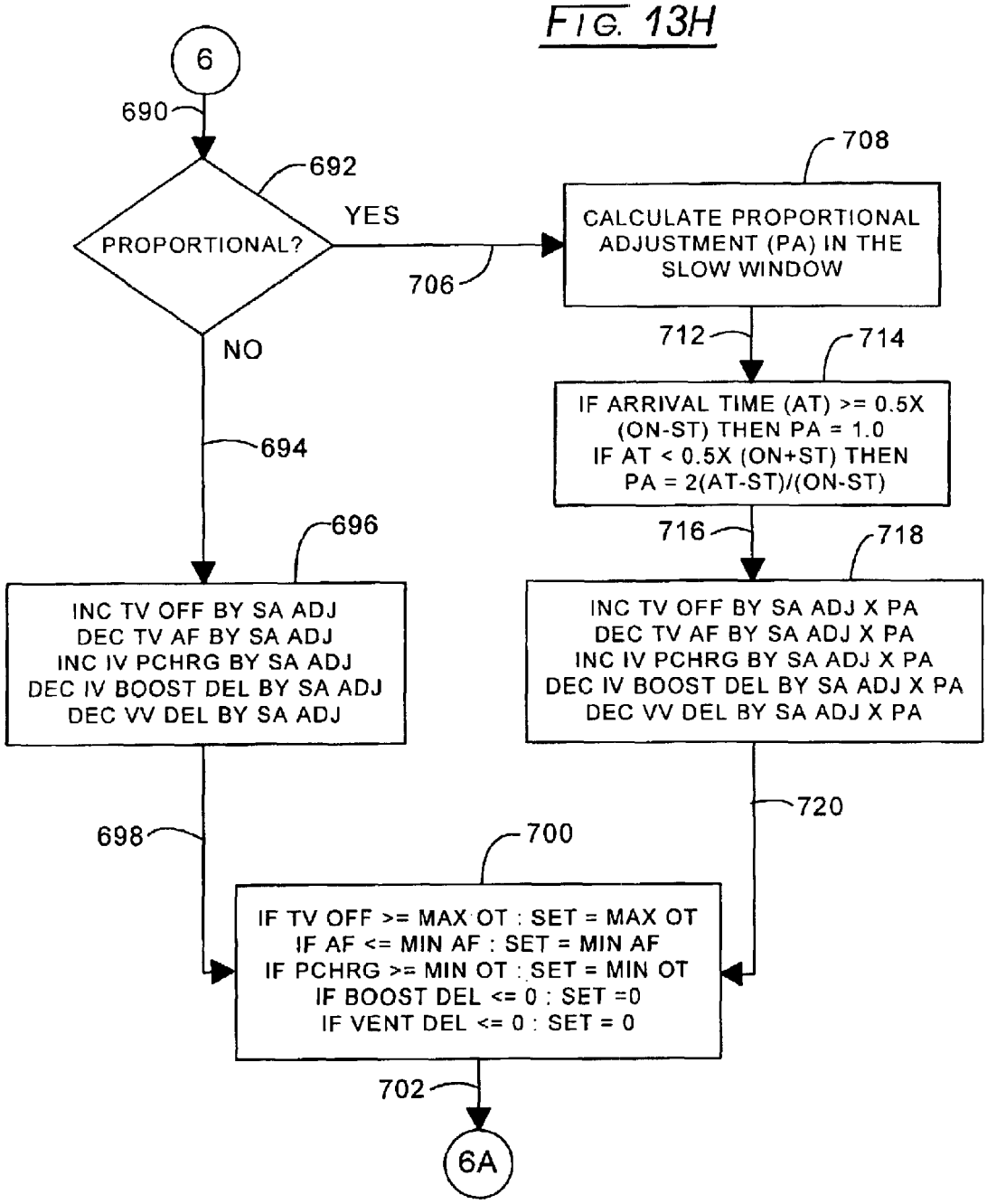
Figure 13I:
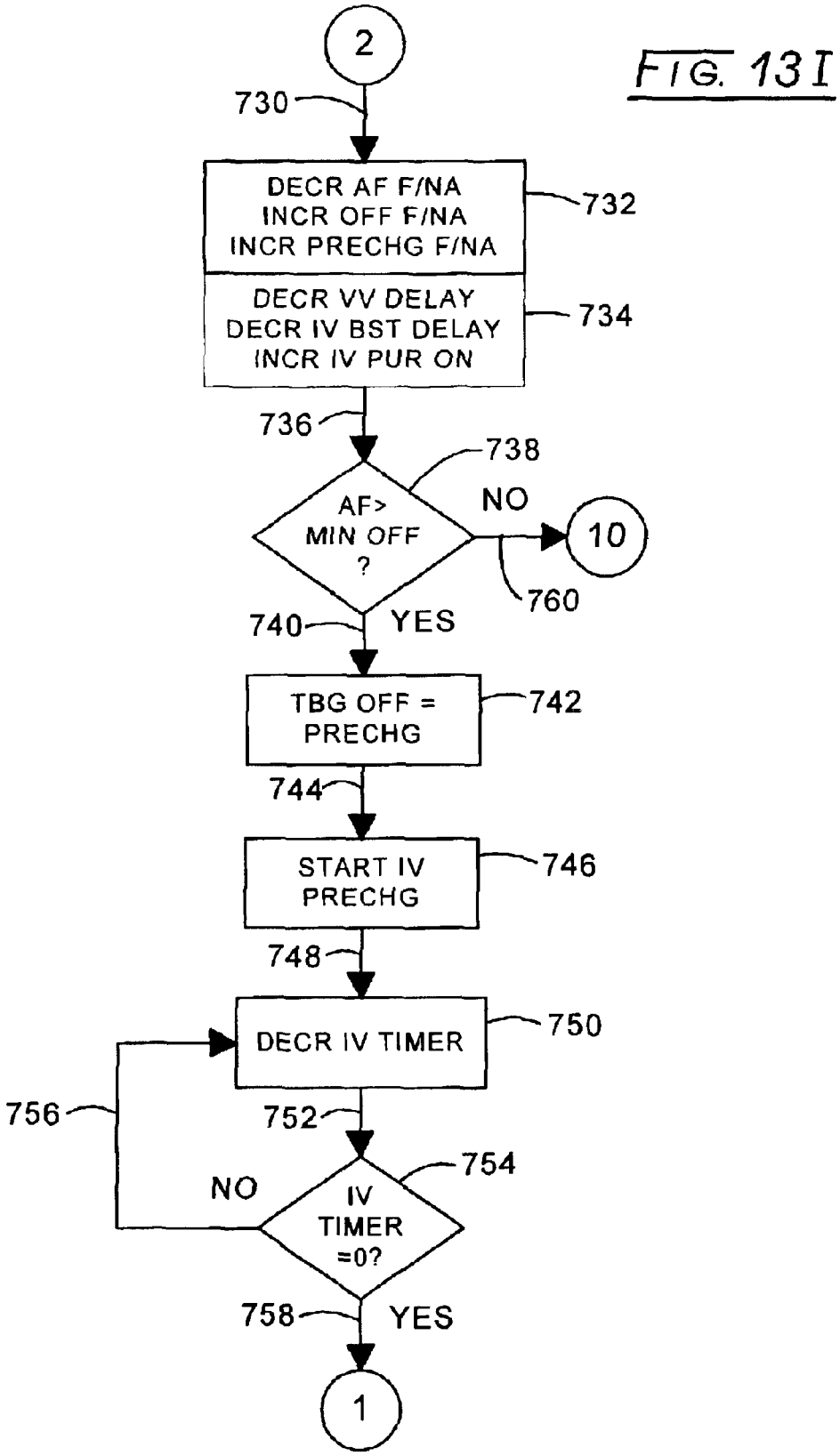

Node 9 reappears in FIG. 13E in conjunction with line 630 extending to block 632. Block 632 provides for the simultaneous closure of both tubing valve 124, casing valve 230, if present, and equalization valve 114. Recall that vent valve 136 and injection valve 258 are closed, however, the pre-charge interval will now commence. Accordingly, as represented at line 634 the program reverts to node 1 leading, for instance, to the loading of the injection valve pre-charge timer and subsequent starting of the pre-charge interval with the opening of the injection valve.

Returning to FIG. 13C and block 566, where a determination is made that plunger 56 arrived at the wellhead within a fast window the program continues to node 4 as represented at line 568. Node 4 reappears in FIG. 13G in conjunction with line 650. Line 650 leads to the query at block 652 determining whether well parameter adjustments for a fast window arrival are to be made proportional with respect to the beginning time and ending time of that window. Where such proportional adjustment is not to be made, then pre-established incremental adjustments will be made and the program continues as represented at line 654. These incremental adjustments which can be made are represented in block 656. In this regard, the tubing valve off-time may be decremented by a fast arrival adjustment (FA ADJ). Such adjustments may be made where tubing valve closure during afterflow is greater than the minimum off-time. The tubing valve afterflow (TV AF) may be incremented by a fast arrival adjustment (FA ADJ). The injection valve pre-charge interval (PCHRG) may be decremented by a fast arrival adjustment, thus conserving injection gas inasmuch as the amount of injection gas utilized was more than required to efficiently lift a liquid slug above the plunger to the wellhead. In similar fashion, the injection valve boost delay (IV BOOST DEL) may be incremented by a fast arrival adjustment (FA ADJ). Finally, where a vent valve is utilized, the vent valve delay (VV DEL) may be incremented by a fast arrival adjustment (FA ADJ). The program then continues to examine the result of these adjustments as represented at line 658 and block 660. In this regard, if the tubing valve off-time is greater than or equal to the minimum off-time, then the tubing valve off-time is set to that same minimum off-time. One of the programmable variables will be the selection of a maximum afterflow time and a minimum available afterflow time. Accordingly, a next examination determines whether the afterflow is equal to or greater than the maximum afterflow programmed. If it is, then the program is set to the maximum programmed afterflow. If the pre-charge (PCHRG) interval is greater than or equal to zero, then that interval is set to a programmed zero value to avoid the occurrence of a negative number. If the boost delay (BOOST DEL) is greater than or equal to the boost on-time (ON) then the boost delay is set to that boost on-time. Finally, if the vent valve delay (VENT DEL) is greater than or equal to the vent valve on-time, then the vent delay is set to that same on-time. As represented at line 662 the program then reverts to node 4A which reappears in FIG. 13C in conjunction with line 664 extending to block 574.

Figure 14:
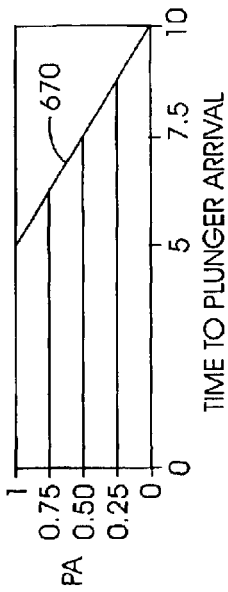
FIG. 14 is a schematic representation of proportional control for fast plunger arrival.

Returning to FIG. 13G and block 652, where the operator has elected to utilize proportional adjustment for plunger arrivals in a fast window, then as represented at 666 and block line 668 the program calculates a proportional adjustment factor (PA) which is applied to the predetermined incremental time adjustment represented at block 656. Looking additionally to FIG. 14 the fast window from the point in time of opening the plunger lift tubing valve to plunger arrival is represented as an abscissa extending from zero minutes to 10 minutes, 10 minutes being the commencement of a normal window or good window or the elected time increment representing good plunger speed or velocity. The proportional adjustment factor is seen as an ordinate in FIG. 14 extending from, in effect, 0 to 100% percent. The PA factor is computed as a ramp function, that function being herein shown graphically as a linear ramp 670 which extends from a proportional adjustment of 0% at the lengthy end of the fast window at 10 minutes, to 100% adjustment corresponding with 5 minutes or 50% of the entire fast window. Between that 5 minutes and zero minutes the arrival is very fast and the proportional adjustment factor remains at 100% of the elected incremental adjustment.

The ramp function 670 may be expressed by the following equation:

$$(Y-Y1)/(X-X1)=(Y2-Y1)/(X2-X1) \quad (1)$$

Where:

X=AT (arrival time);

X1=FT (fast time);

X2=0.5 FT

Y=PA (proportional adjustment);

Y1=0; and

Y2=1

Making the above substitutions (in equation (1)), the following expression obtains:

$$PA=2-2(AT/FT) \quad (2)$$

$$PA=(AT/FT-1)/(-F) \quad (3)$$

Expression (3) substitutes a variable, F, as a selected decimal representation of a time location within the range of fast rates in place of the value 0.5 employed with expression (2).

Line 672 is seen to extend from block 668 to block 674 which identifies the noted 50% of fast window selection wherein if the arrival time (AT) is greater than or equal to (F) or 0.5 times the fast time (FT), i.e., the time span of the range of fast rates, then the proportional adjustment is said equal to 1.0 or 100%. If the arrival time is greater than 0.5 times the full extent of the fast time then the proportioned adjustment is equal to expression (2) above. The program then carries out adjustments as represented at line 676 and block 678. Those adjustments in block 678 represent the adjustments made in block 656 multiplied by the proportional adjustment, PA. Upon deriving these adjustments, then as represented at line 680 the checks provided at block 660 are carried out.

Returning to FIG. 13C, where it is determined that the plunger arrived within a slow window, then as represented at line 570 the program reverts to node 6. Node 6 reappears in FIG. 13H in conjunction with line 690 extending to block 692 where a determination is made as to whether the operator has elected to utilize proportional adjustment with respect to the slow window. In the event that election was not made, then as represented at line 694 and block 696 fixed increment adjustments are carried out. In this regard, tubing valve off-time (TV OFF) is incremented by a slow arrival adjustment (SA ADJ); tubing valve afterflow (TV AF) is decremented by a slow arrival adjustment (SA ADJ); the injection valve pre-charge interval (IV PCHRG) is incremented by a slow arrival adjustment (SA ADJ); injection valve boost delay (IV BOOST DEL) is decremented by a slow arrival adjustment (SA ADJ); and vent valve delay (VV DEL) is decremented by a slow arrival adjustment (SA ADJ). As before, the results of these adjustments are evaluated as represented at line 698 and block 700. In this regard, adjustments are constrained by the predetermined tubing valve on cycle and checks are made for maximum and minimum values which have been programmed. Looking to the valuations or checks, if the tubing valve off-time (TV OFF) is greater than or equal to the maximum off-time (MAX OT), then the tubing valve off-time is set to that maximum off-time (MAX OT); if the afterflow (AF) is less than or equal to the minimum afterflow (MIN AF), then the afterflow is set to that minimum afterflow (MIN AF); if the pre-charge interval (PCHRG) is now greater than or equal to the minimum off-time (MIN OT) then the pre-charge interval is set to that minimum off-time (MIN OT); if the boost delay (BOOST DEL) is greater than or equal to zero, then the boost delay is set to zero; and if the vent delay VENT DEL) is less than or equal to zero, then the vent delay is set to zero. The program then returns to node 6A as represented at line 702. Node 6A reappears in connection with FIG. 13C in conjunction with line 704 extending to block 574.

Figure 15:
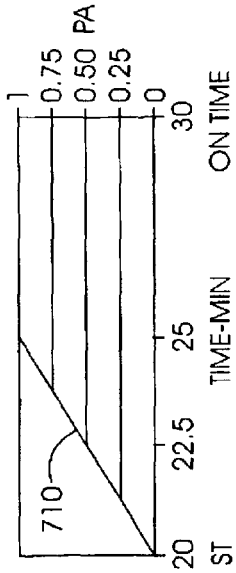
FIG. 15 is a schematic representation of proportional control for plunger arrivals within a slow window.

Returning to block 692, where the operator has elected to utilize proportional adjustments, then as represented at line 706 and block 708 a calculation is carried out for deriving a proportional adjustment factor (PA) for the slow window or range of slow designated times. Looking additionally to FIG. 15, this proportional adjustment is a ramp function which is graphically represented at sloping line 710. For illustrative convenience, the pre-assigned on-time for the plunger lift is arbitrarily set forth as 30 minutes. Within this on-time the slow window is assigned as extending from 20 minutes to 30 minutes. Ramp function 710 is seen extending from the commencement of the slow time window to a selected decimal representation of a time location within the slow window or range of slow rates of movement of plunger 56. i.e., a time location between ST and ON. Here that factor, F is 0.5 and corresponds with a plunger arrival time of 25 minutes in this example. With such proportioning, as +22.5 minutes the proportional adjustment, PA will be 0.50 or 50%.

Ramp 710 is developed in accordance with the following expression:

$$(Y-Y1)/(X-X1)=(Y2-Y1)/(X2-X1) \quad (4)$$

Where: X=arrival time (AT);

X1=the commencement of the slow time (ST);

(ON) is the designated on-time;

X2=(ON+ST) 0.5;

Y=PA;

Y1=0; and

Y2=1

Substituting the above results in the following expression:

$$(PA=2(AT-ST)/(ON-ST) \quad (5)$$

Expression (5) assumes that the decimal representation of time location within the slow window is 0.5. Substituting the variable, F for that value results in the following expression:

$$PA=(AT-ST)/F(ON-ST) \quad (6)$$

Returning to FIG. 13H, line 712 extends from block 708 to block 714 which provides that if the arrival time of the plunger (AT) is greater than or equal to FX (ON ST), where F=0.5, then PA=1.0. If AT is less than FX (ON+ST) then PA is equal to expression 5 (or expression 6). With the proportional adjustment, PA thus computed, as represented at line 716 and block 718, the proportional adjustments available are indicated. It may be observed that these available adjustments or well plunger speed parameters are the same as described in connection with block 696 but multiplied by the proportional adjustment factor, PA. The program then continues as represented at line 720 which extends to earlier-described block 700, whereupon the program extends to node 6A.

Returning to FIG. 13B and the query posed at block 518, where the tubing valve timer has been decremented to zero, I.e., the pre-designated plunger lift tubing on-time has timed out and the plunger 56 has not arrived at the wellhead, a condition referred to as "no arrival" is at hand. Accordingly, with an affirmative determination at block 518, as represented at line 546 the program is directed to node 2. Node 2 reappears in FIG. 13I in conjunction with line 730 extending to block 732. Block 732 carries out corrections for this no arrival condition. These corrections will include a decrementing of the afterflow for a non-arrival condition (DECR AF F/NA): an incrementing of the tubing off-time (INCR OFF F/NA); and an incrementing of the pre-charge interval for non-arrival (INCR PRECHG F/NA). Additionally, as represented in the thin line block 734, where a vent valve is employed, then the vent valve delay or vent delay may be decremented (DECR W DELAY); the injection valve boost delay may be decremented (DECR IV BST DELAY); and the injection valve purge on or open may be incremented (INCR IV PUR ON). The program then continues as represented at line 736 to the query posed at block 738 determining whether the on-time during the afterflow interval terminates substantially at the commencement of the minimum off-time. In the event of an affirmative determination, then as represented at line 740 and block 742 the tubing off-time as described at timeline block 240 in FIG. 9 is set equal to the pre-charge interval as described at timeline block 238 in that figure. Next, as represented at line 744 and block 746 providing for a starting of the injection valve pre-charge takes place. In concert with this, as represented at line 748 and block 760 the injection valve timer is decremented. Next, as represented at line 752 and block 754 a determination is made as to whether the injection valve timer has timed out or has reached a zero value. In the event that it has not, then the program loops as represented at line 756 to block 750 to continue injection valve timer decrementation. In the event of an affirmative determination with respect to the query at block 754, then as represented at line 758 the program reverts to node 1 in FIG. 13A.

Returning to the test at block 738, in the event of a negative determination when the on-time during the afterflow interval terminates earlier than a commencement of the minimum off-time, then the program continues to node 10 as represented at line 760.

Figures 13J, 13K:
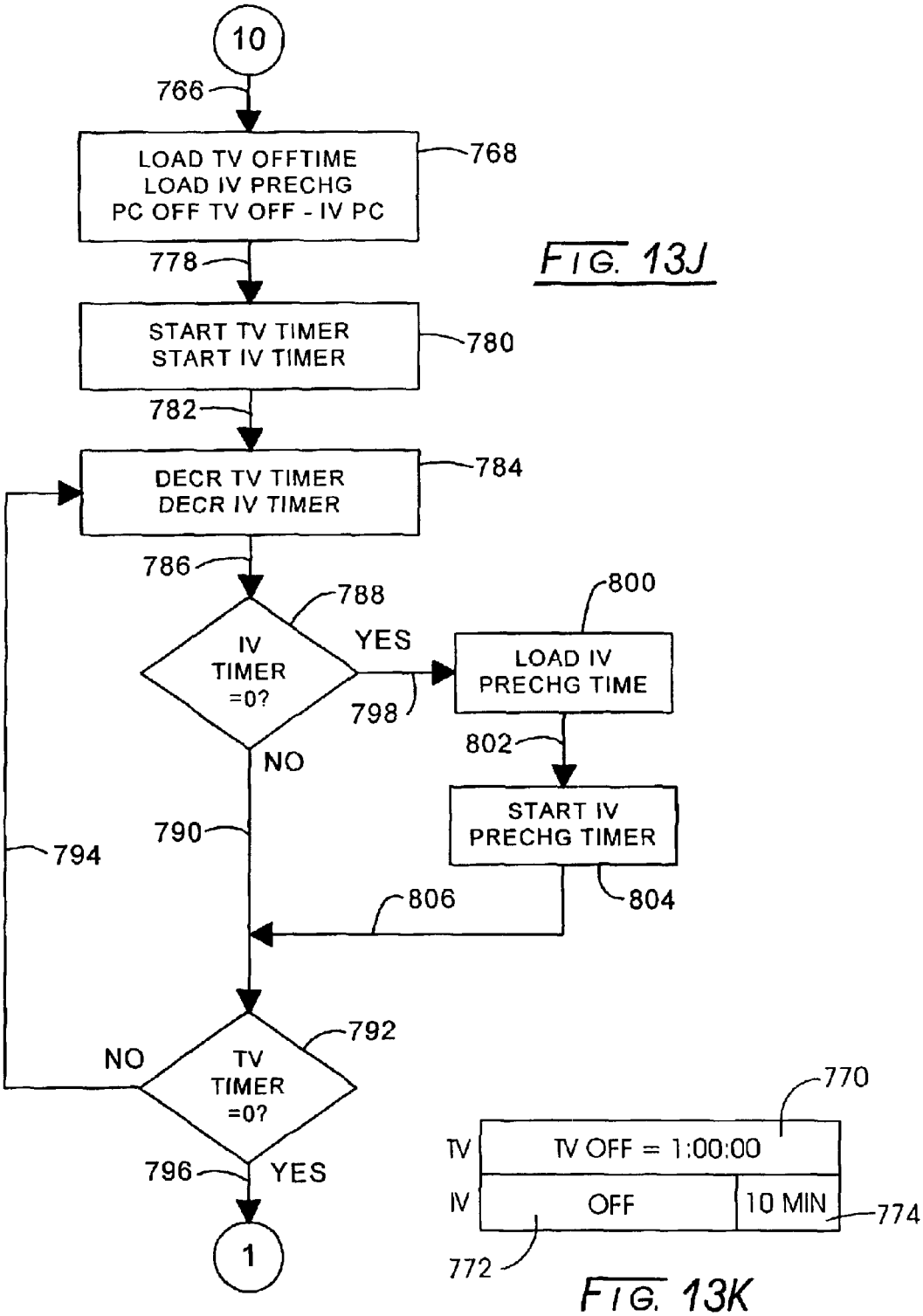

Node 10 reappears in FIG. 13J in connection with line 766 extending to block 768. Block 768 provides for the loading of the tubing valve off-time as well as the injection valve pre-charge times for this type of no arrival condition. Looking momentarily to FIG. 13K, the earlier-described timeline blocks 240 and 314 are revised. For example, the tubing valve off interval is now described as being one hour and during that interval the injection valve is off as represented at block 772 until the commencement of the pre-charge interval which may, for example, increase from 8 minutes to 10 minutes as represented at block 774. As opposed to the arrangement shown in FIG. 9, the minimum off-time is not incorporated within the afterflow.

Returning to FIG. 13J upon carrying out the timer loading at block 768, as represented at line 778 and block 780, the tubing valve and injection valve timers are started. The injection valve off interval 772 (FIG. 13K) is computed and that computed off-time is then timed by the injection valve timer. Next, as represented at line 782 and block 784 the tubing valve and injection valve timers are decremented and, as represented at line 786 and block 788 a determination is made as to whether the injection valve timer has reached a zero valuation. In the event that it has not, then as represented at line 790 and block 792 a determination then is made as to whether the tubing valve off-timer has reached a zero valuation. In the event that it has not, then the program loops as represented at loop line 794 to the decrementing steps of block 784. In the event of an affirmative determination at block 792, then as represented at line 796 the program extends to node 1 shown in FIG. 13A.

Returning to the inquiry at block 788, in the event of an affirmative determination that the injection valve off-timer has reached zero, then as represented at line 798 and block 800 the injection valve pre-charge time is loaded and, as represented at line 802 and block 804 the injection valve pre-charge timer is started and as represented at line 806 the program continues to line 790 as the tubing valve timer continues to time out the tubing valve off-time.

Figure 16:
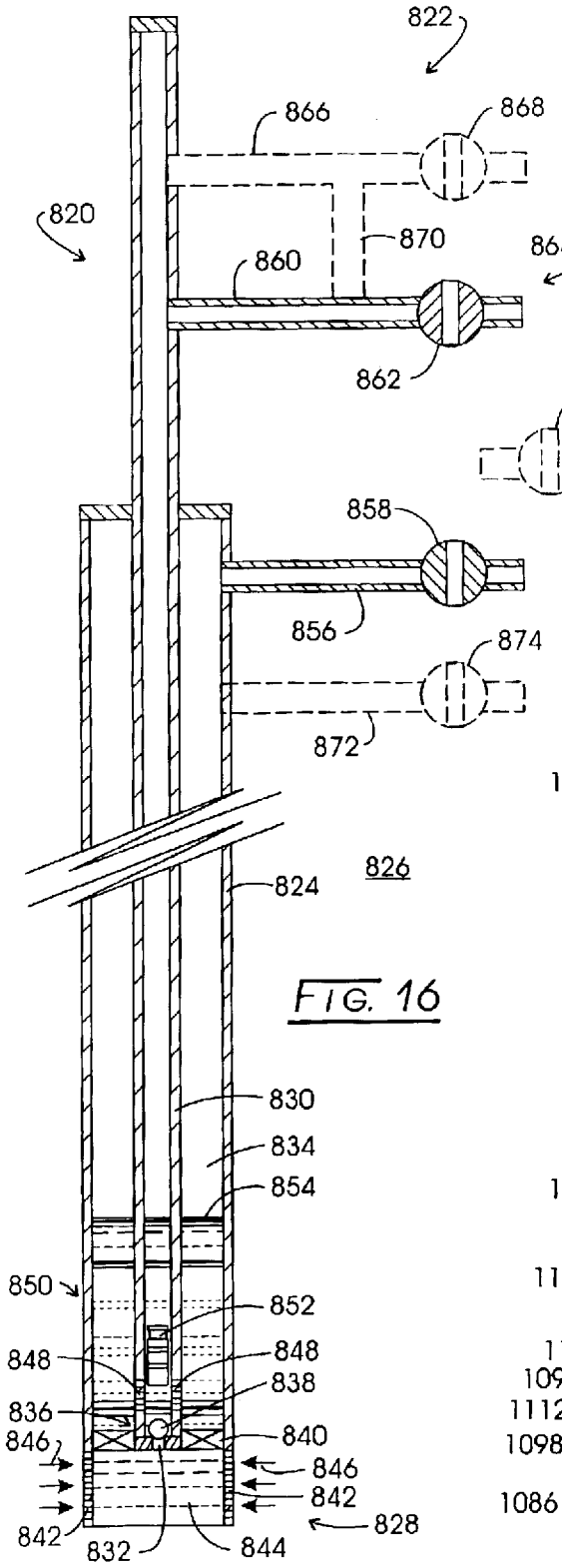
FIG. 16 is a schematic sectional representation of another well installation incorporating the method of the invention.

Other chamber-based well installations can be plunger enhanced under the teachings of the invention. For example, a "two-packer" chamber structuring often is employed with injection lift installation. See Brown (supra) at p. 126. Referring to FIG. 16, such two-packer geometry is converted to a single packer geometry to establish a chamber. Employing only a casing and a tubing string now incorporating a plunger, this embodiment is illustrated with a well installation represented generally at 820. Installation 820 includes a wellhead represented generally at 822 and is shown having a casing 824 extending from the wellhead 822 within a geologic formation represented generally at 826 to a lower region represented generally at 828. A tubing assembly 830 extends within the casing 824 from the wellhead 822 to a fluid input 832 at lower region 828. The spacing between tubing assembly 830 and casing 824 defines an annulus 834 representing a volume or cross-sectional area substantially greater than the corresponding volume within a cross-section of the tubing assembly 830. An entrance valve assembly functioning as a check valve represented generally at 836 is positioned at the tubing assembly fluid input 832. This check valve may be configured as a ball valve the ball of which is represented at 838. Other than through the entrance assembly 836, zone fluids are blocked from flowing into the annulus 834 by an annulus seal or packing 840. Below this packing 840 and entrance assembly 836 are the perforation intervals of casing 824 as shown at 842. Zone fluids 844 including liquid and gas flow through casing perforations 842 as represented by the arrow arrays 846. Above the entrance assembly check valve function the tubing assembly 830 is perforated or provides an opening 848. Thus, a chamber is defined as represented in general at 850. A plunger 852 is shown in its home or bottom location within the tubing assembly 830 and fluids which have migrated through the entrance assembly 836 are shown to have accumulated to an equalized level within chamber 850 as represented at fluid level 854.

Now turning to wellhead 822, annulus 834 is seen to be in fluid flow communication with a casing line 856 incorporating a casing motor valve or casing valve 858. Casing line 856, in general, will extend to a common point which may, for example, be provided in similar fashion as common point header 66 shown in FIG. 1. A tubing line 860 incorporating a tubing motor valve or tubing valve 862 is provided in fluid flow communication with tubing assembly 830. Tubing line 860 may further incorporate a check valve (not shown) at location 864 on the downstream side of valve 862 and then extend to the noted common point with casing line 856. As an optional feature, in fashion similar to the arrangement of FIG. 1, a venting line 866 incorporating a vent motor valve or vent valve 868 may be provided in fluid flow transfer association with tubing assembly 830. A fluid flow line 870 is seen communicating between flow lines 860 and 866. Vent line 866 may extend to a low pressure source, for example, such as a tank at atmospheric pressure or a low pressure line within a plant facility. Casing line 856 as well as tubing line 860 ultimately will be in communication with a collection facility. As an option, that facility may also provide a source of gas under pressure which may be implemented as a compressor for purposes of providing injection plunger lift gas to the annulus 834. Accordingly, an injection line 872 incorporating an injection valve 874 is shown in fluid flow communication with casing 824 or annulus 834. Where injection line 872 is not utilized, the natural pressures of zone 826 as manifested at casing perforation intervals 842 provide the pressures requisite for operating chamber 850 and propelling plunger 852 to the wellhead 822.

Figure 17:
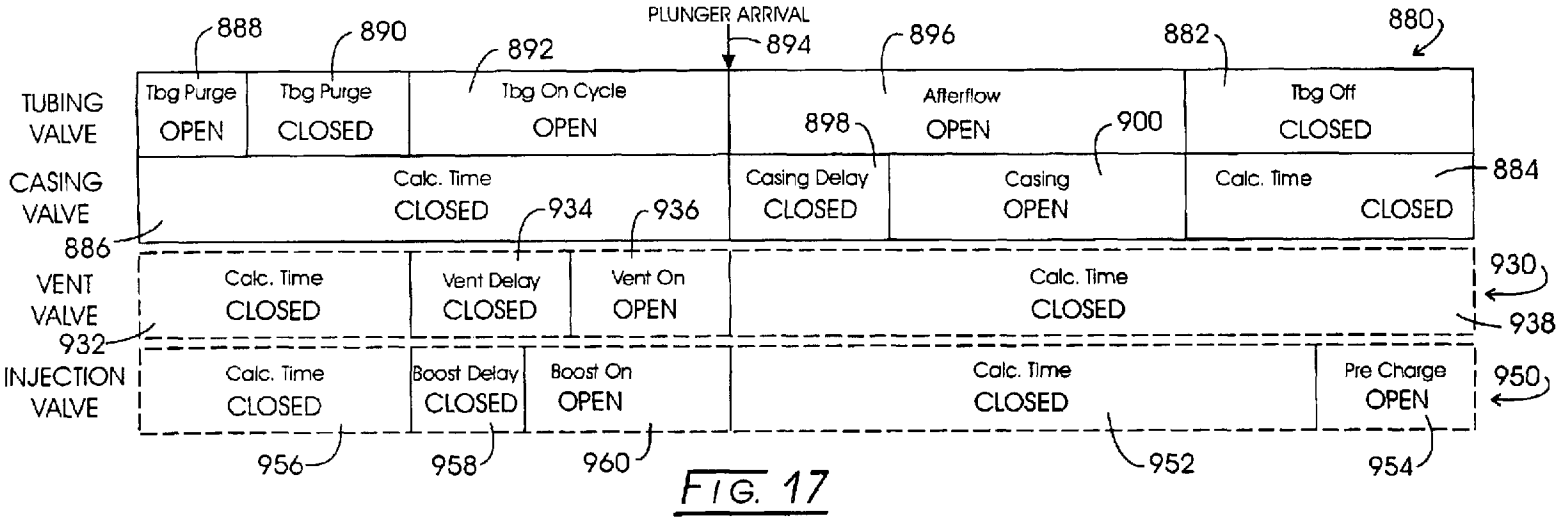
FIG. 17 is a timeline diagram associated with the well installation of FIG. 16.

Referring additionally to FIG. 17, a timeline diagram is provided showing the operation of well installation 820 utilizing only the tubing valve 862 and casing valve 858. The diagram is structured for a condition wherein the interval of afterflow is less than an assigned minimum off-time required to permit the plunger 852 to move from wellhead 822 to its bottom location. For example, the afterflow may be 30 minutes with respect to a minimum off-time of 45 minutes.

In general, the level of 854 of fluid within the chamber 850 in FIG. 16 is relatively low to exhibit a corresponding relatively low bottom hole pressure. To describe a cycle of performance, it may assumed that the tubing valve 868 is closed as represented by timeline block 882. That off-time interval may, for example, be one hour in duration for the noted exemplary afterflow of 30 minutes. Similarly, casing valve 858 will be closed for a corresponding calculated interval as represented at 884. Pressures from zone 826 will have built up during this time in combination with the accumulation of fluid within the chamber 850 and will be present in both the tubing assembly 830 and the annulus 834. While the casing valve 858 remains closed as represented at timeline block 886, the tubing valve 862 will open for a purge fallback interval as represented at timeline block 888. This casing pressure within annulus 834 will evacuate the liquid within it through the openings or perforations 848 and into tubing assembly 830. Inasmuch as this tube filling activity will generally elevate the location of plunger 852, as before, the tubing valve 862 is then closed for a purge interval effective to prevent plunger 852 to fall to its home position below the resultant tubing assembly contained slug of fluid. That purge off-time (fallback) interval is represented at timeline block 890. At the termination of the tubing purge off-time interval, as represented at timeline block 892, tubing valve 862 is opened to define an on cycle or on-time during which plunger 852 and the fluid slug above it are driven upward at some speed or velocity to expel such fluid into the tubing valve stream and thence ultimately to the collection facility. Casing valve 858 remains closed. At the point in time of plunger arrival represented by arrow 894 tubing valve 862 will remain open for an afterflow interval as represented at timeline block 896, for example, the above-noted 30 minutes, and the casing valve 858 remains closed for a programmed casing delay interval. This delay permits any fluid which may have been propelled through tubing assembly 830 behind plunger 852 to be evacuated through tubing line 860 as opposed to falling back to the lower region of the well. That casing delay is represented at timeline block 898. Following the casing delay, as represented at timeline block 900 casing valve 858 is opened. This casing valve open condition continues for the duration of the afterflow interval and is a computed interval. When that afterflow time is less than the designated minimum off-time, for example, if the casing delay was programmed to be 5 minutes, and the afterflow interval was 30 minutes with a minimum off-time of 45 minutes, then the casing open interval 900 would be 25 minutes. During the tubing off interval 882, plunger 852 returns to its bottom or home location and during the mutually open condition of the tubing valve and the casing valve, the chamber 850 in effect, fills through the entrance assembly 836 and openings or perforations 848.

As before, the speed or velocity performance of plunger 852 is monitored with respect to a predetermined tubing valve open time. An optimum plunger speed or velocity is determined either as a single point or with an arrange of time intervals. A slow window is determined as well as a fast window of plunger performance.

Assuming plunger arrival 894 occurs in a fast window of evaluation, then typically the afterflow interval 896 will be increased, for example, in 2 minute increments while the tubing off-time 882 will be decremented. As the afterflow interval is increased to equality with the predetermined minimum tubing off-time or exceeds it, for example, reaching an afterflow time of 60 minutes with a minimum off-time of 45 minutes, then the control will close the tubing valve for the minimum off-time while retaining the casing valve in its open orientation throughout the afterflow interval.

Figure 18:
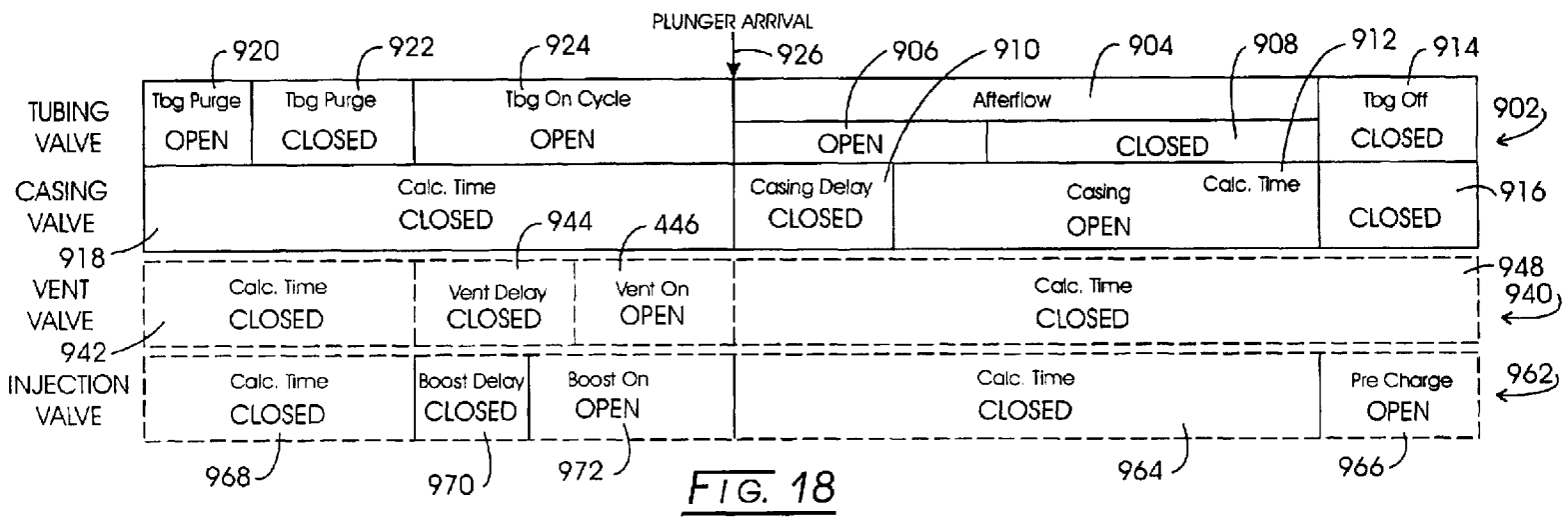
FIG. 18 is a timeline diagram additionally associated with the well installation of FIG. 16.

Referring to FIG. 18, this operational condition is represented at the timeline combination shown in general at 902. In the figure, the timeline block 904 representing afterflow is expanded, for example to 60 minutes with respect to 45 minute minimum tubing off-time. Accordingly, the tubing on-time as represented at timeline block 906 occurring during afterflow is diminished, for the example described to 15 minutes to accommodate for the minimum off-time represented at timeline block 908 which for the instant example is 45 minutes. Casing delay represented at timeline block 910 initially is programmed and may be, for example, 5 minutes. The resultant casing open time as represented at timeline block 912 is calculated to be sustained until the end of the afterflow interval 904, or is now for the noted example an interval of 55 minutes. Thus, while the plunger 852 is permitted to return from the wellhead to its bottom location during the minimum off-time, the well continues to produce gas through the casing line 856. Following the afterflow interval, both the tubing valve 862 and casing valve 858 are turned off providing for a pre-charge as respectively represented at timeline blocks 914 and 916. At the termination of this pre-charge interval, casing valve 858 remains closed as represented at timeline block 918 while the tubing valve 862 is open for a purge interval as represented at timeline block 920. During this interval, the plunger 852 will be caused to rise somewhat. According, as represented at timeline block 922 tubing valve 862 is closed for an interval sufficient for the plunger 852 to return to its home position or bottom location wherein the slug of fluid in the tubing assembly 830 now is above it. Following the tubing purge off-time interval 922, tubing valve 862 is opened as represented at timeline block 924 for an interval occurring until plunger arrival represented at arrow 926. Program casing delay as earlier-described at 910 then ensues in combination with the afterflow interval 904 and the tubing on-time 906.

It may be observed from FIG. 16 that during the intervals wherein both the tubing valve 862 and casing valve 858 were closed to pressurize the well, such pressure did not affect the perforation interval 842 inasmuch as it is located below the seal 840 and the associated check valve function at entrance assembly 836. Fluids are not allowed to return to the formation due to the presence of the check valve. Note, the formation does see the increase in tubing and casing pressure build-up where flow is shut-in.

Returning to FIG. 17 and looking to the timeline combination represented in general at 930 the performance of an optional vent valve as at 868 is revealed. The vent valve may be employed where slow arrivals of the plunger are encountered or under a variety of conditions, for example, where the well will have been shut in for a given reason such as high sales line pressure or the like. In general, the vent valve is closed as represented at timeline block 932 during the tubing purge activities represented at timelines 888 and 890. At such time as the tubing on cycle or on-time commences as represented at timeline block 892, the vent valve may remain closed during a vent delay as represented at timeline block 934, whereupon, as represented at timeline block 936 the vent valve as at 868 is opened until plunger arrival as represented at arrow 894. Upon such arrival, the control responds to close vent valve 868 as represented at timeline 938 which closure continues through the interval represented at timeline 932.

Looking to FIG. 18 the same logic is portrayed with respect to a venting timeline represented in general at 940. Again as discussed above, this timeline is associated with a condition wherein the afterflow interval equals or exceeds the tubing minimum off-time. Timeline 940 shows that the vent valve 868 is closed as represented at timeline block 942 during the intervals of purging activity represented at timeline blocks 920 and 922. At the commencement of the tubing on cycle or on-time, as represented at timeline block 924, a vent valve delay interval ensues as represented at timeline block 944, following which a vent on interval occurs with the opening of vent valve 868 as represented at timeline block 946. This open interval will persist until plunger arrival as represented at arrow 926, whereupon, as represented at timeline block 948 vent valve 868 will close and remain closed through the timeline block interval 942, whereupon the vent delay interval 944 commences.

For the embodiment of FIGS. 16–18, while fluid flow is through the check valve function at entrance assembly 836 the liquid head will be lessened, however, cycle frequency will increase somewhat dramatically. Further, production through the casing valve occurs throughout the entire afterflow interval and the zone at the perforations in the casing is not affected by pressurization of annulus 834 nor by fluid fallback.

As described in connection with FIG. 16, injection gas from a source of gas under pressure may be applied to the annulus 834 as represented at injection line 872 and injection valve 874. Looking to FIG. 17, for the noted condition wherein the interval of afterflow is less than the minimum tubing off-time, an injection cycle is identified generally at 950. With this arrangement, upon plunger arrival as represented at arrow 894 the injection valve 874 is closed as depicted at timeline block 952. At a calculated termination of this injection off interval, as represented at timeline block 954 injection valve 874 is opened to carry out a pre-charge interval. At the termination of that interval, injection valve 874 is closed as represented at timeline block 956 while the tubing purge open and tubing purge close activity as represented at respective timeline blocks 888 and 890 are carried out. At the commencement of the tubing on cycle as represented at timeline block 892, the boost delay interval ensues, injection valve 874 remaining closed. The boost delay is represented at timeline block 958. At the termination of this boost delay, injection valve 874 is opened as represented at timeline block 960 and the injection continues until plunger arrival as represented at arrow 894. The program then closes injection valve 874 and the close time represented at timeline block 952 ensues.

Looking to FIG. 18, the corresponding timeline for utilization of an injection valve under conditions wherein the afterflow interval is greater than the minimum off-time of the tubing line is represented in general at 962. As before, with the occurrence of plunger arrival as represented at arrow 926, the injection valve 874 will remain closed as depicted at timeline block 964. However, at the termination of afterflow as represented at timeline block 904 the tubing off interval and casing off interval as represented respectively at timeline blocks 914 and 916 will have been set to the pre-charge interval. As represented at timeline block 966 the pre-charge interval occurs at the termination of afterflow. Timeline block 968 shows that injection valve 874 then is closed during the carrying out of purge activities as represented at timeline blocks 920 and 922. As represented at timeline block 970 a boost delay interval, if any, is carried out following which as shown at timeline block 972 the boost on condition is commenced with the opening of injection valve 874 for purposes of urging plunger 852 to wellhead 822. This boost on condition persists until plunger arrival as represented at arrow 926, whereupon the injection valve 874 is closed as represented at timeline block 964.

Another chamber structure utilizing gas lift production and designed to save injection gas where long casing pay intervals are encountered is configured somewhat as an elongated bottle which is positioned below the pay interval and incorporates a very long neck or stem extending to a location above the pay interval. A check valve is positioned at the bottom of the bottle and a length of mosquito tubing extends from the open end of the stem into the bottle region at a location just above the check valve. The stem is packed or sealed against the casing adjacent the stem top just below an entrance opening for receiving injection gas at an annulus between the mosquito tubing and the interior of the stem. See Brown (supra) at p. 127.

Figure 19:
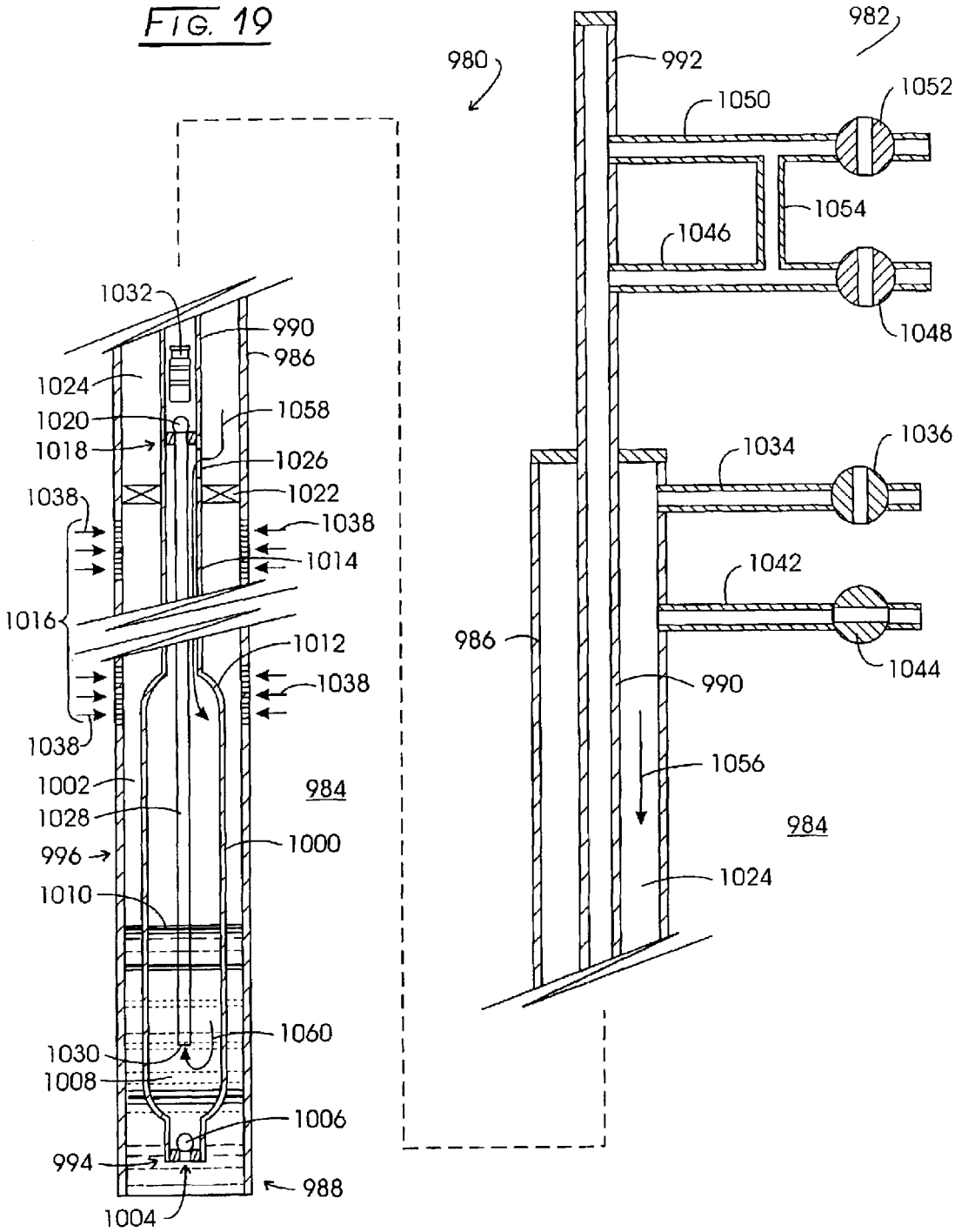
FIG. 19 is a schematic sectional representation of another well installation employing the method of the invention.

Referring to FIG. 19, a well installation incorporating the modification of such a chamber to achieve plunger enhanced liquid lift is represented generally at 980. The wellhead for installation 980 is represented generally at 982 and the geologic zone within which it performs is represented in general at 984. Casing 986 is seen extending into zone 984 to a lower region represented generally at 988. A tubing assembly 990 extends from a lubricator region 992 to a fluid input at lower region 988 which, for the instant embodiment is a formation fluid receiving assembly or check valve function represented generally at 994 forming part of a chamber represented generally at 996. Chamber 996 is seen to have a bottle-like configuration with a cylindrical chamber side 1000 of diameter greater than that of tubing assembly 990 and which is spaced from casing 986 to define a chamber annulus 1002. The lower end of chamber 1000 is of generally hemispherical-shape and extends to fluid receiving assembly 994 which incorporates a check valve function 1004 schematically represented as a ball valve with a ball 1006. Zone fluids 1008 will accumulate through the check valve function 1004 as well as into the chamber annulus 1002 and is seen at a common fluid level 1010. The upper portion of chamber 996 also is of hemispherical-shape and is configured with tubing assembly 990 to define a long stem portion 1014 which extends through the long pay or perforation interval represented at bracket 1016. That pay interval may, for example, be provided as a sequence of casing perforation arrays having a length of about 1500 feet. Stem portion 1014 extends through this pay interval 1016 to, in effect, be terminated at a check valve function 1018 here shown as another ball valve with a ball 1020. Additionally positioned above the pay interval 1016 but below check valve function 1018 is an upper packing or seal 1022 extending between the stem portion 1014 which, in effect, is a continuation of tubing assembly 990 and the casing 986. Thus, the casing annulus 1024 between tubing assembly 990 and casing 986 is sealed off at packer 1022. However, between the check valve function 1018 and packer 1022 is an opening or openings 1026 serving as an injection input to the stem portion 1014. Check valve function 1018 supports or acts as a hanger for a lengthy extent of mosquito tubing 1028 which extends therefrom to a lower opening 1030 in the lower region of chamber 996. With this arrangement, lower opening 1030 serves as a tubing input with respect to tubing assembly 990. Positioned within tubing assembly 990 above check valve function 1018 is a plunger 1032.

Now looking to the wellhead 982, a casing line 1034 incorporating a casing valve 1036 is provided in fluid flow communication with the casing or casing annulus 1024 and extends to a collection facility. Additionally communicating with the casing or casing annulus 1024 is an injection line 1042 which incorporates an injection valve 1044 and extends between the casing or casing annulus 1024 and a source of gas under pressure which may be employed for the instant injection plunger lift. A tubing line 1046 is seen coupled in fluid flow communication with tubing assembly 990 and extends to a common point with casing line 1034, for example, such as the common point header 66 shown in FIG. 1 and thence to the collection facility. A tubing valve 1048 is incorporated within tubing line 1046. As an optional feature, a venting line 1050 incorporating a vent valve 1052 may be provided which extends to a low pressure component of the collection facility such as a tank at atmospheric pressure or a low pressure line. A diverting line 1054 communicates with tubing line 1046 and venting line 1050.

Installation 980 may be operated in the manner described above in connection with the earlier embodiments without the presence of an equalization valve. In this regard, a pre-charge activity may be carried out by opening vent valve 1044 while the remaining valves are closed. This will cause injection pressure along an injection passage represented by arrow 1056 within casing annulus 1024 and arrow 1058 extending through opening 1026 and into the chamber 996. This will close check valve 1004. The injection valve 1044 then is closed while tubing valve 1048 is opened for a short purge interval which, as represented at arrow 1060 will cause fluid to enter mosquito tubing 1028 and pass through check valve function 1018 and into tubing assembly 990 above that valve. Thus, fluid is removed from the chamber 996 and now extends above the check valve function 1018. This activity will create a slug of fluid and tubing valve 1048 then is closed for an interval permitting plunger 1032 to return to its home or bottom location below the liquid slug. Tubing valve 1048 then is opened to permit commencement of the tubing on cycle or on-time and upon a detection of plunger arrival at the lubricator region 992 tubing valve 1048 may remain open during an afterflow interval. During this same afterflow interval casing valve 1036 is open to produce gas. As before, however, a casing delay may be invoked prior to such opening and following plunger arrival to remove any liquids which may have followed plunger 1032 to wellhead 992. At some interval during the afterflow, both the casing valve 1036 and tubing valve 1048 will be open, a condition which ultimately will equalize pressure at the chamber 996 and annulus 1024. Accordingly the chamber 996 is filled.

With the arrangement, as before, plunger cycles may increase substantially in frequency to, in turn, assure low bottom hole pressure. Such enhanced cycling frequency also incorporates the attendant advantages of improving the movement of solids from the lower region 988 due to their entrainment within well liquids and no injection pressures are asserted at the perforation interval 1016 in consequence of the seal or packing 1022. Because the speed of velocity or plunger 1032 also may be monitored and the above-noted well parameters adjusted to achieve an optimized plunger speed the lifting of liquids may be carried out with much greater efficiency and injection gas utilization will be optimized.

Well installations may be encountered in which the upper regions of a casing within a geologic zone may be ruptured or otherwise opened. This may permit zone liquids to enter the well and migrate to its lower region to substantially increase bottom hole pressures and adversely affect if not terminate well production.

Figure 20:
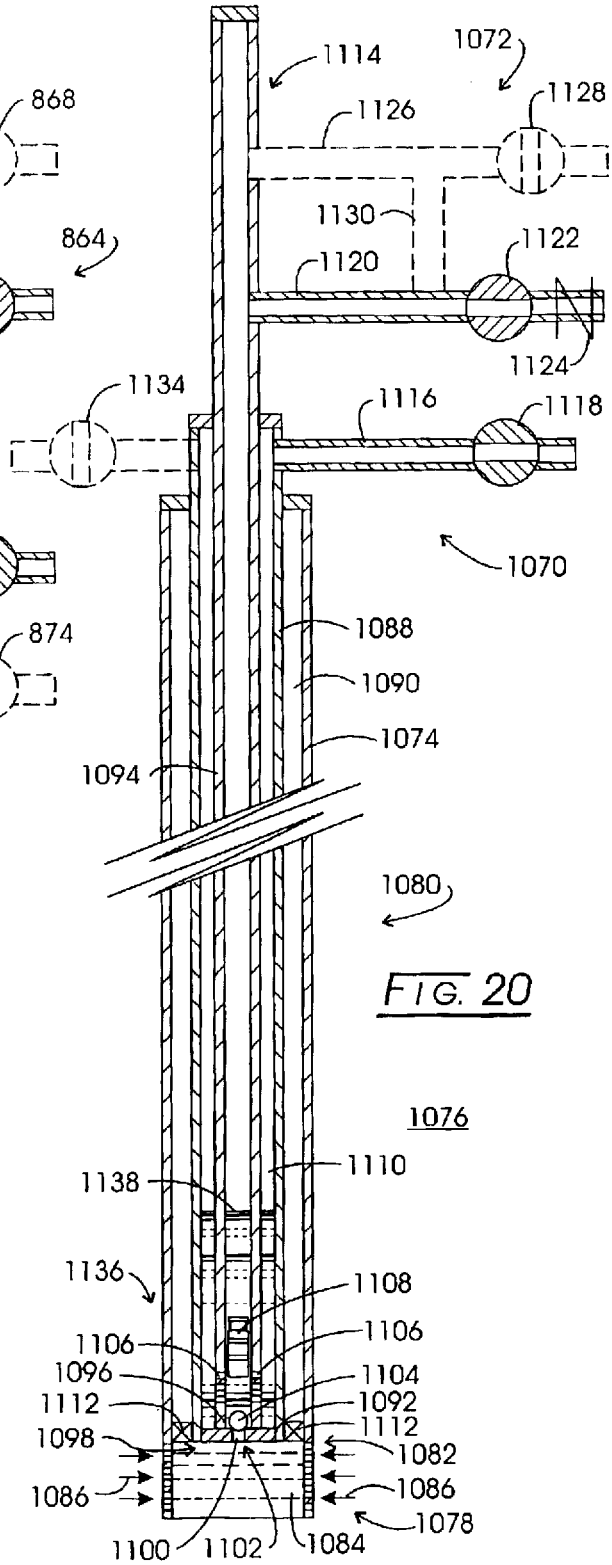
FIG. 20 is a schematic sectional representation of another well installation incorporating the method of the invention.

Referring to FIG. 20, a correction for such casing defect condition using a topology essentially identical to that shown in FIG. 16 is presented. This well installation is represented in general at 1070. Installation 1070 includes a wellhead represented generally at 1072 and a casing 1074 extending into a geologic zone represented generally at 1076 to a lower region represented generally at 1078. Some defect permitting the ingress of zone liquids will have occurred in an upper region of the casing 1074 as represented generally at 1080. However, within the lower region 1078, casing 1074 is formed with a perforation interval 1082 through which zone fluid 1084 will migrate as represented at arrow arrays 1086. Extending from the wellhead 1072 to the lower region 1078 is a tubing assembly 1088 which may be that tubing assembly originally provided with the well installation 1070. However, that tubing assembly 1088 now performs in the manner of a retro-fit casing positioned within casing 1074 and defining an outer casing annulus 1090. Outer tubing assembly 1088 extends to a lower opening 1092 within lower region 1078. Positioned within this outer tubing assembly 1088 is a plunger lift tubing assembly 1094. Tubing assembly 1094 may be formed with coiled tubing and is seen to extend to a tubing input 1096 within the lower region 1078 and in adjacency with lower opening 1092 of outer tubing assembly 1088. As in the embodiment of FIG. 16, a formation fluid receiving assembly represented generally at 1098 is configured to extend in sealing fashion within outer tubing assembly 1088 and against tubing input 1096. The assembly 1098 is configured with a fluid input opening 1100 which is associated with a check valve function represented generally at 1102 which is shown configured as a ball valve having a ball 1104. Plunger lift tubing assembly 1094 is perforated or provided with an injection input 1106 just above the check valve function 1102. A plunger 1108 is shown in its home or bottom position above the injection input 1106. With this arrangement, an inner tubing annulus 1110 is defined. Note, additionally, that the outer casing annulus 1090 is sealed. For example, with packing 1112 interposed between the casing 1074 and outer tubing assembly 1088 at a location above the perforation interval 1082 and below the location of the upwardly disposed casing 1074 defect. This isolates the perforation interval from accumulated fluids in the outer casing annulus 1090.

Now looking to the wellhead 1072, plunger lift tubing assembly 1094 is seen to extend to a lubricator region 1114. A casing line 1116 incorporating casing valve 1118 extends in fluid communication from inner tubing annulus 1110 or plunger lift tubing assembly 1094 to a collection facility. A tubing line 1120 incorporating a tubing valve 1122 and check valve 1124 is seen to extend from plunger lift tubing assembly 1094 to the collection facility. As before, downstream from casing valve 1118 and tubing valve 1122 and check valve 1124, the tubing line 1120 and casing line 1116 are associated at a common point, for example, as described earlier at common point header 66 in FIG. 1.

A vent line may optionally be provided with the installation 1070. In this regard, a vent line is shown at 1126 incorporating a vent valve 1128 extending in fluid flow communication between plunger lift tubing assembly 1094 and a collection facility. As before, a diverting line 1130 extends between tubing line 1120 and vent line 1126 inboard of valves 1122 and 1128.

Where the formation pressure is adequate, the well installation 1080 may be operated in the manner described in connection with installation 820 in FIG. 16. Optionally, the installation may perform in conjunction with injection gas. For this arrangement, an injection line 1132 incorporating an injection valve 1134 may extend between outer tubing assembly 1088 and a source of gas under pressure such as a compressor. With the above described arrangement, a chamber 1136 is defined with the formation of fluid receiving assembly 1098, plunger lift tubing assembly 1094 and outer tubing assembly 1088. As noted above, when casing valve 1118 and tubing valve 1122 are open in common during an afterflow interval the chamber 1136 is filled and a common upper liquid level 1138 is defined. Installation 1080 may be operated in with injection gas in the same manner as described in connection with installation 820.

Returning to the well installation embodiment of FIG. 1, the noted concentric configuration utilized to derive chamber 54 permits the retrofitting of the well installation in accordance with the invention without "killing" the well. In this regard, retrofitting wells conventionally calls for filling the well with a liquid to avoid pressure and blowout. These somewhat continuously injected liquids must be removed utilizing time consuming and expensive procedures subsequent to retrofitting to bring the subject well back into production. With the concentric chamber defining design, very little liquid is utilized, providing, for example, a hydrostatic pressure in the small diameter coil tubing 44.

Figure 21:
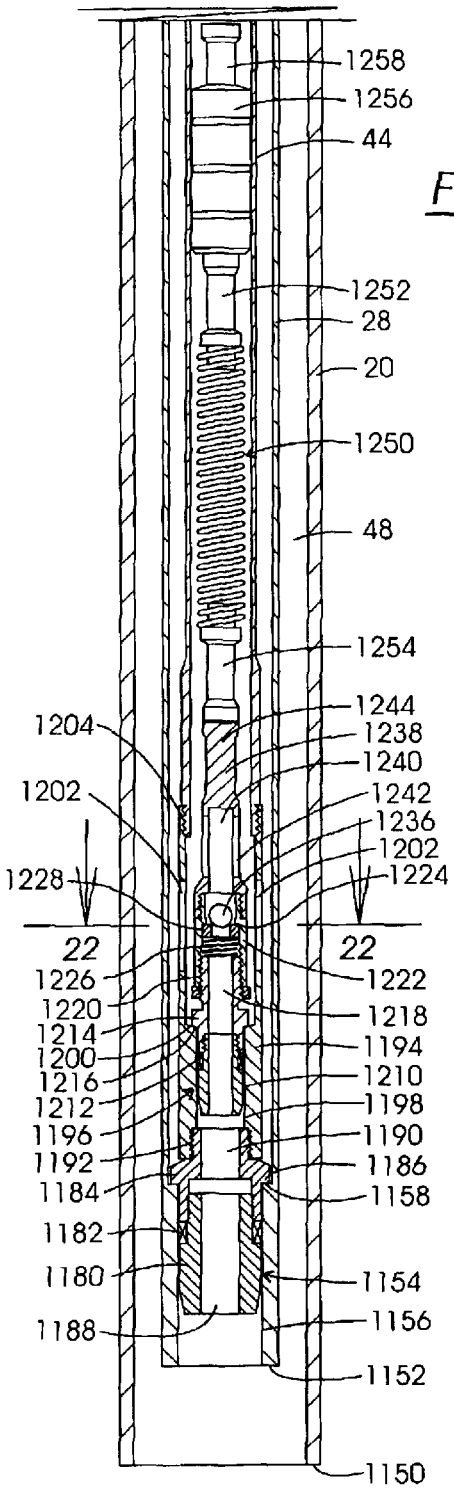
FIG. 21 is a partial sectional view of the lower region of the well installation of FIG. 1.
Figure 22:
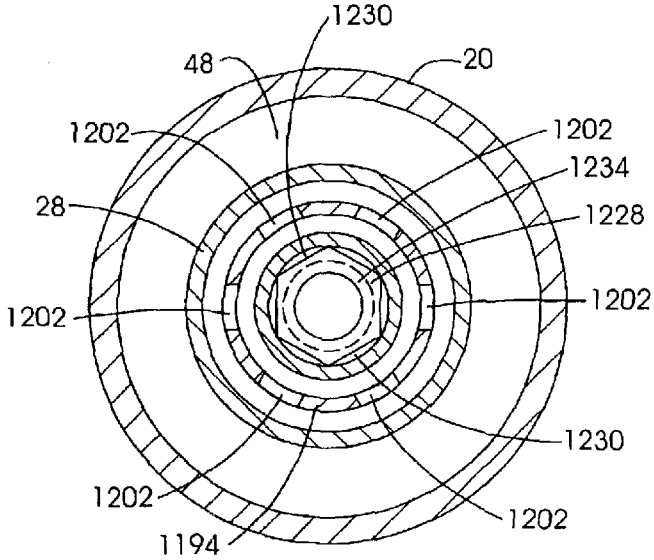
FIG. 22 is a sectional view taken through the plane 22—22 shown in FIG. 21.
Figure 23:
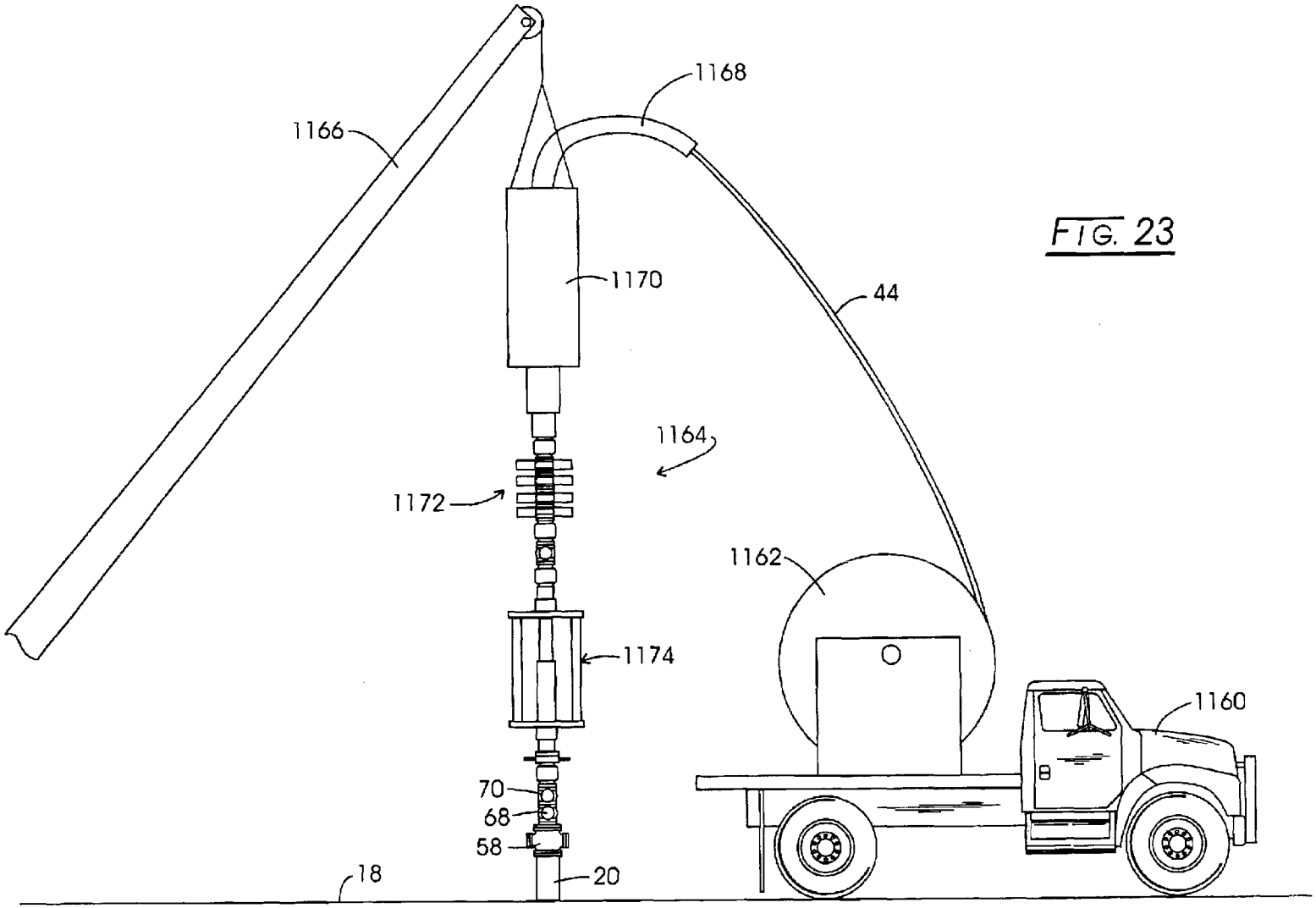
FIG. 23 is a pretorial representation of an installation of coil tubing within a well installation.

FIGS. 21–23 illustrate the structuring and technique for retrofitting a well installation, for example, similar to that shown at 10 in FIG. 1. Accordingly, certain of the components in FIG. 1 are identified with the same numeration. In FIGS. 21 and 22, casing 20 is seen extending to a bottom end 1150. Intermediate tubing 28 is seen to be spaced inwardly from casing 20 to define the earlier described primary annulus 48. This intermediate tubing 28 extends to an inlet end 1152 which is preconfigured with a seating nipple represented generally at 1154 which is comprised of a polished bore 1156 extending from an annular ledge 1158. Coiled tubing is introduced into the intermediate tubing 28 from the wellhead. Looking additionally to FIG. 23, the technique for carrying out this insertion is generally revealed. In the figure, a truck 1160 carrying a reel 1162 of coiled tubing is positioned adjacent the retro-fitted well installation. Coiled tubing 44 is fed from the reel 1062 through a snubber arrangement represented generally at 1164 which is supported, for example, from a crane 1166. In this regard, the tubing 44 is pulled from reel 1162 along a guide 1168 and into a tube straightener 1170. Below straightener 1170 are a plurality of blowout preventer components represented generally at 1172 through which the coiled tubing 44 passes, whereupon it is hydraulically engaged and driven into the well by snubber 1174. The end of the coil tubing 44 is structured to engage seating nipple 1154.

Returning to FIGS. 21 and 22, the tubing pre-configuration is revealed. This pre-configuration includes a lower or primary seal assembly 1180 about which is positioned a primary seal or gland 1182. Seal 1182 is retained in position by a mandrel 1184 which incorporates an outwardly extending integrally formed collar 1186 which engages annular ledge 1158 of intermediate tubing 28 seating nipple 1154. This abutting arrangement is referred to as a "no go" and prevents the tubing 44 from extending through the seating nipple 1154. Lower seal assembly 1180 and mandrel 1184 are seen to have centrally disposed and aligned passageways shown respectively at 1188 and 1190 extending through them. Mandrel 1184 is threadably engaged at 1192 with a receiver housing 1194. Housing 1194 is configured with a secondary seating nipple represented generally at 1196 comprised of a polished bore 1198 and an annular ledge 1200 functioning as a secondary "no go". The receiving housing then extends upwardly from the secondary seating nipple 1196, whereupon it is configured having elongate slot-shaped injection inlets 1202 which are seen additionally in FIG. 22. Those inlets are schematically depicted at 52 in FIGS. 3–8. Receiver housing 1194 extends upwardly to a threaded connection 1204 with coil tubing 44. Connection 1204 completes the sub-assembly which is lowered into the position shown. An F-profile nipple is run in conjunction with connection 1204. This F-profile nipple accepts an F-plug to isolate the coiled tubing from well pressure. Such F-plugs are configured with a seal and locking dogs which hold and seal the plug in place. Then, liquid can be injected into the coil tubing 44 and a double barrier against blowout pressure thus is provided. In general, the F-plug is inserted and or pulled from an auxiliary lubricator/catcher mounted upon a preexisting surface connection.

After the F-plug is in place and the double barrier is established, the wellhead installation may be carried to a further stage of completion, whereupon the F-plug is removed or retrieved and retrievable down hole components are inserted within tubing 44 and appropriately positioned. This down hole assembly will include a secondary seal assembly 1210 which supports an annular seal or secondary seal or gland 1212 which engages and seals against polished bore 1198 of secondary seating nipple 1196. Assembly 1210 is threadably engaged with a secondary mandrel 1214 which retains secondary seal 1212 in position and is structured having an integrally formed collar 1216 which abuttably engages the annular ledge 1200 of secondary seating nipple 1196 to provide a secondary "no go" interconnection. Secondary mandrel 1214 incorporates a centrally disposed passageway 1218 and extends upwardly with external threads 1220 which threadably engage a vertically threadably adjustable ball valve housing 1222. Housing 1222 extends to define an integrally formed inwardly depending ball valve seat retainer 1244. Interposed between the retainer 1224 and secondary mandrel 1214 is a compression coil pressure relief spring 1226 and an upwardly disposed abuttably engaged ball seat 1228. Ball seat 1228 is seen in FIG. 22 to be formed of hexagonal stock so as to define fluid passageways as at 1230 which are opened by the compression spring 1226 at such time as the coil tubing 44 may carry an excessive fluid head. As is apparent, adjusting the position of the threaded connection of ball valve housing 1222 will, in turn, adjust the pressure asserted by pressure relief spring 1226. Positioned over the annular opening 1234 of the ball seat 1228 (FIG. 22) is a ball 1236. Ball 1236 is captured by a ball valve cavity housing 1238 which, in turn, is threadably engaged with the external threads 1220 of ball valve housing 1222. A passageway 1240 above ball 1236 incorporates openings as at 1242 to provide fluid communication to the ball valve from the interior of coil tubing 44. Cavity housing 1238 is seen to incorporate an upwardly depending fishing neck 1244 to permit its wire line tool retrieval in conjunction with the above-discussed threadably attached components. Next inserted within the tubing 44 is a bumper spring assembly represented generally at 1250 functioning to cushion a plunger upon reaching a home or bottom position. Assembly 1250 is configured with oppositely disposed fishing necks 1252 and 1254. A plunger is shown at 1256 also having a fishing neck 1258.

Upon insertion of plunger 1256 within the coil tubing 44, the wellhead is fully assembled and the well is cycled to remove barrier fluid within coil tubing 44.

Returning to the pressure release spring 1226, in the event of the occurrence of certain circumstances which would cause the coil tubing 44 to fill with an excessive amount of liquid or slug such that available pressures will not be able to evacuate such a large slug, then the pressure relief feature of spring 1226 comes into play. Such overloading of the tubing may occur, for example, where the well is shut in for an interval due to collection facility problems, for example, a loss of a compressor or extended high sales line pressure. While such a hydrostatic fluid load is pushing down against the ball valve or check valve assembly, the casing derived pressures including the pressure of spring 1226 are pushing upwardly. Where a differential in pressure exists between the upper hydrostatic load and the pressure within annulus 48 as combined with the compression force of spring 1226, then valve seat 1228 will be pushed downwardly to permit bleeding off of slug fluid within tubing 44 until pressure equilibrium is reached with the casing. Such fluid release is through the earlier described fluid passageways 1230 (FIG. 22) around the seat 1228. The result will be a slug of lessened height which is manageable for the pressures available to the system. In effect, this valving arrangement permits a check valve function in combination with a pressure relief function.

Since certain changes may be made in the above-described method without departing from the scope of the invention herein involved, it is intended that all matter contained in the description thereof or shown in the accompanying drawings shall be interpreted as illustrative and not in a limiting sense.

What is claimed is:

1. The method for operating a well installation having a casing extending within a geologic formation from a wellhead to a bottom region exhibiting a given liquid fluid induced down hole pressure, said casing having a perforation interval extending to an end location at a given depth, said installation including a collection facility and a source of gas under pressure having an injection output, comprising the steps of:

(a) providing a tubing assembly within said casing including a plunger lift tube having a tube outlet at said wellhead and extending to a tubing input located in adjacency with or below said perforation interval end location communicable in fluid passage relationship with formation fluids and having an injection input;

(b) providing an injection passage adjacent said plunger lift tube extending from said injection output at least to said plunger lift tube injection input, said injection passage defining with said casing, a casing passageway extending to said wellhead;

(c) providing a plunger within said plunger lift tube movable between a bottom position located above said injection input and said wellhead;

(d) providing a formation fluid receiving assembly defining a chamber with said injection passage in fluid communication with said tubing assembly, said chamber having a lower disposed check valve assembly with an open orientation admitting formation fluid within said chamber and responsive to injection fluid pressure to define a U-tube function with said injection passage and said tubing assembly;

(e) providing a tubing valve between said tube outlet and said collection facility actuable between an open orientation permitting the flow of fluid to said collection facility and a closed orientation blocking said tube outlet;

(f) providing an injection control assembly actuable between an open condition effecting application of gas under pressure from said pressurized gas output to said injection gas input and a closed condition;

(g) providing a detector at said wellhead having a detector output in response to the arrival of said plunger at said wellhead;

(h) accumulating formation liquid fluid into said chamber by passage thereof through said check valve assembly under equalizing pressure between said chamber and said casing passage;

(i) moving liquid fluid from said chamber into said tubing assembly above said plunger;

(j) actuating said injection control assembly to said open condition to apply gas under pressure to said defined U-tube from said injection input, to impart upward movement to said plunger;

(k) actuating said tubing valve to said open orientation;

(l) actuating said injection control assembly to said closed condition in response to said detector output;

(m) then, actuating said tubing valve into said closed orientation for an off-time interval at least sufficient for the movement of said plunger from said wellhead to said bottom position; and (n) providing a casing gas fluid flow communication path between said casing passageway and said collection facility and producing gas fluid to said collection facility from said casing passageway.

2. The method of claim 1 in which:

said step (n) provides gas fluid continuously throughout steps (h) through (m).

3. The method of claim 1 further comprising the step of:

(o) providing an equalizing valve in gas flow communication between said defined chamber and said casing passageway and actuable between open and closed orientations; and said step (h) is carried out by actuating said equalizing valve into said open orientation in response to said detector output.

4. The method of claim 3 in which:

said step of actuating said equalizing valve into said open orientation is carried out following an equalizing delay interval commencing with the initiation of said detector output.

5. The method of claim 3 in which:

said step (o) provides said equalizing valve in gas flow communication with said collection facility when in said open orientation.

6. The method of claim 5 in which:

said step (h) of actuating said equalizing valve into said open orientation retains said open orientation for an equalizing production interval continuing after said step of actuating said tubing valve into said closed orientation for said off-time interval, whereupon said equalizing valve is actuated into said closed orientation.

7. The method of claim 5 further comprising the steps of:

(ar) determining a maximum interval commencing upon the generation of said detector output and extending in time to the termination of said tubing valve off-time interval;

(as) actuating said equalizing valve into said open orientation in the presence of an occurrence of said detector output and subsequently into said closed orientation at said termination of said tubing valve off-time interval; and (at) retaining said equalizing valve in said open orientation during said maximum interval until the commencement of said off-time interval to define an open flow interval.

8. The method of claim 1 further comprising the steps of:

(p) providing a casing valve within said casing gas fluid flow communication path actuable between an open orientation providing gas fluid flow communication between said casing and said collection facility and a closed orientation blocking said casing gas flow communication path; and (q) actuating said casing valve into said open orientation in the presence of the occurrence of said detector output.

9. The method of claim 8 in which:

said step (p) of actuating said casing valve into said open orientation is carried out following a casing delay interval commencing with the initiation of said detector output.

10. The method of claim 8 in which:

said step (q) of actuating said casing valve into said open orientation for a casing production interval continues after said step of actuating said tubing valve into said closed orientation, whereupon said casing valve is actuated into said closed orientation.

11. The method of claim 1 further comprising the steps of:

(r) providing a low pressure collection facility;

(s) providing a vent fluid communication path between said low pressure collection facility and said plunger lift tube;

(t) providing a vent valve within said vent fluid communication path actuable between an open orientation diverting fluid flow from said tubing valve to said collection facility and providing it along said vent fluid communication path and a closed orientation blocking said fluid flow communication along said vent fluid communication path: and (u) actuating said vent valve into said open orientation in the presence of said actuation of said tubing valve into said open orientation.

12. The method of claim 11 in which:

said step (u) of actuating said vent valve into said open orientation is carried out following a vent delay interval commencing with the initiation of said actuation of said tubing valve into said open orientation.

13. The method of claim 12 further comprising the steps of (v) determining an on-time interval with respect to said plunger lift tube;

(w) determining time related data corresponding with fast and slow movement of said plunger from said bottom position to said wellhead;

(x) determining a plunger arrival interval with respect to said actuation of said tubing valve into said open orientation and subsequently occurring said detector output;

(y) evaluating said plunger arrival interval with respect to said time related data; and (z) altering the extent of said vent delay interval in correspondence with an evaluation determining fast or slow movement of said plunger.

14. The method of claim 1 in which said step (i) is carried out by:

(i1) actuating said injection control assembly to said open condition in the presence of said tubing valve closed condition for a pre-charge interval;

(i2) then actuating said tubing valve into said open orientation for a purge interval; and (i3) then actuating said tubing valve into said closed orientation for a purge settlement interval effective to permit movement of said plunger toward said bottom position.

15. The method of claim 14 further comprising the steps of:

determining an on-time interval with respect to said plunger lift tube;

determining time related data corresponding with fast and slow movement of said plunger from said bottom position to said wellhead;

determining a plunger arrival interval with respect to said actuation of said tubing valve into said open orientation and subsequently occurring said detector output;

evaluating said plunger arrival interval with respect to said time related data; and altering the extent of said pre-charge interval in correspondence with an evaluation determining fast or slow movement of said plunger.

16. The method of claim 14 wherein:

said step (b) provides said injection path in a manner defining said casing passageway as a casing annulus extending to said wellhead.

17. The method of claim 14 further comprising the step of:

(o) providing an equalizing valve in gas flow communication between said defined chamber and said casing annulus and actuable between open and closed orientations; and said step (h) is carried out by actuating said equalizing valve into said open orientation in response to said detector output.

18. The method of claim 17 in which:

said step (o) provides said equalizing valve in gas flow communication with said collection facility when in said open orientation.

19. The method of claim 18 in which:

said step (h) of actuating said equalizing valve into said open orientation retains said open orientation for an equalizing production interval continuing after said step of actuating said tubing valve into said closed orientation for said interval off-time, whereupon said equalizing valve is actuated into said closed orientation.

20. The method of claim 17 in which:

said step (h) of actuating said equalizing valve into said open orientation is carried out following an equalizing delay interval commencing with the initiation of said detector output.

21. The method of claim 1 further comprising the steps of:

(aa) determining an on-time interval with respect to said plunger lift tube;

(ab) determining an interval commencing upon the occurrence of said detector output;

(ac) determining time related data corresponding with fast and slow movement of said plunger from said bottom position to said wellhead;

(ad) determining a plunger arrival interval with respect to said actuation of said tubing valve into said open orientation and a subsequently occurring said detector output;

(ae) evaluating said plunger arrival interval with respect to said time related data; and (af) altering the extent of said interval in correspondence with an evaluation determining fast or slow movement of said plunger.

22. The method of claim 21 in which:

said off-time interval occurs within said afterflow interval;

said step (af) of altering the extent of said interval is carried out by adjusting the extent of said off-time interval.

23. The method of claim 1 further comprising the steps of:

(ag) determining an on-time interval with respect to said plunger lift tube;

(ah) determining a boost delay interval commencing with said actuation of said tubing valve into said open orientation;

said step (j) actuation of said injection control assembly into said open orientation being carried out at the termination of said boost delay interval;

(ai) determining time related data corresponding with fast and slow movement of said plunger from said bottom position to said wellhead;

(aj) determining a plunger arrival interval with respect to said actuation of said tubing valve into said open orientation and a subsequently occurring said detector output;

(ak) evaluating said plunger arrival interval with respect to said time related data; and (al) altering the extent of said boost delay interval in correspondence with an evaluation determining fast or slow movement of said plunger.

24. The method of claim 1 further comprising the steps of:

(am) determining an on-time interval with respect to said plunger lift tube;

(an) determining time related data corresponding with fast and slow movement of said plunger from said bottom position to said wellhead;

(ao) determining a plunger arrival interval with respect to said actuation of said tubing valve into said open orientation and a subsequently occurring said detector output;

(ap) evaluating said plunger arrival interval with respect to said time related data; and (aq) altering the extent of said off-time interval in correspondence with an evaluation determining fast or slow movement of said plunger.

25. The method of claim 1 in which:

said step (b) of providing an injection passage provides an intermediate tubing extending within said casing from said wellhead at least to a location adjacent said plunger lift tube injection input and spaced inwardly from said casing to provide a said casing passageway as a casing annulus passage as at least a portion of said casing gas fluid flow communication path; and said intermediate tubing being spaced from said plunger lift tube to define an injection annulus providing said injection passage.

26. The method of claim 1 further comprising the steps of:

(av) providing a casing valve within said casing gas fluid flow communication path actuable between an open orientation providing gas fluid flow communication between said casing and said collection facility and a closed orientation blocking said casing gas flow communication path;

(aw) determining a maximum afterflow interval commencing upon the generation of said detector output and extending in time to the termination of said tubing valve off-time interval;

(ax) actuating said casing valve into said open orientation in the presence of an occurrence of said detector output and subsequently into said closed orientation at said termination of said tubing valve off-time interval; and (ay) retaining said casing valve in said open orientation during said maximum interval until the said termination of said off-time interval to define an open flow interval.

27. The method of claim 1 further comprising the steps of:

(ba) assigning an on-time interval with respect to said plunger lift tube;

(bb) determining time related data corresponding with good or a range of good, a range of fast and a range of slow rates of movement of said plunger from said bottom position to said wellhead;

(bc) assigning time increment adjustments for at least one well control parameter affecting the rate of movement of said plunger;

(bd) determining a plunger arrival interval with respect to said actuation of said tubing valve into said open orientation and a subsequently occurring said detector output;

(be) evaluating said plunger arrival interval with respect to said time related data; and (bf) altering the extent of a said well control parameter by a said time increment adjustment in correspondence with an evaluation determining fast or slow movement of said plunger.

28. The method of claim 27 in which said step (bf) further adjusts the value of said time increment adjustment in proportion to its proximity to said good or a range of good rate or rates of movement.

29. The method of operating a well installation having a wellhead in fluid transfer relationship with a collection facility and with a well casing extending within a geologic formation and having a perforation interval effectively extending a given depth to an interval depth location exhibiting a given liquid fluid induced down hole pressure, and having a source of gas under pressure with a pressurized gas output, comprising the steps of:

(a) providing an injection passage within said casing, having an injection input coupled with said pressurized gas output extending to an injection outlet and defining a casing production region with said casing;

(b) providing a plunger lift tube at least partially within said injection passage extending from an outlet at said wellhead to a tubing input, said plunger lift tube being communicable in fluid passage relationship with said injection outlet at an injection location;

(c) providing a plunger within said plunger lift tube movable between a bottom position located above said injection location and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) collecting formation liquid fluid into said plunger lift tube above said plunger bottom position;

(f) communicating said plunger lift tube outlet in fluid transfer relationship with said surface collection facility;

(g) applying injection gas under pressure from said pressurized gas output to said injection input for an injection interval effective to move a quantity of said formation liquid by said plunger to said wellhead through said outlet and into said surface collection facility so as to substantially reduce said down hole pressure; and (h) communicating said casing production region in gas fluid transfer relationship with said surface collection facility.

30. The method of claim 29 in which said step (d) providing a formation fluid receiving assembly locates said check valve in adjacency with or below said interval depth location.

31. The method of claim 29 further comprising the step of:

(i) providing an equalizing valve assembly actuable between an open orientation connecting said chamber with said casing production region in gas transfer relationship and a closed orientation; and said step (e) comprises the step (e1) of actuating said equalizing valve into said open orientation to effect collection of formation fluid within said chamber.

32. The method of claim 31 further comprising the step of:

(j) actuating said equalizing valve into said closed orientation during said step (g) of applying gas under pressure from said pressurized gas output to said injection input.

33. The method of claim 31 in which:

said step (e1) comprises the step (e2) of actuating said equalizing valve into said open orientation, when said plunger is at said wellhead, for an interval following said step of applying injection gas under pressure from said compressed gas output to said injection input.

34. The method of claim 31 in which:

said step (i) provides said equalizing valve in gas flow communication with said collection facility when in said open orientation.

35. The method of claim 33 further comprising the step of:

determining an optimum interval of time corresponding with a movement of said plunger from said bottom location to said wellhead at an optimum speed; and adjusting the extent of said interval to cause the extent of said injection interval to approach said optimum interval.

36. The method of claim 31 in which:

said step (g) terminates said application of injection gas upon the arrival of said plunger at said wellhead;

said step (e) communicates said plunger lift outlet with said surface collection facility for an interval in response to said arrival of said plunger at said wellhead, and terminates said communication during said interval to define a tubing off-time;

said step (e) comprises the steps of:

(e3) applying injection gas under pressure from said pressurized gas output for a pre-charge interval during said tubing off-time;

(e4) then communicating said plunger lift tube outlet with said surface collection facility for a purge interval;

(e5) then terminating said communicating of said plunger lift tube outlet with said surface collection facility for a purge off interval.

37. The method of claim 29 in which:

said step (a) of providing an injection passage provides said passage in fluid pressure isolation from said casing.

38. The method of claim 29 in which:

said step (a) provides said injection passage as comprising an intermediate tube spaced outwardly from said plunger lift tube to define said injection passage and spaced inwardly from said casing to define said casing production region.

39. The method of claim 38 in which:

said step (d) of providing a formation fluid receiving assembly provides said check value as a standing ball valve.

40. The method of claim 38 in which said step (d) further defines said chamber by packing located between said intermediate tube and said check valve.

41. The method of claim 29 comprising the steps of:

(i) assigning an on-time interval with respect to said plunger lift tube;

(j) determining time related data corresponding with good or a range of good, a range of fast and a range of slow rates of movement of said plunger from said bottom position to said wellhead;

(k) assigning time increment adjustments for at least one well control parameter affecting the rate of movement of said plunger;

(l) determining a plunger arrival interval with respect to said interval effective to move said plunger to said wellhead;

(m) evaluating said plunger arrival interval with respect to said time related data; and (n) altering the extent of said well control parameter by a said time increment adjustment in correspondence with an evaluation determining fast or slow movement of said plunger.

42. The method of claim 41 in which said step (n) further adjusts the value of said time increment adjustment in proportion to its proximity to said good or a range of good rate or rates of movement.

43. The method for operating a well installation having a casing extending within a geologic formation from a wellhead to a bottom region exhibiting a given liquid fluid induced down hole pressure, said installation including a collection facility, and having a source of gas under pressure with a pressurized gas output, comprising the steps of:

(a) providing a tubing assembly within said casing having a plunger lift tube with a tube outlet at said wellhead, extending to a tubing input located to receive formation fluid;

(b) providing an injection passage extending from an injection gas input at said wellhead to an injection outlet;

(c) providing a plunger within said plunger lift tube movable between a bottom position and said wellhead;

(d) providing a formation fluid receiving assembly defining a chamber with said injection passage in fluid communication with said plunger lift tube tubing input and said injection outlet, said chamber having a check valve with an open orientation admitting formation fluid within said chamber and responsive to fluid pressure to define a U-tube function with said injection passage and said plunger lift tube;

(e) providing a detector at said wellhead having a detector output in response to the arrival of said plunger at said wellhead;

(f) providing a tubing valve between said tube outlet and said collection facility actuable between an open orientation permitting the flow of fluid to said collection facility and a closed orientation blocking said tube outlet;

(g) providing an injection valve between said pressurized gas outlet and said injection gas input actuable between an open orientation effecting application of gas under pressure to said injection outlet and a closed orientation;

(h) providing an equalizing valve in gas flow communication between said injection gas input and said collection facility, actuable between an open orientation providing said flow communication and a closed orientation blocking said communication;

(i) accumulating formation liquid fluid into said chamber through said check valve when said equalizing valve is in said open orientation, said injection valve is in said closed orientation and said check valve is in said open orientation;

(j) actuating said equalizing valve into said closed orientation;

(k) moving formation fluid accumulated within said chamber into said plunger lift tube above said plunger;

(l) actuating said injection valve into said open orientation;

(m) actuating said tubing valve into said open orientation to effect movement of said liquid fluid by said plunger toward said wellhead; and (n) reiterating said steps (i) through (m) at a rate effective to remove an amount of said liquid fluid so as to reduce said down hole pressure.

44. The method of claim 43 further comprising the step of:

(o) providing a casing gas flow communication path between said casing and said collection facility.

45. The method of claim 44 in which:

said step (b) of providing an injection passage provides an intermediate tube extending within said casing from said wellhead spaced inwardly from said casing to provide a casing annulus passage as at least a portion of said casing gas flow communication path; and said intermediate tube being spaced from said plunger lift tube to define an injection annulus providing said injection passage.

46. The method of claim 43 in which said step (k) of moving formation fluid comprises the steps of:

(k1) actuating said injection valve to said open orientation for a pre-charge interval in the presence of said tubing valve closed orientation, and said equalizing valve closed orientation;

(k2) then actuating said tubing valve into said open orientation for a purge interval; and (k3) then actuating said tubing valve into said closed orientation for a purge settlement interval effective to permit movement of said plunger toward said bottom position.

47. The method of claim 46 further comprising the steps of:

(o) determining an on-time interval with respect to said plunger lift tube;

(p) determining time related data corresponding with fast and slow movement of said plunger from said bottom position to said wellhead;

(q) determining a plunger arrival interval with respect to said actuation of said tubing valve into said open orientation and subsequently occurring said detector output;

(r) evaluating said plunger arrival interval with respect to said time related data; and (s) altering the extent of said pre-charge interval in correspondence with an evaluation determining fast or slow movement of said plunger.

48. The method of claim 46 further comprising the steps of:

(ba) determining an on-time interval with respect to said plunger lift tube;

(bb) determining time related data corresponding with fast and slow movement of said plunger from said bottom position to said wellhead;

(bc) determining a plunger arrival interval with respect to said actuation of said tubing valve into said open orientation and a subsequently occurring said detector output;

(bd) evaluating said plunger arrival interval with respect to said time related data; and (be) altering the extent of said pre-charge interval in correspondence with an evaluation determining fast or slow movement of said plunger.

49. The method of claim 43 further comprising the steps of:

(t) actuating said injection valve to said closed orientation in response to said detector output;

(u) actuating said equalizing valve into said open orientation in the presence of an occurrence of said detector output; and (v) actuating said tubing valve into said closed orientation in the presence of an occurrence of said detector output for an off-time interval at least sufficient for the movement of said plunger to said bottom position.

50. The method of claim 49 in which:

said step (u) of actuating said equalizing valve into said open orientation in the presence of an occurrence of said detector output is carried out following an equalizing delay interval commencing with the initiation of said detector output.

51. The method of claim 49 in which:

said step (u) of actuating said equalizing valve into said open orientation in the presence of an occurrence of said detector output retains said open orientation for an equalizing production interval continuing after said step (v) of actuating said tubing valve into said closed orientation for said off-time interval, whereupon said equalizing valve is actuated into said closed orientation.

52. The method of claim 49 further comprising the steps of:

(aa) determining an on-time interval with respect to said plunger lift tube;

(ab) determining time related data corresponding with fast and slow movement of said plunger from said bottom position to said wellhead;

(ac) determining a plunger arrival interval with respect to said actuation of said tubing valve into said open orientation and a subsequently occurring said detector output:

(ad) evaluating said plunger arrival interval with respect to said time related data; and (ae) altering the extent of said off-time interval in correspondence with an evaluation determining fast or slow movement of said plunger.

53. The method of claim 49 further comprising the steps of:

(af) determining a maximum afterflow interval commencing upon the generation of said detector output and extending in time to the termination of said tubing valve off-time interval;

(ag) actuating said equalizing valve into said open orientation in the presence of an occurrence of said detector output and subsequently into said closed orientation at said termination of said tubing valve off-time interval; and (ah) retaining said tubing valve in said open orientation during said maximum afterflow interval until the commencement of said off-time interval to define an open flow interval.

54. The method of claim 53 which:

said step (ag) of actuating said equalizing valve into said open orientation in the presence of an occurrence of said detector output is carried out following an equalizing delay interval commencing with the initiation of said detector output.

55. The method of claim 53 further comprising the step of:

(al) determining a minimum time extent of said interval corresponding with a said tubing valve off-time interval sufficient for the movement of said plunger from said wellhead to said bottom position.

56. The method of claim 55 further comprising the steps of:

(am) determining an on-time interval with respect to said plunger lift tube;

(an) determining time related data corresponding with fast and slow movement of said plunger, from said bottom position to said wellhead;

(ao) determining a plunger arrival interval with respect to said actuation of said tubing valve into said open orientation and a subsequently occurring said detector output;

(ap) evaluating said plunger arrival interval with respect to said time related data; and (aq) altering the extent of said tubing valve open flow interval in correspondence with an evaluation determining fast or slow movement of said plunger.

57. The method of claim 49 further comprising the steps of:

(w) providing a casing gas flow communication path between said casing and said collection facility;

(ai) providing a casing valve within said casing gas flow communication path actuable between an open orientation providing gas flow communication between said casing and said collection facility and a closed orientation blocking said casing gas flow communication path;

(aj) providing an afterflow interval commencing upon the generation of said detector output and extending in time to the termination of said tubing valve off-time interval;

(ak) actuating said casing valve into said open orientation in the presence of an occurrence of said detector output and subsequently into said closed orientation at said termination of said tubing valve off-time interval; and (al) retaining said tubing valve in said open orientation during said maximum afterflow interval until the commencement of said off-time interval to define an open flow interval.

58. The method of claim 57 further comprising the steps of:

(am) determining an on-time interval with respect to said plunger lift tube;

(an) determining time related data corresponding with fast and slow movement of said plunger from said bottom position to said wellhead;

(ao) determining a plunger arrival interval with respect to said actuation of said tubing valve into said open orientation and a subsequently occurring said detector output;

(ap) evaluating said plunger arrival interval with respect to said time related data; and (aq) altering the extent of said open flow interval during said afterflow interval in correspondence with an evaluation determining fast or slow movement of said plunger.

59. The method of claim 57 in which:

said step (ak) of actuating said casing valve into said open orientation in the presence of an occurrence of said detector output is carried out following a casing delay interval commencing with the initiation of said detector output.

60. The method of claim 49 further comprising the steps of:

(bf) providing a low pressure collection facility;

(bg) providing a vent fluid communication path between said low pressure collection facility and said plunger lift tube;

(bh) providing a vent valve within said vent fluid communication path actuable between an open orientation diverting fluid flow communication with said collection facility and providing it along said vent fluid communication path and a closed orientation blocking said fluid flow communication along said vent fluid communication path: and (bi) actuating said vent valve into said open orientation in the presence of said actuation of said tubing valve in said open orientation.

61. The method of claim 60 in which:

said step (bi) of actuating said vent valve into said open orientation is carried out following a vent delay interval commencing with the initiation of said actuation of said tubing valve into said open orientation.

62. The method of claim 60 further comprising the steps of:

(bj) determining an on-time interval with respect to said plunger lift tube;

(bk) determining time related data corresponding with fast and slow movement of said plunger from said bottom position to said wellhead;

(bl) determining a plunger arrival interval with respect to said actuation of said tubing valve into said open orientation and subsequently occurring said detector output;

(bm) evaluating said plunger arrival interval with respect to said time related data; and (bn) altering the extent of said vent delay interval in correspondence with an evaluation determining fast or slow movement of said plunger.

63. The method of claim 49 further comprising the steps of:

(bo) determining an on-time interval with respect to said plunger lift tube;

(bp) providing an afterflow interval commencing upon the generation of said detector output;

(bq) determining time related data corresponding with fast and slow movement of said plunger from said bottom position to said wellhead;

(br) determining a plunger arrival interval with respect to said actuation of said tubing valve into said open orientation and a subsequently occurring said detector output;

(bs) evaluating said plunger arrival interval with respect to said time related data; and (bt) altering the extent of said afterflow interval in correspondence with an evaluation determining fast or slow movement of said plunger.

64. The method of claim 49 further comprising the steps of:

(bu) determining an on-time interval with respect to said plunger lift tube;

(by) determining time related data corresponding with fast and slow movement of said plunger from said bottom position to said wellhead;

(bw) determining a plunger arrival interval with respect to said actuation of said tubing valve into said open orientation and subsequently occurring said detector output;

(bx) evaluating said plunger arrival interval with respect to said time related data; and (by) altering the extent of said pre-charge interval in correspondence with an evaluation determining fast or slow movement of said plunger.

65. The method of claim 43 further comprising the steps of:

(ar) determining an on-time interval with respect to said plunger lift tube;

(as) determining a boost delay interval commencing with said actuation of said tubing valve into said open orientation;

(at) said actuation of said injection valve being carried out at the termination of said boost delay interval;

(au) determining time related data corresponding with fast and slow movement of said plunger from said bottom position to said wellhead;

(av) determining a plunger arrival interval with respect to said actuation of said tubing valve into said open orientation and a subsequently occurring said detector output;

(aw) evaluating said plunger arrival interval with respect to said time related data; and (ax) altering the extent of said boost delay interval in correspondence with an evaluation determining fast or slow movement of said plunger.

66. The method of claim 43 further comprising the steps of:

(ca) assigning an on-time interval with respect to said plunger lift tube;

(cb) determining time related data corresponding with good or a range of good, a range of fast and a range of slow rates of movement of said plunger from said bottom position to said wellhead;

(cc) assigning time increment adjustments for at least one well control parameter affecting the rate of movement of said plunger;

(cd) determining a plunger arrival interval with respect to said actuation of said tubing valve into said open orientation and a subsequently occurring said detector output;

(ce) evaluating said plunger arrival interval with respect to said time related data; and (cf) altering the extent of a said well control parameter by a said time increment adjustment in correspondence with an evaluation determining fast or slow movement of said plunger.

67. The method of claim 66 in which said step (cf) further adjusts the value of said time increment adjustment in proportion to its proximity to said good or a range of good rate or rates of movement.

68. The method of operating a well installation having a wellhead in fluid transfer relationship with a collection facility, having a well casing extending from said wellhead within a geologic formation to a lower region, having a tubing assembly extending within said casing from said wellhead to a fluid input at said lower region, the space between said tubing assembly and said casing defining an annulus, said method comprising the steps of:

(a) blocking fluid flow within said annulus with an annulus seal;

(b) providing an entrance valve assembly positioned to control fluid flow into said tubing assembly;

(c) providing fluid communication between said annulus and said tubing assembly at a communication entrance within said lower region above said entrance valve assembly and said annulus seal;

(d) providing a plunger within said tubing assembly movable between said wellhead and a bottom location above said communication entrance;

(e) providing a tubing valve in fluid flow communication between said tubing assembly at said wellhead and said collection facility, actuable between open and closed orientations;

(f) accumulating formation fluid through said entrance valve assembly into said tubing assembly and said annulus above said annulus seal;

(g) pressurizing said annulus above said seal for a pre-charge interval;

(h) actuating said tubing valve into said open orientation for a purge interval effective to transfer fluid accumulated in said annulus through said communication entrance into said tubing assembly;

(i) actuating said tubing valve into said closed orientation;

(j) pressurizing said annulus;

(k) actuating said tubing valve into said open orientation to commence an on-time driving said plunger toward said wellhead at a plunger speed;

(l) directing fluid above said plunger into said collection facility;

(m) detecting the arrival of said plunger at said wellhead;

(n) communicating said annulus in fluid flow relationship with said collection facility for an afterflow interval in response to said detected arrival of said plunger at said wellhead;

(o) actuating said tubing valve into said closed orientation for an off-time interval permitting said plunger to move toward said bottom location; and (p) reiterating said steps (f) through (o) to define a sequence of well production cycles.

69. The method of claim 68 in which:

said step (i) maintains said tubing valve in said closed orientation for a post purge interval effective to permit positioning of said plunger at said bottom location.

70. The method of claim 68 in which:

said step (n) is carried out following a casing delay interval commencing with said step (m) detecting the arrival of said plunger at said wellhead.

71. The method of claim 68 in which:

said steps (j) and (g) are carried out by injecting gas into said annulus from a source of gas under pressure.

72. The method of claim 68 further comprising the step of:

(q) determining a minimum effective off-time corresponding with the time interval required for said plunger to travel from said wellhead to said bottom location; and said step (o) is carried out at the termination of said afterflow interval when said on-time during said afterflow interval terminates earlier than a commencement of said minimum off-time.

73. The method of claim 68 further comprising the step of:

(q) determining a minimum off-time corresponding with the time interval required for said plunger to travel from said wellhead to said bottom location; and said step (o) is carried out at a time prior to the termination of said afterflow interval corresponding with said minimum off-time when said on-time during said afterflow interval terminates substantially at the commencement of said minimum off-time.

74. The method of claim 73 in which:

said step (o) retains said tubing valve in said closed orientation for an interval coinciding with said step (g) pre-charge interval.

75. The method of claim 68 further comprising the step of:

(r) determining an optimum said plunger speed;

said step (m) includes the step:

(m1) determining the cycle speed at which said plunger traveled from said bottom location to said wellhead; and said step (j) is carried out for an interval of said pressurization adjusting the cycle speed of said plunger toward said optimum plunger speed during a succeeding said well production cycle.

76. The method of claim 68 in which:

said step (b) provides said entrance valve assembly as a check valve having a closed orientation in the presence of said pressurization of said annulus and an open orientation in the absence of said pressurization.

77. The method of claim 76 in which:

said check valve is implemented as a ball valve.

78. The method of claim 76 in which:

said step (a) annulus seal is present as well packing interposed between said casing and said tubing assembly adjust said tubing assembly input.

79. The method of claim 68 in which:

said casing is configured with a perforation interval in fluid flow communication with said formation; and said tubing assembly input is located above said perforation interval.

80. The method of claim 68 further comprising the step of:

(s) providing a casing valve in fluid flow communication between said annulus at said wellhead and said collection facility and actuable between open and closed orientations; and said step (f) is carried out by actuating said casing valve and said tubing valve into said open orientation during at least a portion of said afterflow interval.

81. The method of claim 68 further comprising the step of:

(s) providing a casing valve in fluid flow communication between said annulus at said wellhead and said collection facility and actuable between open and closed orientation; and said step (g) is carried out by actuating said casing valve and said tubing valve into said closed orientation for said pre-charge interval.

82. The method of claim 81 in which:

said casing valve is retained in said closed orientation subsequent to said pre-charge interval at least until said step (m) detection of said plunger arrival.

83. The method of claim 82 in which:

said step (n) is carried out by actuating said casing valve into said open orientation.

84. The method of claim 82 in which:

said step (n) is carried out by actuating said casing valve into said open orientation following a casing delay interval commencing with said step (m) detection of said plunger arrival.

85. The method of claim 84 further comprising the step of:

(r) determining an optimum said plunger speed;

said step (m) includes the step:

(m1) determining the speed at which said plunger traveled from said bottom location to said wellhead;

said step (n) casing delay interval is determined to adjust the speed of said plunger toward said optimum plunger speed during a succeeding said well production cycle.

86. The method of claim 68 further comprising the steps of:

(s) providing a casing valve in fluid flow communication between said annulus at said wellhead and said collection facility and actuable between open and closed orientations;

(t) providing an injection valve in fluid flow communication between said annulus at said wellhead and a source of gas under pressure, and actuable between open and closed orientations;

said casing valve and said tubing valve are actuated into said closed orientation at least during said step (q) pre-charge interval; and said step (g) is carried out by actuating said injection valve into said open orientation for said pre-charge interval.

87. The method of claim 86 in which:

said step (j) is carried out by actuating said injection valve into said open orientation until said step (m) detection of said plunger arrival.

88. The method of claim 87 further comprising the step of:

(r) determining an optimum said plunger speed;

said step (m) includes the step:

(m1) determining the speed at which said plunger traveled from said bottom location to said wellhead;

said step (j) is carried out by actuating said injection valve into said open orientation following a boost delay interval commencing with said step (k) actuation of said tubing valve into said open orientation to commence said on-time;

said step (j) boost delay interval is determined to adjust the speed of said plunger toward said optimum plunger speed during a succeeding said well production cycle.

89. The method of claim 68 in which:

said step (b) provides said entrance valve assembly as a check valve having a biased configuration providing a pressure relief function wherein excessive levels of fluid within said tubing assembly are transferred into said lower region.

90. The method of claim 68 in which:

said step (b) provides said entrance valve assembly as comprising a ball valve assembly having a ball and a seat configured with a fluid bypass channel, said seat being biased upwardly with a predetermined bias force effective for opening said bypass channel in the presence of excessive pressure within said tubing assembly.

91. The method of claim 68 further comprising the steps of:

(u) assigning an on-time interval with respect to said tubing assembly;

(v) determining time related data corresponding with good or a range of good, a range of fast and a range of slow rates of movement of said plunger from said bottom location to said wellhead;

(w) assigning time increment adjustments for at least one well control parameter affecting the rate of movement of said plunger;

(x) determining a plunger arrival interval with respect to said step (k) actuation of said tubing valve into said open orientation and said step (m) of detecting the arrival of said plunger at said wellhead;

(y) evaluating said plunger arrival interval with respect to said time related data; and (z) altering the extent of said well control parameter by a said time increment adjustment in correspondence with an evaluation determining fast or slow movement of said plunger.

92. The method of claim 91 in which said step (z) further adjusts the value of said time increment adjustment in proportion to its proximity to said good or a range of good rate or rates of movement.

93. The method of claim 92 in which said step (z) further adjustment for said fast rates of movement is carried out by applying a factor, PA to said time increment adjustment where $PA=(AT/FT-1)/(-F)$ where AT is the time of travel of said plunger, FT is the time span of said range of fast rates, and F is a selected decimal representation of a time location within said range of fast rates.

94. The method of claim 93 in which F is about 0.5.

95. The method of claim 91 in which said step (z) further adjustment for said slow rates of movement is carried out by applying a factor, PA to said time increment adjustment where $PA=(AT-ST)/F(ON-ST)$ where AT is the time of travel of said plunger, ST is the time within said assigned on-time interval representing the commencement of said determined slow rate of movement of said plunger, ON is the said on-time interval, and F is a selected decimal representation of a time location between ST and ON.

96. The method of claim 95 in which F is about 0.5.

97. The method of operating a well installation having a wellhead in fluid transfer relationship with a collection facility, having a well casing extending from said wellhead within a geologic formation to a lower region having a perforation interval and exhibiting a fault at a given location, said installation having a tubing string extending within said casing from said wellhead to a fluid input at said lower region, the space between said tubing string and said casing defining a first annulus, said method comprising the steps of:

(a) sealing said first annulus at a location below said given location and above said perforation interval;

(b) providing a plunger lift tube within said tubing string spaced therefrom to define a second annulus and extending to a tubing input and having a fluid input located above said tubing input;

(c) sealing said second annulus to block the flow of formation fluids thereinto;

(d) providing a formation fluid receiving assembly defining a chamber with said second annulus and said plunger lift tube, said chamber having a lower disposed check valve function with an open orientation admitting formation fluid within said chamber and responsive to fluid pressure at said second annulus to define a U-tube function with said plunger lift tube fluid input;

(e) providing a plunger within said plunger lift tube movable between a bottom position located above said fluid input and said wellhead;

(f) providing a tubing valve in fluid flow communication between said plunger lift tube and said collection facility, actuable between open and closed orientations;

(g) providing a casing valve in fluid flow communication between said second annulus and said collection facility, actuable between open and closed orientations;

(h) accumulating formation fluid within said chamber through said fluid receiving assembly when said tubing valve and said casing valve are in said open orientation;

(i) actuating said tubing valve and said casing valve into said closed orientation;

(j) effecting a pressurization of said second annulus for a pre-charge interval;

(k) then actuating said tubing valve into said open orientation for a purge interval effective to transfer fluid from said second annulus through said fluid input into said plunger lift tube;

(l) actuating said tubing valve into said open orientation to effect movement of said plunger to said wellhead;

(m) actuating said casing valve into said open orientation for an afterflow interval when said plunger arrives at said wellhead;

(n) closing said tubing valve for an off-time interval permitting said plunger to move toward said bottom position; and (o) reiterating said steps (h) through (n) to define a sequence of well production cycles.

98. The method of claim 97 in which:

said steps (j) and (i) are carried out by injecting gas into said secondary annulus from a source of gas under pressure.

99. The method of claim 97 further comprising the step of:

(p) subsequent to said step (k), actuating said tubing valve into said closed orientation for a post purge interval effective to permit positioning of said plunger at said bottom position.

100. The method of claim 97 further comprising the steps of:

(q) assigning an on-time interval with respect to said plunger lift tube;

(r) determining time related data corresponding with good or a range of good, a range of fast and a range of slow rates of movement of said plunger from said bottom position to said wellhead;

(s) assigning time increment adjustment for at least one well control parameter affecting said rate of movement of said plunger;

(t) determining a plunger arrival interval with respect to said step (l) actuation of said tubing valve into said open orientation;

(u) evaluating said plunger arrival interval with respect to said time related data; and (v) altering the extent of said well control parameter by a said time increment adjustment in correspondence with an evaluation determining fast or slow movement of said plunger.

101. The method of claim 100 in which said step (v) further adjusts the value of said time increment adjustment in proportion to its proximity to said good or a range of good rate or rates of movement.

102. The method of operating a well installation having a wellhead in fluid transfer relationship with a collection facility, having a well casing extending from said wellhead within a geologic formation to a lower region having a perforation interval, having a tubing assembly extending within said casing from said wellhead to a tubing input at said lower region, the space between said tubing assembly and said casing defining an annulus, said method comprising the steps of:

(a) sealing said annulus with a seal to block the flow of formation fluids thereinto;

(b) providing a fluid input above said tubing assembly tubing input;

(c) providing a formation fluid receiving assembly defining a chamber with said annulus, said tubing assembly and said fluid input, said chamber having a lower disposed check valve function with an open orientation admitting formation fluid within said chamber and responsive to fluid pressure at said annulus to define a U-tube function with said tubing assembly fluid input;

(d) providing a plunger within said tubing assembly movable between a bottom position located above said fluid input and said wellhead;

(e) providing a tubing valve in fluid flow communication between said tubing assembly and said collection facility, actuable between open and closed orientations;

(f) providing a casing valve in fluid flow communication between said annulus and said collection facility, actuatable between open and closed orientations;

(g) accumulating formation fluid within said chamber through said fluid receiving assembly when said tubing valve and said casing valve are in said open orientation;

(h) actuating said tubing valve and said casing valve into said closed orientation;

(i) effecting a pressurization of said annulus above said seal;

(j) actuating said tubing valve into said open orientation for a purge interval effective to transfer fluid from said annulus through said fluid input into said tubing assembly;

(k) commencing an on-time by actuating said tubing valve into said open orientation;

(l) detecting the arrival of said plunger at said wellhead;

(m) actuating said casing valve into said open orientation for an afterflow gas production interval in response to said step (l) detection of said plunger at said wellhead;

(n) closing said tubing valve for an off-time interval permitting said plunger to move toward said bottom position; and (o) reiterating said steps (g) through (n) to define a sequence of well production cycles.

103. The method of claim 102 in which said steps (i) and (k) are carried out by injecting gas under pressure into said annulus from a source of gas under pressure.

104. The method of claim 102 further comprising the step of:

(p) subsequent to said step (j) actuating said tubing valve into said closed orientation for a post purge interval effective to permit positioning of said plunger at said bottom position.

105. The method of claim 102 further comprising the steps of:

(q) assigning an on-time interval with respect to said tubing assembly;

(r) determining time related data corresponding with good or a range of good, a range of fast and a range of slow rates of movement of said plunger from said bottom position to said wellhead;

(s) assigning time increment adjustment for at least one well control parameter affecting the rate of movement of said plunger;

(t) determining a plunger arrival interval with respect to said step (k) actuation of said tubing valve and said step (l) detecting the arrival of said plunger;

(u) evaluating said plunger arrival interval with respect to said time related data; and (v) altering the extent of said well control parameter by a said time increment adjustment in correspondence with an evaluation determining fast and slow movement of said plunger.

106. The method of claim 105 in which said step (v) further adjusts the value of said time increment adjustment in proportion to its proximity to said good or a range of good rate or rates of movement.

107. The method of claim 106 in which said step (v) further adjustment for said fast rates of movement is carried out by applying a factor, PA to said time increment adjustment where PA=(AT/FT−1)/(−F) where AT is the time of travel of said plunger, FT is the time span of said range of fast rates, and F is a selected decimal representation of a time location within said range of fast rates.

108. The method of claim 107 in which F is about 0.5.

109. The method of claim 107 in which:

said step (c) provides said check valve function as comprising a ball valve assembly having a ball and a seat configured with a fluid bypass channel, said seat being biased upwardly with a predetermined bias force effective for opening said bypass channel in the presence of excessive pressure within said tubing assembly.

110. The method of claim 108 in which said step (v) further adjustment for said slow rates of movement is carried out by applying a factor, PA to said time increment adjustment where PA=(AT−ST)/F(ON−ST) where AT is the time of travel of said plunger, ST is the time within said assigned on-time interval representing the commencement of said determined slow rate of movement of said plunger, ON is the said on-time interval, and F is a selected decimal representation of a time location between ST and ON.

111. The method of claim 110 in which F is about 0.5.

112. The method of claim 102 in which said step (c) provides said check valve function as a check valve having a biased configuration providing a pressure relief function wherein excessive levels of fluid within said tubing assembly are transferred into said lower region.

113. The method for operating a well installation having a casing extending within a geologic formation from a wellhead to a bottom region, said casing having a perforation interval extending to an end location at a given depth, said installation including a collection facility and a source of gas under pressure having an injection output, comprising the steps of:

(a) providing a tubing assembly within said casing including a plunger lift tube having a tube outlet at said wellhead and extending to a tubing input located in adjacency with or below said perforation interval end location communicable in fluid passage relationship with formation fluids and having an injection input;

(b) providing an injection passage adjacent said plunger lift tube extending from said injection output at least to said plunger lift tube injection input;

(c) providing a plunger within said plunger lift tube movable between a bottom position located above said injection input and said wellhead;

(d) providing a formation fluid receiving assembly defining a chamber with said injection passage in fluid communication with said tubing assembly, said chamber having a lower disposed check valve assembly with an open orientation admitting formation fluid within said chamber and responsive to injection fluid pressure to define a U-tube function with said injection passage and said tubing assembly, said check valve assembly being provided in a biased configuration providing a pressure relief function wherein excessive levels of fluid within said plunger lift tube are transferred into said bottom region;

(e) providing a tubing valve between said tube outlet and said collection facility actuable between an open orientation permitting the flow of fluid to said collection facility and a closed orientation blocking said tube outlet;

(f) providing an injection control assembly actuable between an open condition effecting application of gas under pressure from said pressurized gas output to said injection gas input and a closed condition;

(g) providing a detector at said wellhead having a detector output in response to the arrival of said plunger at said wellhead;

(h) accumulating formation fluid into said chamber by passage thereof through said check valve assembly;

(i) moving fluid from said chamber into said tubing assembly above said plunger;

(j) actuating said injection control assembly to said open condition to apply gas under pressure to said defined U-tube from said injection input, to impart upward movement to said plunger;

(k) actuating said tubing valve to said open orientation;

(l) actuating said injection control assembly to said closed condition in response to said detector output; and (m) then, actuating said tubing valve into said closed orientation for an off-time interval at least sufficient for the movement of said plunger from said wellhead to said bottom position.

114. The method for operating a well installation having a casing extending within a geologic formation from a wellhead to a bottom region, said casing having a perforation interval extending to an end location at a given depth, said installation including a collection facility and a source of gas under pressure having an injection output, comprising the steps of:

(a) providing a tubing assembly within said casing including a plunger lift tube having a tube outlet at said wellhead and extending to a tubing input located in adjacency with or below said perforation interval end location communicable in fluid passage relationship with formation fluids and having an injection input;

(b) providing an injection passage adjacent said plunger lift tube extending from said injection output at least to said plunger lift tube injection input;

(c) providing a plunger within said plunger lift tube movable between a bottom position located above said injection input and said wellhead;

(d) providing a formation fluid receiving assembly defining a chamber with said injection passage in fluid communication with said tubing assembly, said chamber having a lower disposed check valve assembly with an open orientation admitting formation fluid within said chamber and responsive to injection fluid pressure to define a U-tube function with said injection passage and said tubing assembly, said check valve assembly being provided as comprising a ball valve assembly having a ball and a seat configured with a fluid bypass channel, said seat being biased upwardly with a predetermined bias force effective for opening said bypass channel in the presence of excessive pressure within said plunger lift tube;

(e) providing a tubing valve between said tube outlet and said collection facility actuable between an open orientation permitting the flow of fluid to said collection facility and a closed orientation blocking said tube outlet;

(f) providing an injection control assembly actuable between an open condition effecting application of gas under pressure from said pressurized gas output to said injection gas input and a closed condition;

(g) providing a detector at said wellhead having a detector output in response to the arrival of said plunger at said wellhead;

(h) accumulating formation fluid into said chamber by passage thereof through said check valve assembly:

(i) moving fluid from said chamber into said tubing assembly above said plunger;

(j) actuating said injection control assembly to said open condition to apply gas under pressure to said defined U-tube from said injection input, to impart upward movement to said plunger;

(k) actuating said tubing valve to said open orientation;

(l) actuating said injection control assembly to said closed condition in response to said detector output; and (m) then, actuating said tubing valve into said closed orientation for an off-time interval at least sufficient for the movement of said plunger from said wellhead to said bottom position.

115. The method for operating a well installation having a casing extending within a geologic formation from a wellhead to a bottom region, said casing having a perforation interval extending to an end location at a given depth, said installation including a collection facility and a source of gas under pressure having an injection output, comprising the steps of:

(a) providing a tubing assembly within said casing including a plunger lift tube having a tube outlet at said wellhead and extending to a tubing input located in adjacency with or below said perforation interval end location communicable in fluid passage relationship with formation fluids and having an injection input;

(b) providing an injection passage adjacent said plunger lift tube extending from said injection output at least to said plunger lift tube injection input;

(c) providing a plunger within said plunger lift tube movable between a bottom position located above said injection input and said wellhead;

(d) providing a formation fluid receiving assembly defining a chamber with said injection passage in fluid communication with said tubing assembly, said chamber having a lower disposed check valve assembly with an open orientation admitting formation fluid within said chamber and responsive to injection fluid pressure to define a U-tube function with said injection passage and said tubing assembly;

(e) providing a tubing valve between said tube outlet and said collection facility actuable between an open orientation permitting the flow of fluid to said collection facility and a closed orientation blocking said tube outlet;

(f) providing an injection control assembly actuable between an open condition effecting application of gas under pressure from said pressurized gas output to said injection gas input and a closed condition;

(g) providing a detector at said wellhead having a detector output in response to the arrival of said plunger at said wellhead;

(h) accumulating formation fluid into said chamber by passage thereof through said check valve assembly;

(i) moving fluid from said chamber into said tubing assembly above said plunger;

(j) actuating said injection control assembly to said open condition to apply gas under pressure to said defined U-tube from said injection input, to impart upward movement to said plunger;

(k) actuating said tubing valve to said open orientation;

(l) actuating said injection control assembly to said closed condition in response to said detector output;

(m) then, actuating said tubing valve into said closed orientation for an off-time interval at least sufficient for the movement of said plunger from said wellhead to said bottom position;

(n) assigning an on-time interval with respect to said plunger lift tube;

(o) determining time related data corresponding with good or a range of good, a range of fast and a range of slow rates of movement of said plunger from said bottom position to said wellhead;

(p) assigning time increment adjustments for at least one well control parameter affecting the rate of movement of said plunger;

(q) determining a plunger arrival interval with respect to said actuation of said tubing valve into said open orientation and a subsequently occurring said detector output;

(r) evaluating said plunger arrival interval with respect to said time related data;

(s) altering the extent of a said well control parameter by a said time increment adjustment in correspondence with an evaluation determining fast or slow movement of said plunger;

said step (s) further adjusts the value of said time increment adjustment in proportion to its proximity to said good or a range of good rate or rates of movement; and in which said step (s) further adjustment for said fast rates of movement is carried out by applying a factor, PA to said time increment adjustment where PA=(AT/FT−1/(−F) where AT is the time of travel of said plunger, FT is the time span of said range of fast rates, and F is a selected decimal representation of a time location within said range of fast rates.

116. The method of claim 115 in which F is about 0.5.

117. The method for operating a well installation having a casing extending within a geologic formation from a wellhead to a bottom region, said casing having a perforation interval extending to an end location at a given depth, said installation including a collection facility and a source of gas under pressure having an injection output, comprising the steps of:

(a) providing a tubing assembly within said casing including a plunger lift tube having a tube outlet at said wellhead and extending to a tubing input located in adjacency with or below said perforation interval end location communicable in fluid passage relationship with formation fluids and having an injection input;

(b) providing an injection passage adjacent said plunger lift tube extending from said injection output at least to said plunger lift tube injection input;

(c) providing a plunger within said plunger lift tube movable between a bottom position located above said injection input and said wellhead;

(d) providing a formation fluid receiving assembly defining a chamber with said injection passage in fluid communication with said tubing assembly, said chamber having a lower disposed check valve assembly with an open orientation admitting formation fluid within said chamber and responsive to injection fluid pressure to define a U-tube function with said injection passage and said tubing assembly;

(e) providing a tubing valve between said tube outlet and said collection facility actuable between an open orientation permitting the flow of fluid to said collection facility and a dosed orientation blocking said tube outlet;

(f) providing an injection control assembly actuable between an open condition effecting application of gas under pressure from said pressurized gas output to said injection gas input and a closed condition;

(g) providing a detector at said wellhead having a detector output in response to the arrival of said plunger at said wellhead;

(h) accumulating formation fluid into said chamber by passage thereof through said check valve assembly;

(i) moving fluid from said chamber into said tubing assembly above said plunger;

(j) actuating said injection control assembly to said open condition to apply gas under pressure to said defined U-tube from said injection input, to impart upward movement to said plunger;

(k) actuating said tubing valve to said open orientation;

(l) actuating said injection control assembly to said closed condition in response to said detector output;

(m) then, actuating said tubing valve into said closed orientation for an off-time interval at least sufficient for the movement of said plunger from said wellhead to said bottom position;

(n) assigning an on-time interval with respect to said plunger lift tube;

(o) determining time related data corresponding with good or a range of good, a range of fast and a range of slow rates of movement of said plunger from said bottom position to said wellhead;

(p) assigning time increment adjustments for at least one well control parameter affecting the rate of movement of said plunger;

(q) determining a plunger arrival interval with respect to said actuation of said tubing valve into said open orientation and a subsequently occurring said detector output;

(r) evaluating said plunger arrival interval with respect to said time related data;

(s) altering the extent of a said well control parameter by a said time increment adjustment in correspondence with an evaluation determining fast or slow movement of said plunger; and in which said step (s) further adjustment for said slow rates of movement is carried out by applying a factor, PA to said time increment adjustment where PA=(AT−ST)/F(ON−ST) where AT is the time of travel of said plunger, ST is the time within said assigned on-time interval representing the commencement of said determined slow rate of movement of said plunger, ON is the said on-time interval, and F is a selected decimal representation of a time location between ST and ON.

118. The method of claim 117 in which F is about 0.5.

119. The method of operating a well installation having a wellhead in fluid transfer relationship with a collection facility and with a well casing extending within a geologic formation and having a perforation interval effectively extending a given depth to an interval depth location, and having a source of gas under pressure with a pressurized gas output, comprising the steps of:

(a) providing an injection passage within said casing, having an injection input coupled with said pressurized gas output extending to an injection outlet and defining a casing production region with said casing;

(b) providing a plunger lift tube at least partially within said injection passage extending from an outlet at said wellhead to a tubing input, said plunger lift tube being communicable in fluid passage relationship with said injection outlet at an injection location;

(c) providing a plunger within said plunger lift tube movable between a bottom position located above said injection location and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) collecting formation fluid into said plunger lift tube above said plunger bottom position;

(f) communicating said plunger lift tube outlet in fluid transfer relationship with said surface collection facility;

(g) applying injection gas under pressure from said pressurized gas output to said injection input for an injection interval effective to move said plunger to said wellhead and to move formation liquid located above it through said outlet and into said surface collection facility; and (h) communicating said casing production region in gas transfer relationship with said surface collection facility;

(i) assigning an on-time interval with respect to said plunger lift tube;

(j) determining time related data corresponding with good or a range of good, a range of fast and a range of slow rates of movement of said plunger from said bottom position to said wellhead;

(k) assigning time increment adjustments for at least one well control parameter affecting the rate of movement of said plunger;

(l) determining a plunger arrival interval with respect to said interval effective to move said plunger to said wellhead;

(m) evaluating said plunger arrival interval with respect to said time related data;

(n) altering the extent of said well control parameter by a said time increment adjustment in correspondence with an evaluation determining fast or slow movement of said plunger;

in which said step (n) further adjusts the value of said time increment adjustment in proportion to its proximity to said good or a range of good rate or rates of movement; and in which said step (n) further adjustment for said fast rates of movement is carried out by applying a factor, PA to said time increment adjustment where PA=(AT/FT−1/(−F) where AT is the time of travel of said plunger, FT is the time span of said range of fast rates, and F is a selected decimal representation of a time location within said range of fast rates.

120. The method of claim 119 in which F is about 0.5.

121. The method of operating a well installation having a wellhead in fluid transfer relationship with a collection facility and with a well casing extending within a geologic formation and having a perforation interval effectively extending a given depth to an interval depth location, and having a source of gas under pressure with a pressurized gas output, comprising the steps of:

(a) providing an injection passage within said casing, having an injection input coupled with said pressurized gas output extending to an injection outlet and defining a casing production region with said ca sing;

(b) providing a plunger lift tube at least partially within said injection passage extending from an outlet at said wellhead to a tubing input, said plunger lift tube being communicable in fluid passage relationship with said injection outlet at an injection location;

(c) providing a plunger within said plunger lift tube movable between a bottom position located above said injection location and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) collecting formation fluid into said plunger lift tube above said plunger bottom position;

(f) communicating said plunger lift tube outlet in fluid transfer relationship with said surface collection facility;

(g) applying injection gas under pressure from said pressurized gas output to said injection input for an injection interval effective to move said plunger to said wellhead and to move formation liquid located above it through said outlet and into said surface collection facility;

(h) communicating said casing production region in gas transfer relationship with said surface collection facility;

(i) assigning an on-time interval with respect to said plunger lift tube;

(j) determining time related data corresponding with good or a range of good, a range of fast and a range of slow rates of movement of said plunger from said bottom position to said wellhead;

(k) assigning time increment adjustments for at least one well control parameter affecting the rate of movement of said plunger;

(l) determining a plunger arrival interval with respect to said interval effective to move said plunger to said wellhead;

(m) evaluating said plunger arrival interval with respect to said time related data;

(n) altering the extent of said well control parameter by a said time increment adjustment in correspondence with an evaluation determining fast or slow movement of said plunger; and in which said step (n) further adjustment for said slow rates of movement is carried out by applying a factor, PA to said time increment adjustment where PA=(AT−ST)/F(ON−ST) where AT is the time of travel of said plunger, ST is the time within said assigned on-time interval representing the commencement of said determined slow rate of movement of said plunger, ON is the said on-time interval, and F is a selected decimal representation of a time location between ST and ON.

122. The method of claim 119 in which F is about 0.5.

123. The method of operating a well installation having a wellhead in fluid transfer relationship with a collection facility and with a well casing extending within a geologic formation and having a perforation interval effectively extending a given depth to an interval depth location, and having a source of gas under pressure with a pressurized gas output, comprising the steps of:

(a) providing an injection passage within said casing, having an injection input coupled with said pressurized gas output extending to an injection outlet and defining a casing production region with said casing;

(b) providing a plunger lift tube at least partially within said injection passage extending from an outlet at said wellhead to a tubing input, said plunger lift tube being communicable in fluid passage relationship with said injection outlet at an injection location;

(c) providing a plunger within said plunger lift tube movable between a bottom position located above said injection location and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) collecting formation fluid into said plunger lift tube above said plunger bottom position;

(f) communicating said plunger lift tube outlet in fluid transfer relationship with said surface collection facility;

(g) applying injection gas under pressure from said pressurized gas output to said injection input for an injection interval effective to move said plunger to said wellhead and to move formation liquid located above it through said outlet and into said surface collection facility;

(h) communicating said casing production region in gas transfer relationship with said surface collection facility; and in which said step (d) provides said check valve in a biased configuration providing a pressure relief function wherein excessive levels of fluid within said plunger lift tube are transferred into said bottom region.

124. The method of operating a well installation having a wellhead in fluid transfer relationship with a collection facility and with a well casing extending within a geologic formation and having a perforation interval effectively extending a given depth to an interval depth location, and having a source of gas under pressure with a pressurized gas output, comprising the steps of:

(a) providing an injection passage within said casing, having an injection input coupled with said pressurized gas output extending to an injection outlet and defining a casing production region with said casing;

(b) providing a plunger lift tube at least partially within said injection passage extending from an outlet at said wellhead to a tubing input, said plunger lift tube being communicable in fluid passage relationship with said injection outlet at an injection location;

(c) providing a plunger within said plunger lift tube movable between a bottom position located above said injection location and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) collecting formation fluid into said plunger lift tube above said plunger bottom position;

(f) communicating said plunger lift tube outlet in fluid transfer relationship with said surface collection facility;

(g) applying injection gas under pressure from said pressurized gas output to said injection input for an injection interval effective to move said plunger to said wellhead and to move formation liquid located above it through said outlet and into said surface collection facility;

(h) communicating said casing production region in gas transfer relationship with said surface collection facility; and in which said step (d) provides said check valve as comprising a ball valve assembly having a ball and a seat configured with a fluid bypass channel, said seat being biased upwardly with a predetermined bias force effective for opening said bypass channel in the presence of excessive pressure within said plunger lift tube.

125. The method for operating a well installation having a casing extending within a geologic formation from a wellhead to a bottom region, said installation including a collection facility, and having a source of gas under pressure with a pressurized gas output, comprising the steps of:

(a) providing a tubing assembly within said casing having a plunger lift tube with a tube outlet at said wellhead, extending to a tubing input located to receive formation fluid;

(b) providing an injection passage extending from an injection gas input at said wellhead to an injection outlet;

(c) providing a plunger within said plunger lift tube movable between a bottom position and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) providing a detector at said wellhead having a detector output in response to the arrival of said plunger at said wellhead;

(f) providing a tubing valve between said tube outlet and said collection facility actuable between an open orientation permitting the flow of fluid to said collection facility and a closed orientation blocking said tube outlet;

(g) providing an injection valve between said pressurized gas outlet and said injection gas input actuable between an open orientation effecting application of gas under pressure to said injection outlet and a closed orientation;

(h) providing an equalizing valve in gas flow communication between said injection gas input and said collection facility, actuable between an open orientation providing said flow communication and a closed orientation blocking said communication:

(i) accumulating formation fluid into said chamber through said check valve when said equalizing valve is in said open orientation, said injection valve is in said closed orientation and said check valve is in said open orientation;

(j) moving formation fluid accumulated within said chamber into said plunger lift tube above said plunger;

(k) actuating said equalizing valve into said closed orientation;

(l) actuating said injection valve into said open orientation;

(m) actuating said tubing valve into said open orientation to effect movement of said plunger toward said wellhead; and in which said step (d) provides said check valve in a biased configuration providing a pressure relief function wherein excessive levels of fluid within said plunger lift tube are transferred into said bottom region.

126. The method for operating a well installation having a casing extending within a geologic formation from a wellhead to a bottom region, said installation including a collection facility, and having a source of gas under pressure with a pressurized gas output, comprising the steps of:

(a) providing a tubing assembly within said casing having a plunger lift tube with a tube outlet at said wellhead, extending to a tubing input located to receive formation fluid;

(b) providing an injection passage extending from an injection gas input at said wellhead to an injection outlet;

(c) providing a plunger within said plunger lift tube movable between a bottom position and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) providing a detector at said wellhead having a detector output in response to the arrival of said plunger at said wellhead;

(f) providing a tubing valve between said tube outlet and said collection facility actuable between an open orientation permitting the flow of fluid to said collection facility and a closed orientation blocking said tube outlet;

(g) providing an injection valve between said pressurized gas outlet and said injection gas input actuable between an open orientation effecting application of gas under pressure to said injection outlet and a closed orientation;

(h) providing an equalizing valve in gas flow communication between said injection gas input and said collection facility, actuable between an open orientation providing said flow communication and a closed orientation blocking said communication;

(i) accumulating formation fluid into said chamber through said check valve when said equalizing valve is in said open orientation, said injection valve is in said closed orientation and said check valve is in said open orientation;

(j) moving formation fluid accumulated within said chamber into said plunger lift tube above said plunger;

(k) actuating said equalizing valve into said closed orientation;

(l) actuating said injection valve into said open orientation;

(m) actuating said tubing valve into said open orientation to effect movement of said plunger toward said wellhead; and in which said step (d) provides said check valve as comprising a ball valve assembly having a ball and a seat configured with a fluid bypass channel, said seat being biased upwardly with a predetermined bias force effective for opening said bypass channel in the presence of excessive pressure within said plunger lift tube.

127. The method for operating a well installation having a casing extending within a geologic formation from a wellhead to a bottom region, said installation including a collection facility, and having a source of gas under pressure with a pressurized gas output, comprising the steps of:

(a) providing a tubing assembly within said casing having a plunger lift tube with a tube outlet at said wellhead, extending to a tubing input located to receive formation fluid;

(b) providing an injection passage extending from an injection gas input at said wellhead to an injection outlet;

(c) providing a plunger within said plunger lift tube movable between a bottom position and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) providing a detector at said wellhead having a detector output in response to the arrival of said plunger at said wellhead;

(f) providing a tubing valve between said tube outlet and said collection facility actuable between an open orientation permitting the flow of fluid to said collection facility and a closed orientation blocking said tube outlet;

(g) providing an injection valve between said pressurized gas outlet and said injection gas input actuable between an open orientation effecting application of gas under pressure to said injection outlet and a closed orientation;

(h) providing an equalizing valve in gas flow communication between said injection gas input and said collection facility, actuable between an open orientation providing said flow communication and a closed orientation blocking said communication;

(i) accumulating formation fluid into said chamber through said check valve when said equalizing valve is in said open orientation, said injection valve is in said closed orientation and said check valve is in said open orientation;

(j) moving formation fluid accumulated within said chamber into said plunger lift tube above said plunger;

(k) actuating said equalizing valve into said closed orientation;

(l) actuating said injection valve into said open orientation;

(m) actuating said tubing valve into said open orientation to effect movement of said plunger toward said wellhead;

(n) assigning an on-time interval with respect to said plunger lift tube;

(o) determining time related data corresponding with good or a range of good, a range of fast and a range of slow rates of movement of said plunger from said bottom position to said wellhead;

(p) assigning time increment adjustments for at least one well control parameter affecting the rate of movement of said plunger;

(q) determining a plunger arrival interval with respect to said actuation of said tubing valve into said open orientation and a subsequently occurring said detector output;

(r) evaluating said plunger arrival interval with respect to said time related data;

(s) altering the extent of a said well control parameter by a said time increment adjustment in correspondence with an evaluation determining fast or slow movement of said plunger;

in which said step (s) further adjusts the value of said time increment adjustment in proportion to its proximity to said good or a range of good rate or rates of movement; and in which said step (s) further adjustment for said fast rates of movement is carried out by applying a factor, PA to said time increment adjustment where PA=(AT/FT−1)/(−F) where AT is the time of travel of said plunger, FT is the time span of said range of fast rates, and F is a selected decimal representation of a time location within said range of fast rates.

128. The method for operating a well installation having a casing extending within a geologic formation from a wellhead to a bottom region, said installation including a collection facility, and having a source of gas under pressure with a pressurized gas output, comprising the steps of:

(a) providing a tubing assembly within said casing having a plunger lift tube with a tube outlet at said wellhead, extending to a tubing input located to receive formation fluid;

(b) providing an injection passage extending from an injection gas input at said wellhead to an injection outlet;

(c) providing a plunger within said plunger lift tube movable between a bottom position and said wellhead;

(d) providing a formation fluid receiving assembly defining a chamber with said injection passage in fluid communication with said plunger lift tube and said injection outlet, said chamber having a check valve with an open orientation admitting formation fluid within said chamber and responsive to fluid pressure to define a U-tube function with said injection passage and said plunger lift tube;

(e) providing a detector at said wellhead having a detector output in response to the arrival of said plunger at said wellhead;

(f) providing a tubing valve between said tube outlet and said collection facility actuable between an open orientation permitting the flow of fluid to said collection facility and a closed orientation blocking said tube outlet;

(g) providing an injection valve between said pressurized gas outlet and said injection gas input actuable between an open orientation effecting application of gas under pressure to said injection outlet and a closed orientation;

(h) providing an equalizing valve in gas flow communication between said injection gas input and said collection facility, actuable between an open orientation providing said flow communication and a closed orientation blocking said communication;

(i) accumulating formation fluid into said chamber through said check valve when said equalizing valve is in said open orientation, said injection valve is in said closed orientation and said check valve is in said open orientation;

(j) moving formation fluid accumulated within said chamber into said plunger lift tube above said plunger, (k) actuating said equalizing valve into said closed orientation;

(l) actuating said injection valve into said open orientation;

(m) actuating said tubing valve into said open orientation to effect movement of said plunger toward said wellhead;

(n) assigning an on-time interval with respect to said plunger lift tube;

(o) determining time related data corresponding with good or a range of good, a range of fast and a range of slow rates of movement of said plunger from said bottom position to said wellhead;

(p) assigning time increment adjustments for at least one well control parameter affecting the rate of movement of said plunger, (q) determining a plunger arrival interval with respect to said actuation of said tubing valve into said open orientation and a subsequently occurring said detector output;

(r) evaluating said plunger arrival interval with respect to said time related data;

(s) altering the extent of a said well control parameter by a said time increment adjustment in correspondence with an evaluation determining fast or slow movement of said plunger; and in which said step (s) further adjustment for said slow rates of movement is carried out by applying a factor, PA to said time increment adjustment where PA=(AT−ST)/F(ON−ST) where AT is the time of travel of said plunger, ST is the time within said assigned on-time interval representing the commencement of said determined slow rate of movement of said plunger, ON is the said on-time interval, and F is a selected decimal representation of a time location between ST and ON.

129. The method of claim 128 in which F is about 0.5.

* * * * *